US012594509B2

(12) United States Patent
Farco et al.

(10) Patent No.: US 12,594,509 B2
(45) Date of Patent: Apr. 7, 2026

(54) INTERCONNECTING METHODS AND SYSTEMS FOR POSABLE BENDABLE BUILDING BLOCK TOYS

(71) Applicants: Joseph Farco, Massapequa Park, NY (US); Daniele Benedettelli, Grossetto (IT)

(72) Inventors: Joseph Farco, Massapequa Park, NY (US); Daniele Benedettelli, Grossetto (IT)

(73) Assignee: Farco ToyCo LLC, Wantagh, NY (US)

( * ) Notice: Subject to any disclaimer, the term of this patent is extended or adjusted under 35 U.S.C. 154(b) by 79 days.

(21) Appl. No.: 18/235,841

(22) Filed: Aug. 19, 2023

(65) Prior Publication Data

US 2025/0058241 A1 Feb. 20, 2025

(51) Int. Cl.

| | |
|---|---|
| ***A63H 3/04*** | (2006.01) |
| ***A63H 3/16*** | (2006.01) |
| ***A63H 3/46*** | (2006.01) |
| ***A63H 33/04*** | (2006.01) |
| ***A63H 33/06*** | (2006.01) |
| ***A63H 33/08*** | (2006.01) |

(52) U.S. Cl.

CPC ..... *A63H 33/042* (2013.01); *A63H 3/04* (2013.01); *A63H 3/16* (2013.01); *A63H 3/46* (2013.01); *A63H 33/062* (2013.01); *A63H 33/086* (2013.01)

(58) Field of Classification Search

CPC ... A63H 3/04; A63H 3/16; A63H 3/36; A63H 3/46

See application file for complete search history.

(56) References Cited

U.S. PATENT DOCUMENTS

| | | | |
|---|---|---|---|
| 280,986 | A | 7/1883 | Wishard |
| 1,113,371 | A | 10/1914 | Pajeau |
| 1,189,585 | A | 7/1916 | Kruse |
| 1,276,117 | A | 8/1918 | Riebe |
| 1,551,250 | A | 8/1925 | Twombly |
| 1,590,898 | A | 6/1926 | Morris |
| 1,608,592 | A | 11/1926 | Funk |
| 1,661,283 | A | 3/1928 | Herman, V |
| 1,707,691 | A | 4/1929 | Sweet |

(Continued)

FOREIGN PATENT DOCUMENTS

| | | | |
|---|---|---|---|
| CN | 2137177 | Y | 6/1996 |
| CN | 201154223 | Y | 11/2008 |

(Continued)

OTHER PUBLICATIONS http://www.eurobricks.com/forum/index.php?showtopic=48318 (Nov. 2010).

(Continued)

*Primary Examiner* — John A Ricci

(57) ABSTRACT

An exemplary toy construction may comprise a posable building block whereby a portion of the posable building block is coupled by a clutch having at least one opening with a first central axis, and a lock having at least one opening with a second central axis, and the first central axis and the second central axis may not be colinear. The exemplary toy construction creates numerous types of joints between the posable building block and the clutch and lock, including a universal joint.

12 Claims, 33 Drawing Sheets

(56) References Cited

U.S. PATENT DOCUMENTS 1,843,115 A 2/1932 Ferris
1,898,297 A 2/1933 Barcley
2,017,023 A 10/1935 Rendle
2,019,516 A 11/1935 VVeinberg
2,073,723 A 3/1937 Noolnough
2,109,422 A 2/1938 Henry
2,144,751 A 1/1939 Brown
2,363,785 A 11/1944 Gold
2,392,024 A 1/1946 Cole
2,601,740 A 7/1952 Florence
2,633,662 A 4/1953 Nelson
2,683,329 A 7/1954 Kobler
2,684,503 A 7/1954 Silver
2,709,318 A 5/1955 Benjamin
2,800,743 A 7/1957 Renouf
2,854,786 A 10/1958 Sabo
3,019,552 A 2/1962 Friedrich
3,176,428 A 4/1965 Slingluff
3,206,611 A 9/1965 Onanian
3,242,610 A 3/1966 Chrstiansen
3,277,601 A 10/1966 Ryan
3,284,947 A * 11/1966 Dahl ..... A63H 3/04 446/374
3,286,391 A 11/1966 Mengeringhausen
3,325,939 A * 6/1967 Ryan ..... A63H 3/04 446/374
3,346,775 A 10/1967 Chrstiansen
3,395,484 A 8/1968 Smith
3,458,949 A 8/1969 Young
3,564,758 A 2/1971 Willis
3,574,968 A 4/1971 Schlau
3,605,323 A 9/1971 Fischer
3,624,691 A * 11/1971 Robson ..... A63H 3/04 446/374
3,624,960 A 12/1971 Folson
3,626,632 A 12/1971 Bullock
3,645,038 A 2/1972 Morrison
3,648,404 A 3/1972 Ogsbury
3,716,942 A 2/1973 Garcia et al.
3,858,578 A 1/1975 Milo
3,918,196 A 11/1975 Schleich
3,955,309 A 5/1976 Noble
3,975,858 A 8/1976 Much
3,998,005 A 12/1976 Way
4,078,328 A 3/1978 Rayment
4,107,870 A 8/1978 Nusnit
4,123,872 A 11/1978 Silva
4,136,484 A 1/1979 Abrams
4,141,177 A 2/1979 Vu
4,182,072 A 1/1980 Muell
4,182,076 A 1/1980 Much
4,193,639 A 3/1980 Pauly et al.
4,197,358 A 4/1980 Garcia
4,233,775 A 11/1980 Neufeld
4,244,140 A 1/1981 Kim
4,246,718 A 1/1981 Chatani
4,273,537 A 6/1981 Borisof
4,295,291 A * 10/1981 Fukui ..... A63H 3/46 446/380
4,302,900 A 12/1981 Rayner
4,393,728 A 7/1983 Larson et al.
4,422,850 A 12/1983 Groebner
4,470,784 A 9/1984 Piotrovsky
4,579,538 A 4/1986 Bass
4,652,248 A 3/1987 Kozuka
4,666,417 A 5/1987 Hillman
4,758,195 A 7/1988 Walsh
4,758,196 A 7/1988 Wang
4,883,440 A 11/1989 Belli
D307,775 S 5/1990 Pedersen
4,932,919 A 6/1990 Shapero
4,954,118 A 9/1990 Refabert
4,963,115 A 10/1990 Stowell et al.
4,964,836 A 10/1990 Kamei
4,988,322 A 1/1991 Knudsen
4,990,120 A 2/1991 Famiglietti
5,017,173 A 5/1991 Shapero et al.
5,061,219 A 10/1991 Glickman
5,114,377 A 5/1992 Cove Mercuri
5,137,486 A 8/1992 Glickman
5,310,376 A 5/1994 Mayuzurni
5,398,391 A 3/1995 Yokochi
5,433,549 A 7/1995 McGaffigan
5,498,190 A 3/1996 Ganson
5,516,314 A 5/1996 Anderson
5,528,909 A 6/1996 Tonakawa
5,630,745 A 5/1997 Yeh
5,733,168 A 3/1998 Poulsen et al.
5,752,869 A 5/1998 Huff
5,762,531 A 6/1998 Witkin
5,785,529 A 7/1998 Hearn
5,800,242 A 9/1998 Clokey
5,836,802 A 11/1998 Harnett
5,848,503 A 12/1998 Toft et al.
5,916,006 A 6/1999 Ganson
6,000,984 A 12/1999 Degner
6,074,270 A 6/2000 Wilcox et al.
6,155,904 A 12/2000 Spector
6,176,756 B1 1/2001 Panec
6,213,839 B1 4/2001 Pedersen
6,217,406 B1 4/2001 Ross
6,322,414 B1 11/2001 Lin
6,454,624 B1 9/2002 Duff et al.
6,461,215 B1 10/2002 Kunz et al.
6,475,117 B1 11/2002 Berglund
6,491,563 B1 12/2002 Bailey
6,648,715 B2 11/2003 Wiens et al.
6,676,474 B2 1/2004 Glickman
6,676,481 B2 1/2004 Klaus
6,736,691 B1 5/2004 Back
6,746,303 B2 6/2004 Beidokhti
6,800,016 B2 * 10/2004 Wittenberg ..... A63H 3/04 446/376
6,843,700 B2 1/2005 Glickman
6,848,663 B2 2/2005 Olive
6,966,812 B1 11/2005 Blonder
7,332,873 B2 2/2008 Newton
7,364,487 B2 4/2008 Evans et al.
7,374,468 B2 5/2008 Flodin
7,479,054 B2 1/2009 Wittenberg et al.
7,540,172 B2 6/2009 Julkowski
8,105,088 B2 1/2012 Charles
8,282,439 B2 10/2012 Han
8,371,894 B1 2/2013 Rosen et al.
8,382,548 B2 2/2013 Maggiore et al.
8,408,962 B2 4/2013 Sambenedetto
8,460,053 B2 6/2013 Fair et al.
8,708,765 B2 4/2014 Pope-Gusev
8,734,198 B1 5/2014 Seldin
8,753,164 B2 6/2014 Hansen et al.
8,756,894 B2 6/2014 Swartz et al.
8,851,953 B2 10/2014 Oschuetz et al.
8,961,257 B2 2/2015 Connor
8,986,012 B1 3/2015 McGee
9,345,982 B2 5/2016 Farco
9,630,118 B2 4/2017 Wong
9,849,398 B2 12/2017 Saigo et al.
10,111,467 B1 10/2018 Arnel
10,258,897 B2 4/2019 Farco
10,343,080 B2 7/2019 Jang
10,507,961 B2 12/2019 Gallup
10,576,391 B1 3/2020 Tong
11,103,799 B2 8/2021 Boyce et al.
11,202,969 B2 12/2021 Kaye
11,312,172 B1 4/2022 Derennaux
11,707,691 B2 * 7/2023 Boyce ..... A63H 3/50 446/376
2003/0020224 A1 1/2003 Murvine
2004/0087245 A1 5/2004 Toht
2005/0070199 A1 3/2005 Voves
2005/0227574 A1 10/2005 Balanchi
2006/0084300 A1 4/2006 Kowalski
2006/0151409 A1 7/2006 Schmoelzer
2007/0178799 A1 8/2007 Rudell

(56) References Cited

U.S. PATENT DOCUMENTS

| | | | | |
|---|---|---|---|---|
| 2009/0205997 | A1 | 8/2009 | Richards | |
| 2011/0177752 | A1 | 7/2011 | Patsiner | |
| 2011/0286217 | A1 | 11/2011 | Martinson | |
| 2012/0214380 | A1 | 8/2012 | Vine, III | |
| 2013/0109267 | A1 | 5/2013 | Schweikardt et al. | |
| 2013/0244530 | A1 | 9/2013 | Renfro | |
| 2013/0252503 | A1 | 9/2013 | Kwok | |
| 2013/0273805 | A1 | 10/2013 | Leonhardt | |
| 2014/0024283 | A1 | 1/2014 | Stolten | |
| 2014/0287401 | A1* | 9/2014 | Hardy | A63H 3/46 434/365 |
| 2015/0375127 | A1* | 12/2015 | Fukuchi | A63H 3/36 446/321 |
| 2016/0310865 | A1 | 10/2016 | Won | |
| 2017/0056782 | A1 | 3/2017 | Farco | |
| 2018/0296936 | A1 | 10/2018 | Dill | |
| 2021/0362066 | A1 | 11/2021 | Boyce et al. | |
| 2022/0247218 | A1 | 8/2022 | Knights | |
| 2023/0113470 | A1* | 4/2023 | Landi, Jr. | A63H 3/04 446/269 |

FOREIGN PATENT DOCUMENTS

| | | | |
|---|---|---|---|
| JP | 49-18954 | | 11/1972 |
| JP | 49-18955 | | 5/1974 |
| JP | 61-94090 | U | 6/1986 |
| JP | 61-94091 | U | 6/1986 |
| JP | 61-94092 | U | 6/1986 |
| JP | 62-53686 | U | 4/1987 |
| JP | 63-103685 | U | 7/1988 |
| JP | 1033833 | A1 | 2/1998 |
| WO | WO92/10262 | A | 6/1992 |
| WO | 9403664 | A1 | 2/1994 |
| WO | 9832509 | A1 | 7/1998 |
| WO | 1999039793 | A1 | 8/1999 |
| WO | 2000010665 | A1 | 3/2000 |
| WO | 2000067869 | A1 | 11/2000 |
| WO | 2001008776 | A1 | 2/2001 |
| WO | 03095056 | A1 | 11/2003 |
| WO | 201208200 | A1 | 6/2012 |
| WO | WO2014/005591 | A1 | 1/2014 |
| WO | 2016036675 | A1 | 3/2016 |
| WO | WO2023122353 | A1 | 6/2023 |
| WO | WO2025042800 | A1 | 2/2025 |

OTHER PUBLICATIONS http://www.technicbricks.com/2011/03/tbs-techpoll-24-should-flex-system.html, Mar. 8. 2011 pp. 1-3.
Lego® Technic Set 5118 (1991).
Lego® Technic Set 7471 (2000), cover, 68-69 et seq.
Lego® Technic Set 8002 (2000), cover, 54-56, 59-62, 64, 69-70, 76-77, 83-98 et seq.
Lego® Technic Set 8074 (1991), cover, 1, 11-13 et seq.
Lego@TechnicSet8412 (1995), cover, 8-11, 14-18, 23-25, 27-35.
Lego® Technic Set 8437 (1997), cover, 24-31, 41, 43-45, 49-50, 52-60.
Lego® Technic Set 8440 (1995), cover, 4-7, 10-12, 28, 31-33, 35-36, 38-41.
Lego®TechnicSet8444 (1999), cover, 2, 6-21, 24-37, 39-42, 45, 47, 49-53, 55, 57-59, 62-63.
Lego® Technic Set 8445 (1999), 31, 41, 44-50, 52-56, 59, 62-63, 69-71, 80-87, 92-94, 114.
Lego® Technic Set 8457 (2000), 33, 37-43, 155-162.
Lego® Technic Set 8479 (1997), 49-50, 55-56, 77.
Lego® Technic Set 8482 (1998), https://www.youtube.com/watch?v=744gOUSfW2w.
Lego® Technic Set 8483 (1998), https://www.youtube.com/watch?v=744gOUSfW2w.
Lego® Technic Set 8485 (1995), [first model] at 23-24, [third model] at 19-30, 32-37, 42, 47.
Lego® Technic Set 8828 (1992), 9.
Lego® Technic Set 8836 (1992), 8.
Lego® Technic Set 8839 (1992), 4, 8-13, 23.
Lego® Technic Set 8856 (1991), 4, 10-19, 23, 39-40.
Lego® Technic Set 9748 (1999), 22, 36, 51, 53-55, 60-61, 63-64, 69-70, 72-74, 76-77, 80-82, 109- 114.
Lego® Technic Set 8272 (2007), 63-64, 67-69.
Lego® Technic Set 5218 (2000), cover, 4-5, 16-23, 33-34, 43, 52, 54-66, 68, 73, 80-81, 95-99, 103- 104.
http://www.eurobricks.com/forum/index.php?showtopic=79234.
Rodriguez, Luis, "FlexRoads." (Copyright 2010).
Micro Light Board Usage Guide, http://brickstuff.dozuki.com/Guide/Micro+Light+Board+Kit+Usage+Guide/5, 2012.
240 Lego System Idea Book, 3170-a, Lego AS Europe, 19 (Aller GmbH, Ultzberg, Germany, 1967), pp. 12-13, 32-47, 50-51, cover-backpage.
1965 Lego Planpacks and Packs Catalog, pp. 1-4.
1967 Lego® Catalog, pp. 4-5.
1969 Lego® Catalog, excerpts.
Lego® Building Toy, Motor Pak, "Lego Now has Gears and Motor.".
1969 Lego® System catalog, excerpts.
Lego® Model Maker 107 (1968), "Battery-Operated Reversible Power Unit.".
Lego—Motor—Eisenbahn (undated).
LEGO verwirklict den Baugeclanken fur Spielzeugautos (1967).
Lego®Set 115, cover page.
Lego® Set 116 (1968), cover, pp. 1-4.
Lego® Set 118 (1969), cover, p. 11.
Lego® Set 119 (1968), cover, pp. 1-3, 6.
Lego® Set 119-157 (1968), cover, pp. 1-2.
Lego® Set 120 (1969), cover, pp. 4-7.
Lego® Set 122 (1969), cover, p. 4.
Lego® Set 133 (1975), cover, pp. 4-5.
Lego® Set 138, (1969), cover, pp. 8-11.
Lego® Set 161 (1972), cover, p. 2.
Lego® Set 162 (1977), cover, pp. 3, 6, 11.
Lego® Set 180 (1972), cover, p. 5.
Lego® Set 182 (1975), cover, back p. pp. 1-4.
Lego® Set 183 (1976), cover, pp. 2-6.
Lego® Set 210 (1976), cover, pp. 1-3.
Lego® Set 404 (1977), cover, pp. 1, 4-5, 7-8, 14-15.
Lego® Set Electronic 118 (1969), cover, back p. pp. 1-9.
LiteBrix® Set 35707 (2013), pp. 22, 26-33.
LiteBrix® Set 35703 (2013), pp. 2, 8-13, 57, 59-61.
LiteBrix® Set 35700 (2013), pp. 3-4, 6-7, 9-20, 22-24.
LiteBrix® Set 35800 (2012), pp. 2, 11-15.
LiteBrix® Set 35810 (2013), pp. 2, 40-42.
U.S. Appl. No. 13/365,907, filed Sep. 27, 2012 Amendment and Respons to Aug. 31, 2012 Office Action, Remarks, pp. 13-21.
E. Pannestri, M. Cavacece, L. Vita, On the Computation of Degrees-of-Freedom: A Didactic Perspective, DETC2005-84109, Proceedings of IDETC '05, 2005 ASME International Design Engineering Technical Conferences and Computers and Information Engineering Conference, Long Beach, CA, USA, Sept. 24-28, 2005.
Kre-OR Set 38771 (2011), pp. 20-36, 56-75, 78.
Berard, Jamie, Stressing the Elements, Aug. 2006, Lego.
BendablesTM—The Bendable Construction System.
BenditsTM—product boxes photographs.
Lego® Master Builder Academy Designer Handbook 20200 - Kit/Level 1 - Space Designer 4646874 (2011), pp. 17, 35.
65|http://www.mocpages.com/moc.php/265752 (Apr. 26, 2011).
66|http://www.halfbakery.com/idea/Flegos (Jun. 21, 2006).
67|http://shop.lego.com/en-US/Doc-Ock-Truck-Heist-76015?p=76015 (Mar. 6, 2014).
http://www.instructables.com/id/Lego-polymer-clay-figure/?ALLSTEPS.
United States Consumer Product Safety Commission, "Laboratory Test Manual For Toy Testing - Requirements for Testing of Toys and Other Articles Intended for Use by Children 12 Years and Under," Jun. 2010, CPSC, 91 pages.
70|/www.genuinemodels.com/demag_crane.htm, Feb. 11, 2003 based on https://web.archive.org/., 26 p. See p. 13.

(56) References Cited

OTHER PUBLICATIONS

International Search Report in PCT/US2015/047836 (published as WO2016/036675 A1), Jan. 11, 2016, 4 pages.
Written Opinion in PCT/US2015/047836 (published as WO2016/036675 A1), Jan. 11, 2016, 6 pages.
Barry Dupen, Applied Strength of Materials for Engineering Technology, (2012), 128 pages.
Oct. 4, 2016 International Preliminary Examination Report on Patentability in PCT/US15/47836, 24 pages.
Oct. 28, 2016 Decision on Petition in PCT/US15/47836, 3 pages.
http://www.instructables.com/id/How-to-make-LEGO-bendy/ (4 pages).
Setti Fine Art, Creating A Figure Armature For Sculpture, (Apr. 17, 2009) (http://www.instructables.com/id/CREATING-A-FIGURE-ARMATURE-FOR-SCULPTURE/ (11 pages).
Browning, Marie, Metal Crafting Workshop, pp. 14-15 (Sterling Publishing Co., Inc., NY 2006) (5 pages).
Jun. 5, 2017 Non-final Office Action re: U.S. Pat. Appln. U.S. Appl. No. 15/251,953 (13 pages).
Jan. 11, 2018 Final Office Action in U.S. Appl. No. 15/251,953 (16 pages).
Jun. 8, 2018 Non-Final Office Action in U.S. Appl. No. 15/251,953 (22 pages).
Dec. 12, 2018 Final Office Action in U.S. Appl. No. 15/251,953 (20 pages).
International Search Report and Written Opinion in PCT/US2022/054016, Mar. 28, 2023 (8 pages).
Non-final Office Action dated Sept. 9, 2024 in U.S. Patent Application U.S. Appl. No. 17/329,576 (9 pages).
Final Office Action dated May 2, 2025 in U.S. Appl. No. 17/329,576 (10 pages).
Notice of Allowance dated Jun. 2, 2025 in U.S. Appl. No. 18/235,841 (8 pages).
U.S. Appl. No. 63/254,371 to Landi Jr. (31 pages).

* cited by examiner

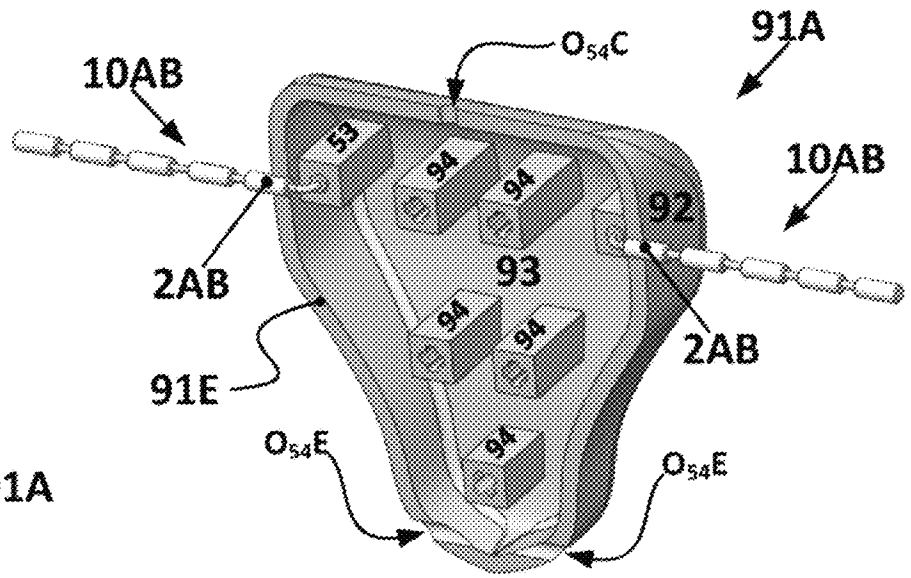
FIG. 10F
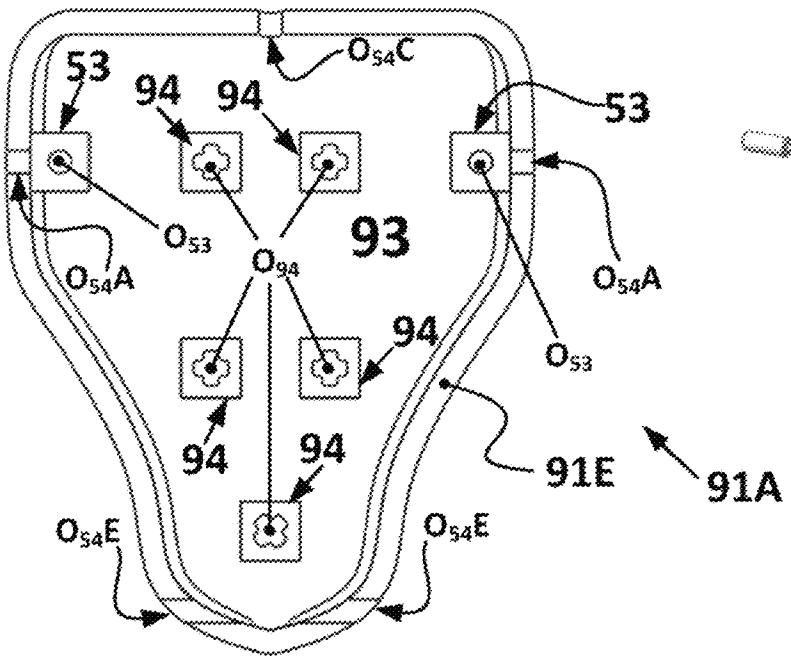
FIG. 10E
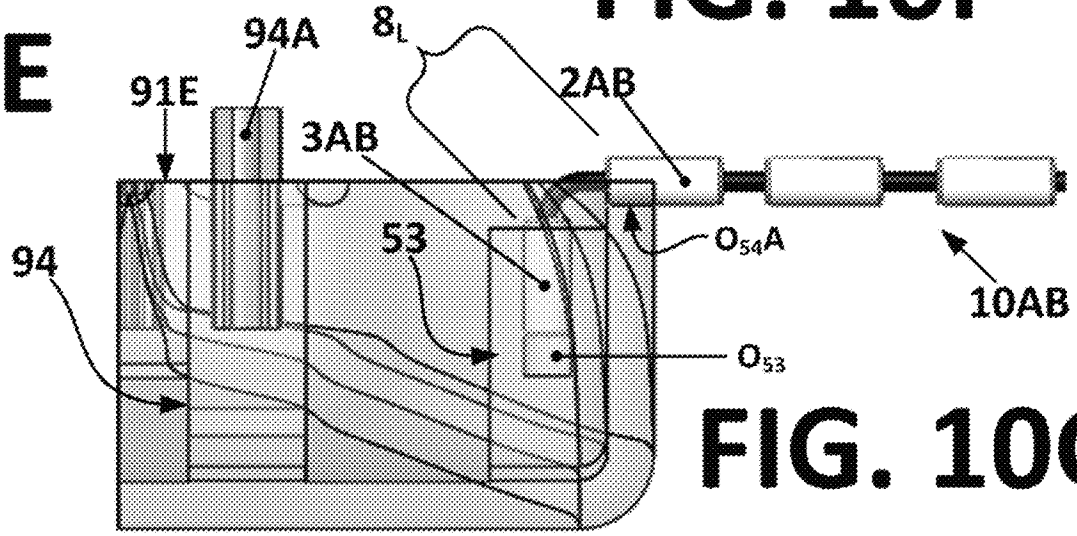
FIG. 10G
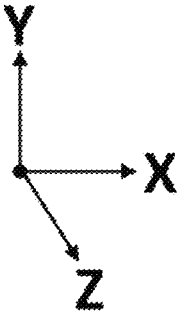

INTERCONNECTING METHODS AND SYSTEMS FOR POSABLE BENDABLE BUILDING BLOCK TOYS

FIELD OF THE INVENTION

The present disclosure relates to novel interconnecting methods using novel posable bendable building block toys as disclosed in U.S. patent application Ser. No. 17/561,926, filed Dec. 25, 2021, and International Patent Application No. PCT/US2022/54016, filed Dec. 25, 2022, the entire contents of each of which being incorporated herein by reference in their entirety.

SUMMARY OF THE INVENTION

An exemplary toy construction may comprise a posable metal component having a first terminus and a second terminus, a first rigid component comprised of a material embedded in the first terminus, a second rigid component comprised of the material, a clutch having at least one opening with a first central axis, and a lock having at least one opening with a second central axis, wherein the first central axis and the second central axis are not colinear. In further accordance with this exemplary embodiment, the first rigid component may be disposed in an opening in the clutch and the second rigid component may be disposed in an opening in the lock. In still further accordance with this exemplary embodiment, a portion of the posable metal component between the first rigid component and the second rigid component may be bent.

In addition to the previously described embodiment and/or as an alternative to any other described exemplary embodiments herein, the toy construction may be further configured so that the first central axis is substantially orthogonal to the second central axis.

In addition to the previously described embodiment and/or as an alternative to any other described exemplary embodiments herein, the toy construction may be further configured so that first central axis is substantially parallel to the second central axis.

In addition to the previously described embodiment and/or as an alternative to any other described exemplary embodiments herein, the toy construction may be further configured so that the clutch and the lock are snap-fit interconnecting building block toys.

In addition to the previously described embodiment and/or as an alternative to any other described exemplary embodiments herein, the toy construction may be further configured so that the clutch and the lock are each separate building blocks that are substantially identical in form and/or function.

In addition to the previously described embodiment and/or as an alternative to any other described exemplary embodiments herein, the toy construction may be further configured so that the clutch and the lock are each the same snap-fit interconnecting building block toy.

In addition to the previously described embodiment and/or as an alternative to any other described exemplary embodiments herein, the toy construction may be further configured so that the clutch is integrally molded into a shelled structure.

In addition to the previously described embodiment and/or as an alternative to any other described exemplary embodiments herein, the toy construction may be further configured so that a first portion of the lock is molded into a shelled structure.

In addition to the previously described embodiment and/or as an alternative to any other described exemplary embodiments herein, the toy construction may be further configured so that the remaining portion of the lock is integrally molded into another shelled structure configured to be combined with the shelled structure having the first portion of the lock. According to an exemplary method, an exemplary posable building block disposed in the first portion of the lock will be disposed within a completed lock formed by combining the two shelled structures.

In addition to the previously described embodiment and/or as an alternative to any other described exemplary embodiments herein, the toy construction may be further configured so that either the clutch, the lock, or any combination or fraction of each is integrally molded into opposed parts of two shelled structures. According to this exemplary aspect, in a first shelled structure there may be a first portion of the clutch or the lock that is molded into the first shelled structure, and there may be a second portion of the clutch or lock that is molded into a second shelled structure, wherein the second shelled structure is configured to combine with the first shelled structure to form a substantially complete and functional clutch and/or lock from the first portion and the second portion of such clutch or lock.

An exemplary locking arrangement for a toy construction may comprise a posable building block, having a posable metal component having a first terminus and a second terminus, a first rigid component comprised of a material embedded in the first terminus, and a second rigid component comprised of the material. Such an exemplary locking arrangement may further comprise a clutch having at least one opening with a first central axis along which it receives at least one rigid component coupled to the posable building block, and a lock having at least one opening with a second central axis along which it receives at least one other rigid component coupled to the posable building block. The exemplary locking arrangement may be further configured such that the portion of the posable building block that is neither coupled in the clutch, the lock, nor disposed between the clutch and the lock, is coupled to the toy construction in such a way that only destruction of the toy construction will release the rigid components of the posable building block found within the clutch and/or the lock.

In addition to the previously described embodiment and/or as an alternative to any other described exemplary embodiments herein, the toy construction may be further configured so that the first central axis and the second central axis are not colinear.

In addition to the previously described embodiment and/or as an alternative to any other described exemplary embodiments herein, the toy construction may be further configured so that the first central axis and the second central axis are colinear.

In addition to the previously described embodiment and/or as an alternative to any other described exemplary embodiments herein, the toy construction may be further configured so that each of the clutch and the lock is integrally molded into at least one shelled structure.

In addition to the previously described embodiment and/or as an alternative to any other described exemplary embodiments herein, the toy construction may be further configured so that each of the clutch and the lock is integrally molded into the same shelled structure.

In addition to the previously described embodiment and/or as an alternative to any other described exemplary embodiments herein, the toy construction may be further configured so that either the clutch or the lock is integrally molded into a first shelled structure, a first portion of the clutch or lock is molded into the first shelled structure, and a second portion of the clutch or lock is molded into a second shelled structure, wherein the second shelled structure is configured to combine with the first shelled structure to form a substantially functionally complete form of the clutch or the lock from the first portion and the second portion.

Additional embodiments include various other structures that couple to the posable building block, such as helical covers, snap-fit interconnecting building blocks whose halves snap-fit to one another, retainers with jaws to hold the posable building block in place against movement, clamping configurations, commercially available building blocks that produce locking and other arrangements, multi-faceted shells of toys that can be designed to hold the posable bendable block toy, and combinations thereof.

In addition to the previously described embodiment and/or as an alternative to any other described exemplary embodiments herein, an exemplary posable component interconnecting at least two rigid components of a posable building block may be covered by a helical cover. In an exemplary embodiment, the helical cover may be configured to be spiraled about the posable component and when fully engaged thereto, circumscribe the posable component either completely or intermittently about its length between the two rigid components it interconnects.

In addition to the previously described embodiment and/or as an alternative to any other described exemplary embodiments herein, the helical cover may be substantially like a spring, and may have the same resiliency and bendability as a spring. In embodiments where the helical cover is a spring, it may be made of metal, plastic, fabric, or any other material that would allow the helical cover to bend with the posable component as it bends.

In addition to the previously described embodiment and/or as an alternative to any other described exemplary embodiments herein, a snap-fit interconnecting building block has two halves with hooks and receivers that are configured to engage in a snap-fit-like manner to one another to form a complete snap-fit interconnecting building block.

In addition to the previously described embodiment and/or as an alternative to any other described exemplary embodiments herein, a snap-fit interconnecting building block has two halves with hooks and receivers that are configured to engage in a snap-fit-like manner to one another to form a complete snap-fit interconnecting building block that also encloses a posable component through its thickness.

In addition to the previously described embodiment and/or as an alternative to any other described exemplary embodiments herein, a snap-fit interconnecting building block has two halves with hooks and receivers that are configured to engage in a snap-fit-like manner to one another to form a complete snap-fit interconnecting building block that is any known building block, including those made by Lego®, K'nex®, Cre-O®, Construx®, and all variations, alternatives, and functional equivalents of the same.

As used in FIGS. 7A-G, the symbols "●●●" are meant to disclose the possibility of one or more intervening components 2/3 and/or lengths of posable component 1. Alternatively, open-ended posable components, as illustrated in FIGS. 1B and 6A, also are meant to disclose the possibility of one or more intervening components 2/3 and/or lengths of posable component 1.

FIGS. 8A-8D provide for illustrative embodiments of another interconnecting methodology for a first exemplary retention device and an exemplary PBB.

FIGS. 9A-9F provide for illustrative embodiments of yet another interconnecting methodology for a second exemplary retention device and an exemplary PBB.

FIGS. 10 and 10A-10G provide for illustrative embodiments of a seventh variation of an interconnecting methodology for a plurality of exemplary PBB.

FIGS. 11A-11E provide for illustrative embodiments of an eight variation of an interconnecting methodology for a plurality of exemplary PBB.

FIGS. 12A-12F provide for illustrative embodiments of a ninth variation of an interconnecting methodology for a plurality of exemplary PBB.

Figure 13B:
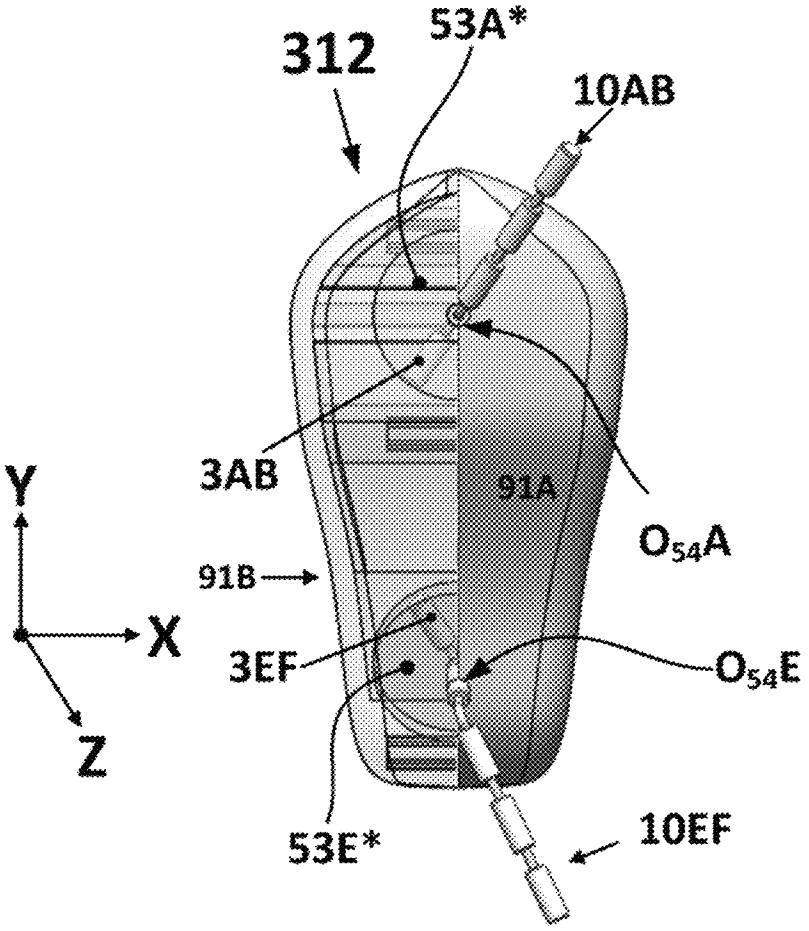
Figure 13A:
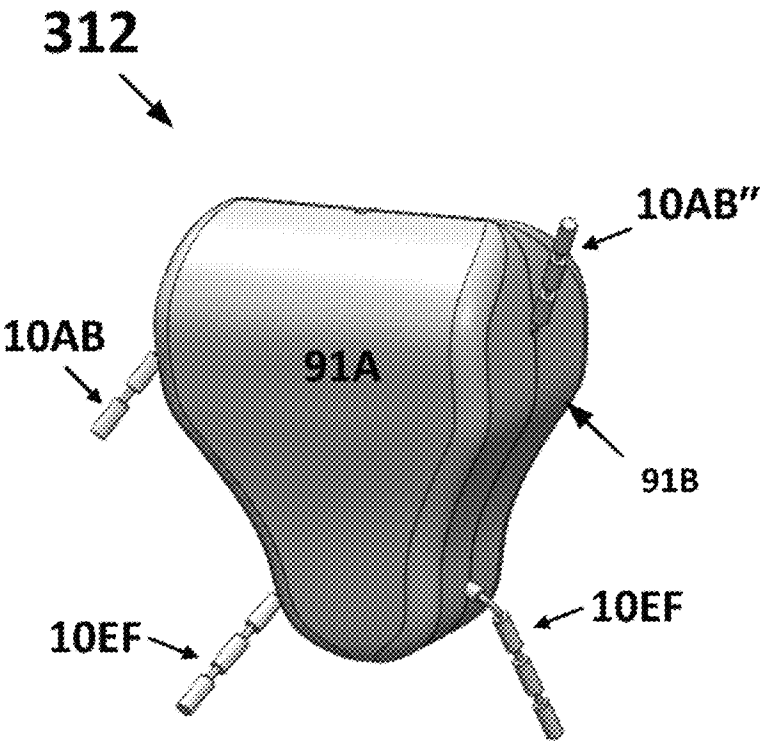
Figure 13C:
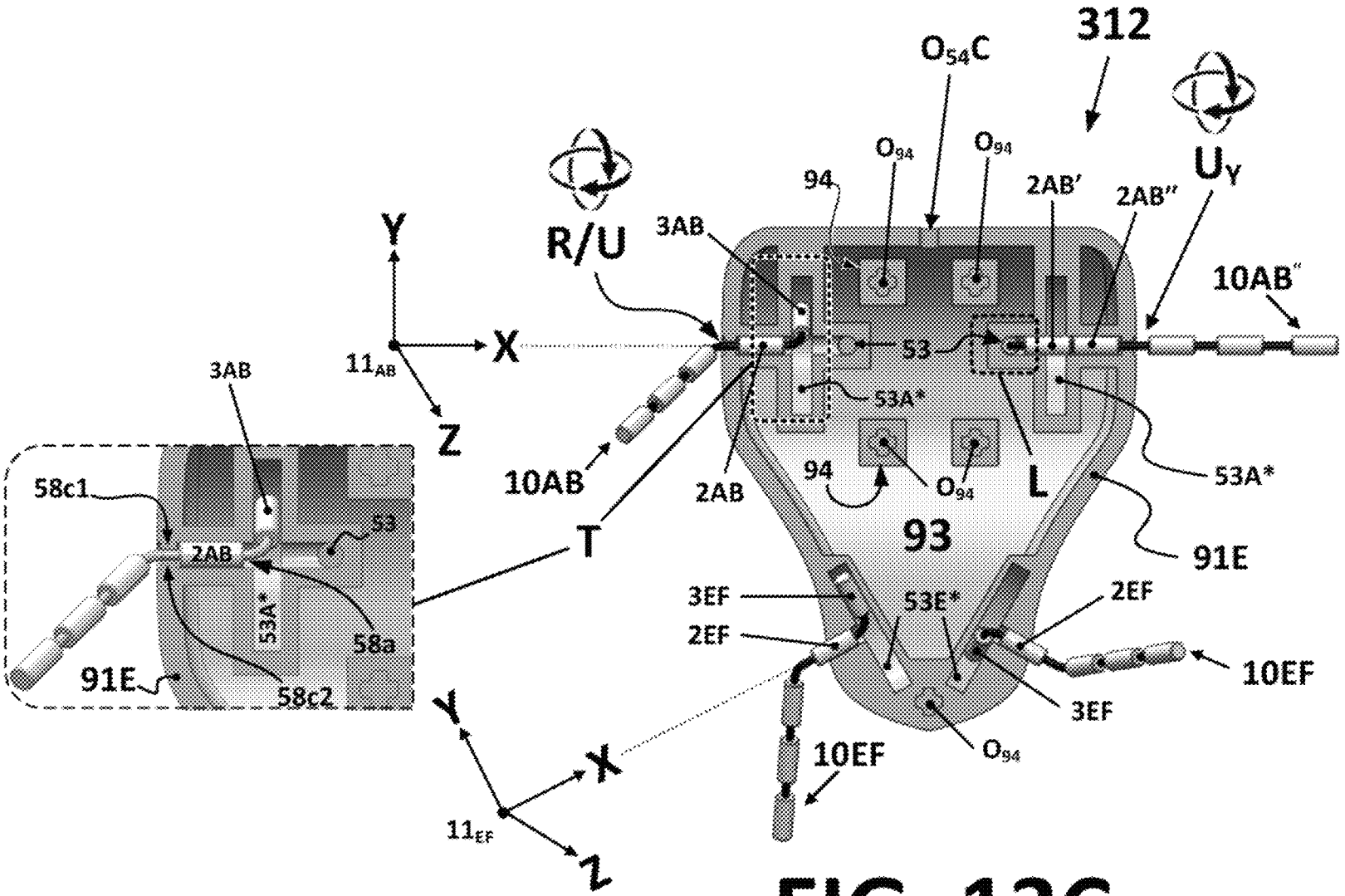

FIGS. 13A-13C provide for illustrative embodiments of a tenth variation of a plurality of exemplary PBB.

In the drawings like characters of reference indicate corresponding parts in the different figures, including figures in U.S. patent application Ser. No. 17/561,926 and International Patent Application No. PCT/US2022/54016, which are incorporated herein by reference. Where there may be a conflict between the reference character used in a figure of the instant case and in a reference character in U.S. patent application Ser. No. 17/561,926 or International Patent Application No. PCT/US2022/54016, the use of the reference character in this disclosure and related figures shall control.

The drawing figures, elements and other depictions, including those from U.S. patent application Ser. No. 17/561,926 and International Patent Application No. PCT/US2022/54016, should be understood as being interchangeable, rearranged, repeated, reduced, changed in size and shape, and may be combined with related features and parts within their respective embodiments and combined and modified by features, whether or not related, in any other embodiments, in any like manner and in accordance with and in furtherance of the teachings and objectives disclosed herein. Thus, the features and methods that may be applied to one type of PBB or connection method may be used in lieu of or in combination with the features and methods applicable to any type of PBB or PBB connection method herein described. Further, while certain structures have been labeled and/or depicted as bricks or blocks, any equivalent structure(s) or instrumentality(ies) may be used as equivalents so long as they enable the same function, in the same way, to achieve the same result as those structures so described.

DETAILED DESCRIPTION

Figure 5:
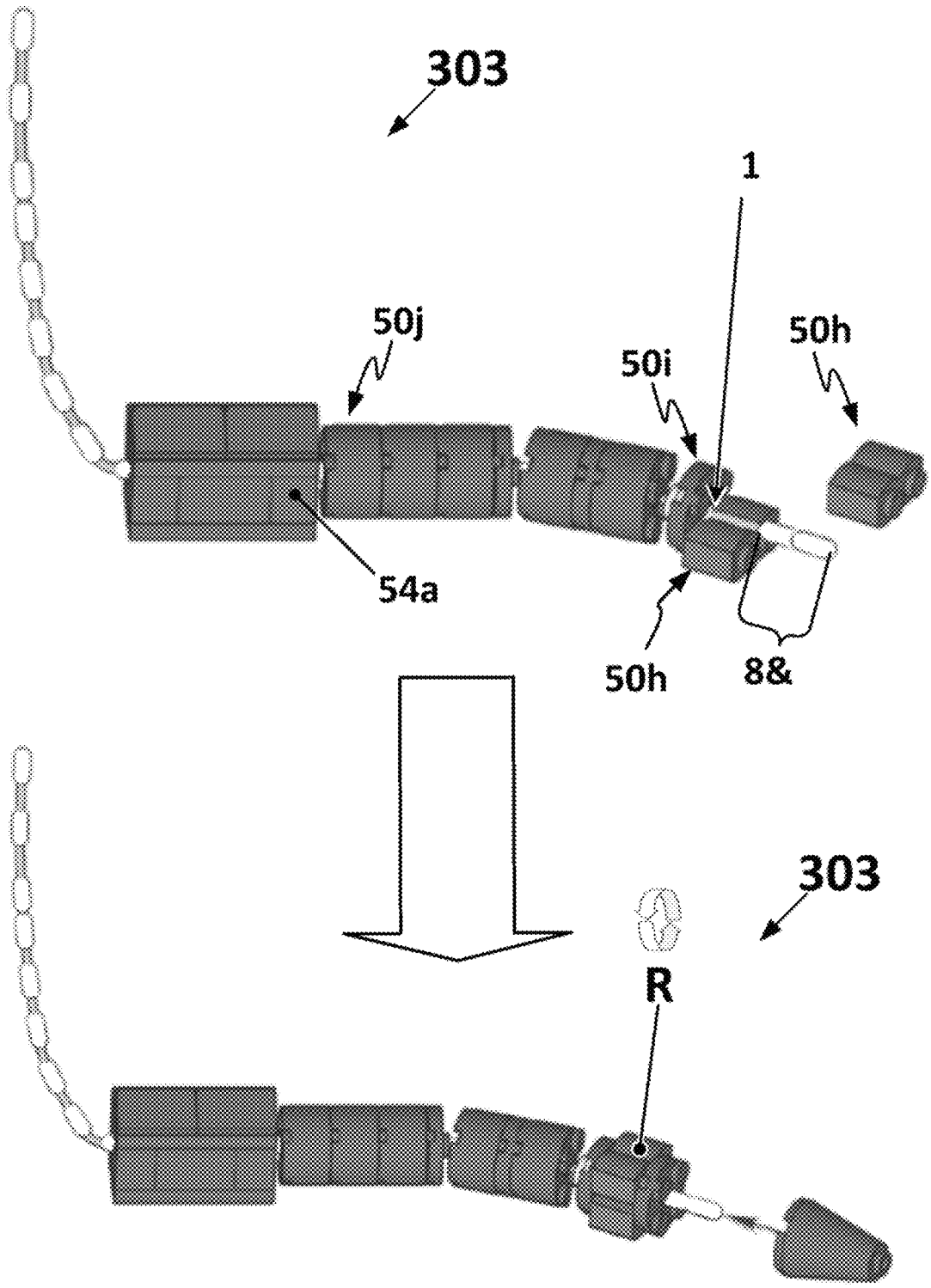
FIG. 5 provides an illustrative embodiment of a sixth variation of an interconnecting methodology for a plurality of exemplary PBB.
Figures 11A, 11B:
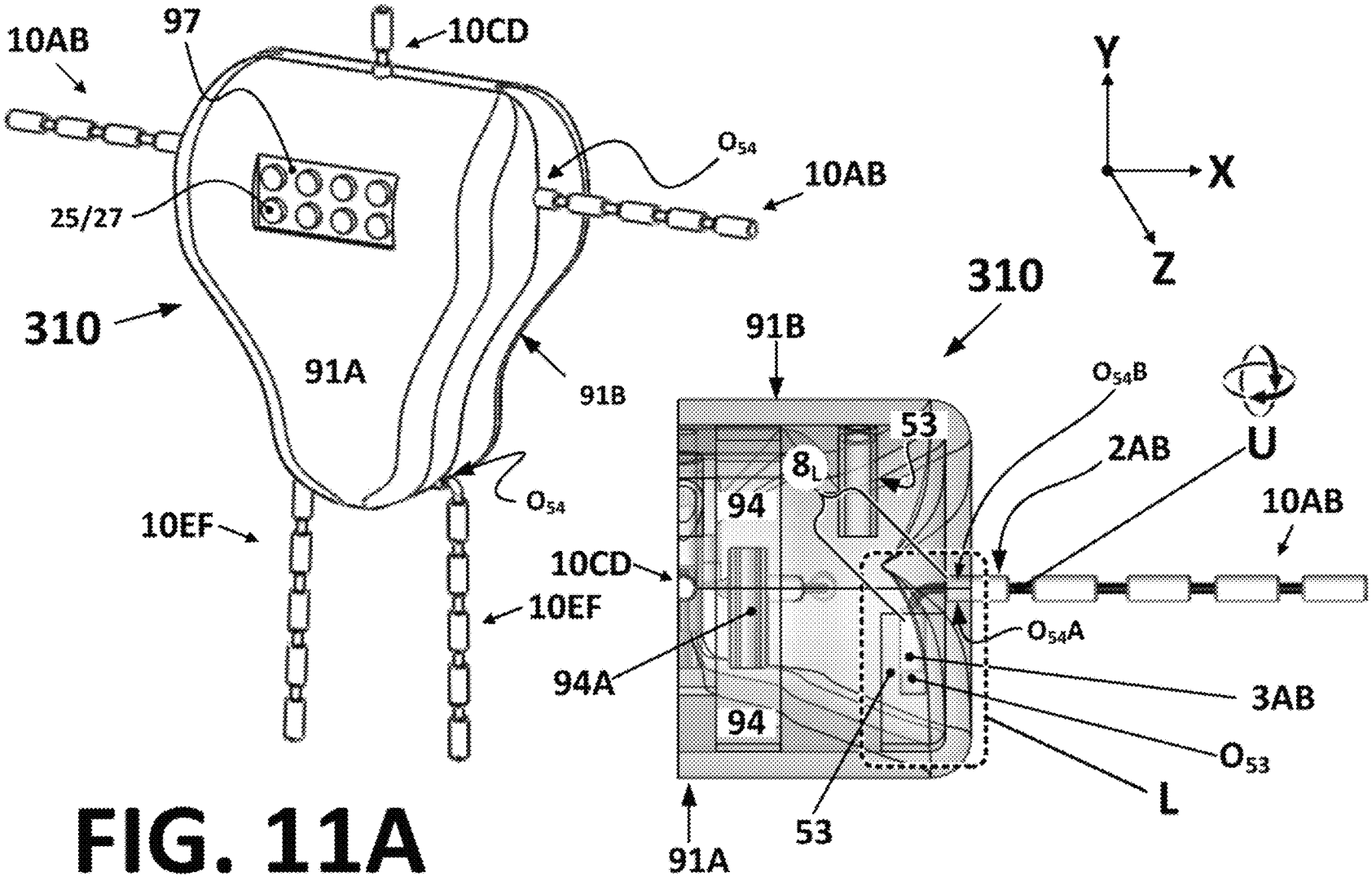

In each of the disclosures to be made herein, reference is made to the features, configurations, and other disclosures of the exemplary interconnectable posable building block toy ("PBB") 10 as disclosed and illustrated in U.S. patent application Ser. No. 17/561,926 and International Patent Application No. PCT/US2022/54016, which are incorporated by reference in their entirety as if fully set forth herein. In a preferred embodiment, a suitable PBB 10 for disclosed embodiments in this case may be the one with the components 1, 2, and 3 that are illustrated in FIGS. 5, 11A, and 14 of U.S. patent application Ser. No. 17/561,926 or FIGS. 1A, 2, 2A-C, 3A-D, 5A-C, 9E, 11A-C, and 12C of International Patent Application No. PCT/US2022/54016, including variations and modified versions of the same. However, in other embodiments, a PBB 10 may be of the kind from International Patent Application No. PCT/US2022/54016 that consist of components 1 and 3 only.

Figure 1:
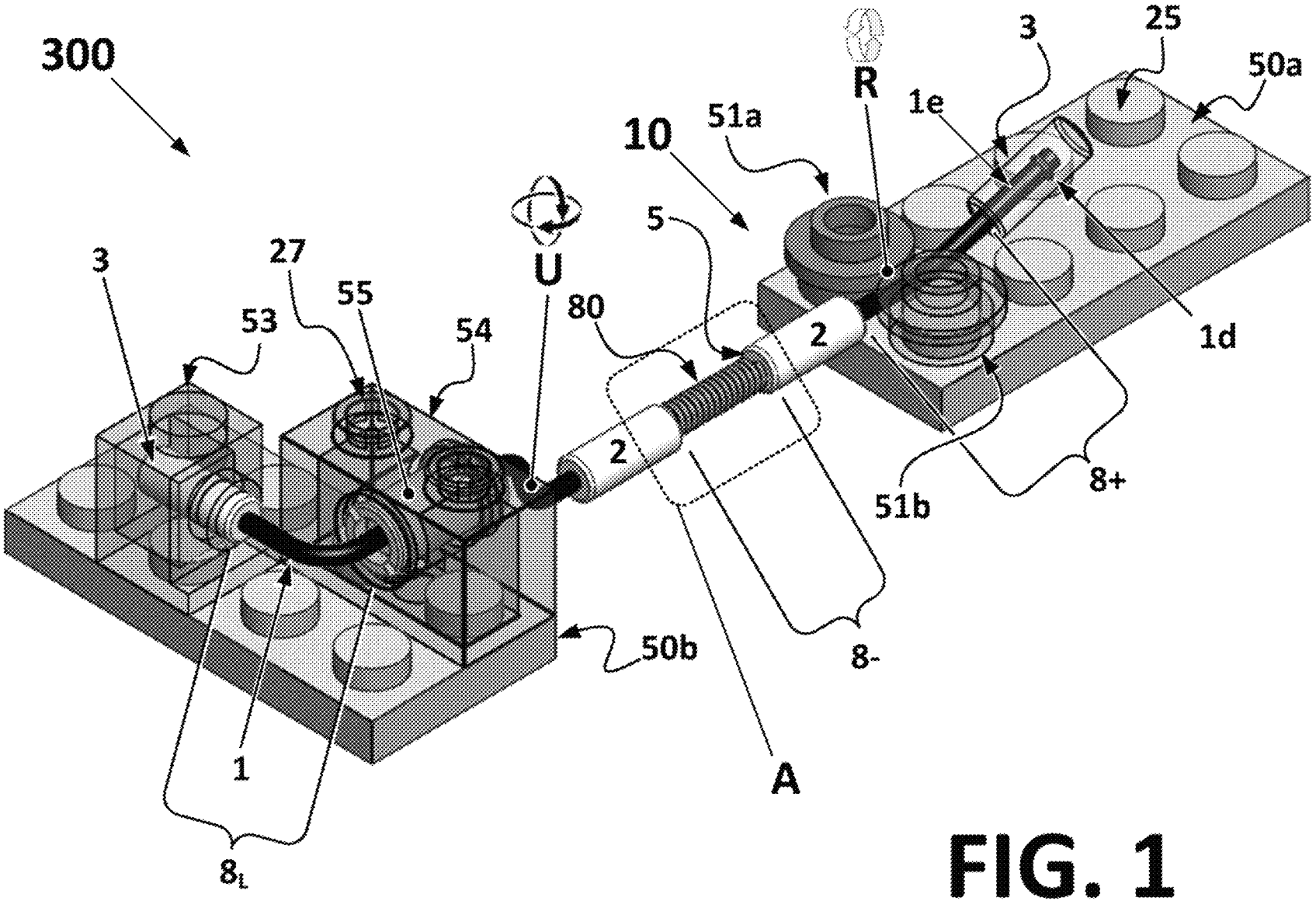
FIG. 1 provides an illustrative embodiment of a variety of interconnecting methodologies for an exemplary posable bendable building block toy (hereinafter referred to as a "PBB"), such as the type disclosed in U.S. patent application Ser. No. 17/561,926 and International Patent Application No. PCT/US2022/54016, the descriptions, illustrations, and functionalities of which being incorporated herein by reference as if fully set forth herein.
Figure 2A:
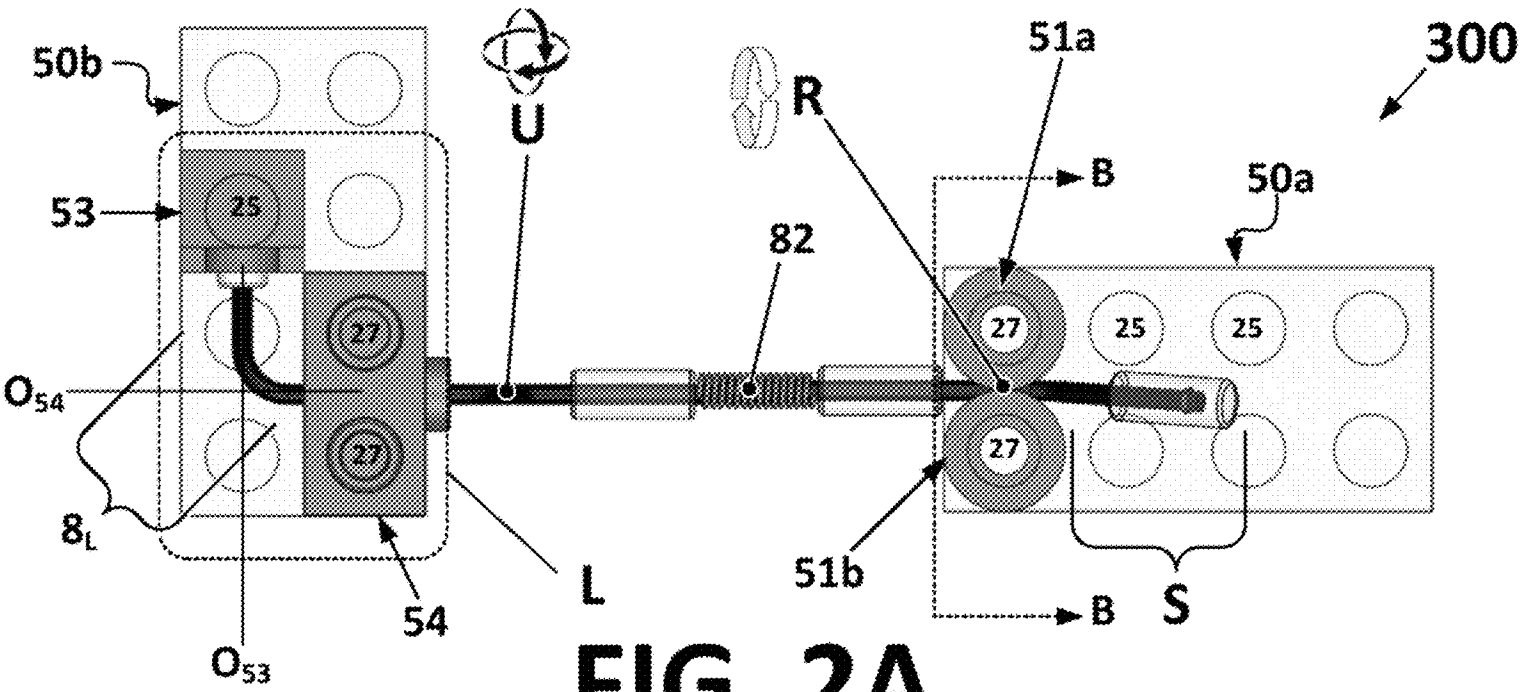
FIG. 2A provides a topographical view of the illustrative embodiment of FIG. 1.

Referring to FIGS. 1 and 2A, an exemplary PBB construction 300 may be comprised of an exemplary PBB 10 interconnected to exemplary snap-fit interconnecting blocks, e.g., plates 50*a* and 50*b*, which may be shown as having cylindrical studs 25/27 extending upwardly from a flat surface whose thickness encloses a cavity (not shown) and which is configured to be friction fit with one or more studs like the cylindrical studs 25/27 extending upwardly from the opposing surface. In an exemplary embodiment, plates 50*a* and/or 50*b* may be a Lego® brick or block having Lego® Part No. 3020, and all variations, combinations, or known functional substitutes for and/or equivalents of the same.

With continued reference to FIGS. 1 and 2A, an exemplary slack space 8+ may be made between an exemplary head component 3 and an exemplary body component 2 of an exemplary PBB 10. As illustrated, the PBB 10 has a head 3 component that is permanently affixed to posable component 1 via a deformed portion 1*d* so that the remainder of the embedded parts 1*e* of posable component 1 is permanently coupled within the rigid head 3. According to FIGS. 1 and 2A, cylindrical blocks 51*a* and 51*b* may be snap-fitted to plates 50*a* so that adjacent ridged surfaces (51*a and 51*b) of the cylindrical blocks 51*a* and 51*b*, respectively, enclose a portion of the posable component 1 extending within slack space 8+. An exemplary illustration of such an enclosure about the posable component 1 of an exemplary PBB 10 may be understood with reference to FIG. 2B.

In a first aspect, an exemplary enclosed portion of an exemplary posable component 1 depicted between exemplary building block toys, e.g., blocks 51*a* and 51*b* on plate 50*a*, may form an exemplary revolute or rotatable connection "R" about the circumference of the exemplary posable component 1. In other words, plate 50*a* may revolve about the portion of posable component 1 found within slack space 8+ such that the studs of plate 50*a* may revolve 360 degrees from their as-illustrated position in FIGS. 1 and 2A. In a second aspect of the disclosures herein, and again with reference to FIG. 2B, an exemplary gap space 50*x* found between blocks 51*a* and 51*b* allows for adequate play or rotational freedom for plate 50*a* to move about posable component 1 using the enclosure formed by blocks 51*a-b* and posable component 1, through which an axis of rotation is created. In a third aspect of the disclosures herein, and again with reference to FIG. 2B, gap space 50*x* found between blocks 51*a* and 51*b* may allow for adequate play or translational freedom for plate 50*a* to tilt at an angle with respect to the longitudinal axis of posable component 1 that is most tangent to block 51*a* and/or 51*b* within that gap space 50*x*.

Figure 2B:
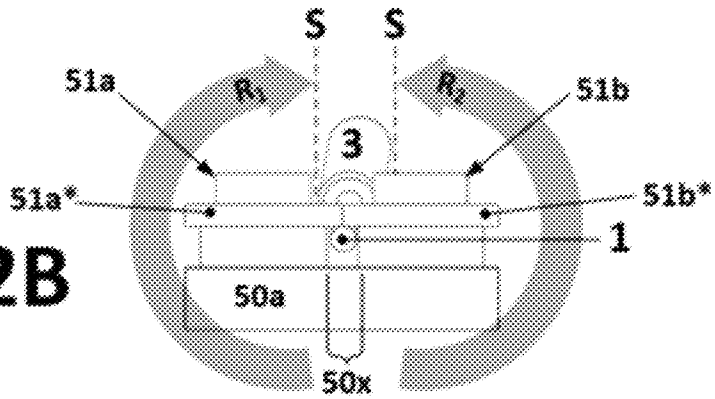
FIG. 2B provides a view of section B-B illustrated in FIG. 2A.
Figure 2C:
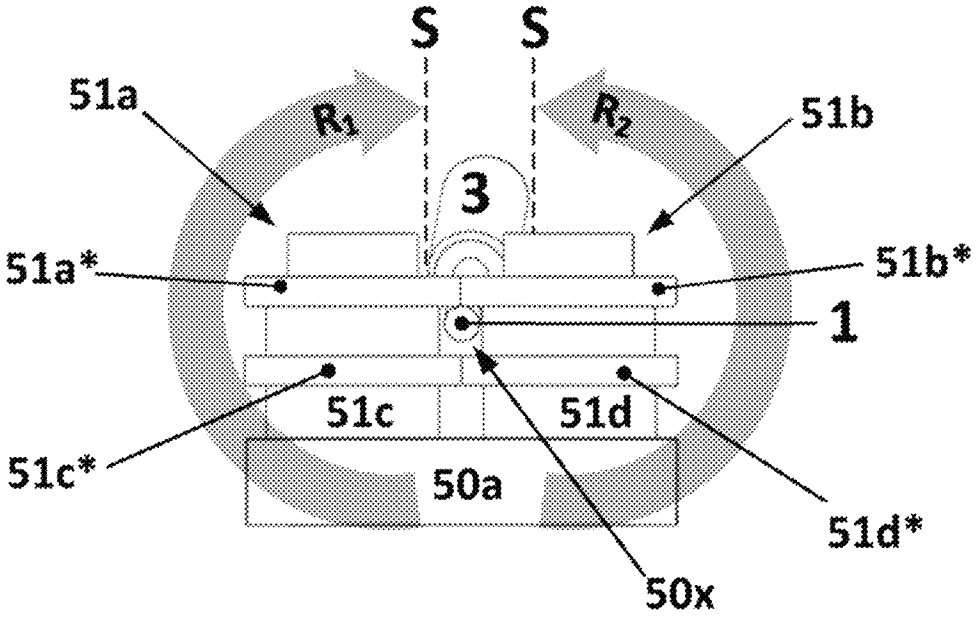
FIG. 2C provides an illustrative embodiment of a first variation of an interconnecting methodology for an exemplary PBB.
Figure 2D:
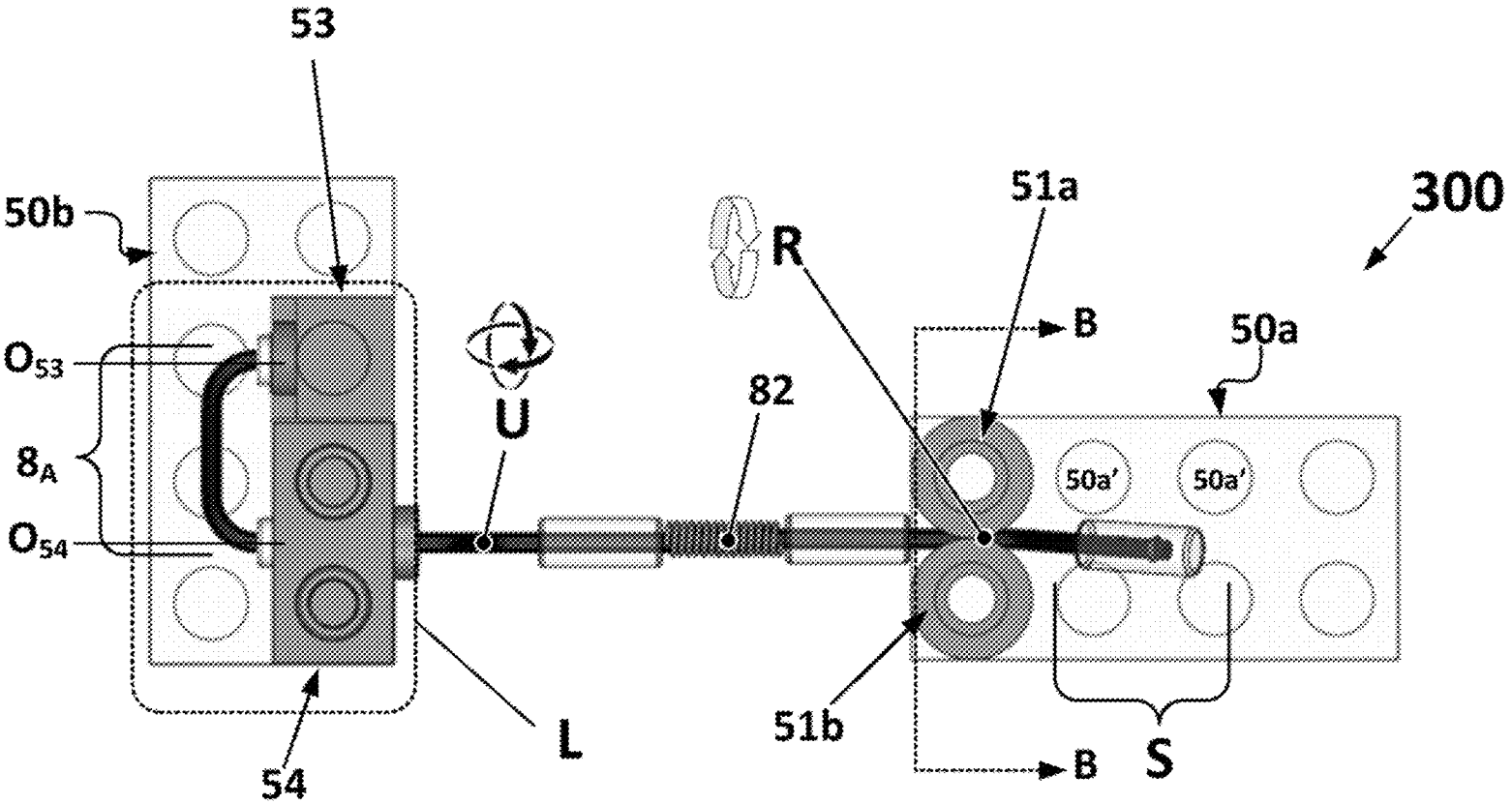
FIG. 2D provides yet another illustrative embodiment of a second variation of an interconnecting methodology for an exemplary PBB.

As may be further illustrated with reference to FIGS. 1 and 2A-B, a PBB 10 located within a PBB construction 300 may be possibly bent so that its head component 3 is held in a position within three-dimensional space against gravity and sufficiently above the studs of plate block 50*a*. As illustrated in FIGS. 2A-B, when such a head component 3 is posed within the rotational pathway of an exemplary plate 50*a*, then such head component 3 may act as a frictional contact point and/or a stopper ("S") to limit the revolutionary movement (clockwise movement denoted $R_1$ and counterclockwise movement denoted $R_2$) of block 50*a* about the axis of the posable component 1 found within space 50*x*. In other words, PBB 10 may simultaneously allow for revolving connections to other structures (e.g., blocks, bricks, and other interconnectable items) about its posable component 1 while using other portions of posable component 1 and/or body components 2 and/or end components 3 to limit the extent of those revolving connections (e.g., more than −360° to less than 3600 rotation). While the illustrative embodiment of FIGS. 1 and 2A-B show a space 50*x* formed between ridges 51*a and 51*b of bricks 51*a-b* and a surface of plate block 50*a* to which bricks 51*a-b* are attached, an exemplary space 50*x* may be made between bricks substantially similar to bricks 51*a-b* (e.g., Lego® bricks) attached to a block similar to plate block 50*a*. Alternatively, an exemplary space 50*x* may be formed between ridges 51*a and 51*b of a first row of bricks 51*a-b*, respectively, and another set of blocks or plates to which the same are interconnected, including a second set of ridges 51*c and 51*d of a second row of bricks 51*c-d* interconnected to the first row of bricks 51*a-b*, respectively, and plate block 50*a*, as may be illustratively provided for in FIG. 2C.

Referring to the structures found on plate 50*b* in the illustrative embodiment of FIGS. 1 and 2A, a lock 54 may be of a type with a cylindrical opening $O_{54}$ through which a cylindrical block element 55 may be disposed, frictionally fit, or snap-fit interconnected. Arranged orthogonally to the cylindrical opening in lock 54 on plate 50*b* may be a clutch 53 in which there is disposed another opening $O_{53}$ of the same or different size to that in lock 54, i.e., $O_{54}$. As arranged on plate 50*b*, lock 54 and clutch 53 may be configured so that their respective openings, $O_{54}$ and $O_{53}$, respectively, are substantially orthogonal to one another. Accordingly, an exemplary length of exposed posable linkage 1 of an exemplary PBB 10 passing between the openings $O_{53}$ and $O_{54}$ may be oriented at a substantially orthogonal angle so that at least one component 2/3 resides within lock 54 via its opening $O_{54}$ and at least one other component 2/3 resides within clutch 53 via its opening $O_{53}$ to create an elbow-like posable component formation $\mathbf{8}_L$ between the two objects 53/54. In an exemplary embodiment, this conformation involving one or more components 2/3, posable component formation $\mathbf{8}_L$, and appropriate objects 53/54 (as well as all variations and types that result in the substantial orthogonal placement of their openings $O_{53}/O_{54}$) may be considered a locking arrangement L. In this exemplary L arrangement, the remainder of PBB 10 that is outside of lock 54 may be moved in substantially any direction without any rotation by plate 50*b*. In other words, the joint formed by the substantially orthogonal $\mathbf{8}_L$ formation in PBB 10 passing through lock 54 and clutch 53 may result in a universal joint ("U") in the posable component 1 at a position that is outside of the last building block passage (e.g., $O_{53}$ or $O_{54}$ as the case may be) that is part of the L arrangement, which as illustrated in FIG. 2A is the dashed rectangle annotated by the letter "L".

An exemplary point outside of the L arrangement may be identified by "U" in FIGS. 1 and 2A to signify the universal joint that forms adjacent the L arrangement. Other examples of U joints may be illustrated in FIGS. 2D, 3-4, 4A, 4D-E, 7E, 7G, 10D, 11B-E, 12C-F, and 13C. Those skilled in the art would recognize that any type of rigid component 2/3 of PBB 10 may be used in one or more of the lock 54/clutches 53 in substantially the same arrangement to achieve substantially the same result, e.g., a universal or "U" joint, provided there is an exemplary $\mathbf{8}_L$ formation that allow two rigid portions 2/3 of PBB 10 to be found both substantially orthogonally and frictionally within the openings $O_{54}/O_{53}$ of lock 54/clutch 53 and all variations and varieties configured to form substantially orthogonal arrangements of openings between the same. While lock 54 may be of one form (e.g., Lego® technic block, part no. 3700, and all variations, combinations, or known functional substitutes for and/or equivalents of the same) and clutch 53 may be another form (e.g., Lego® Erling brick, part nos. 4070, 30069, and all variations, combinations, or known functional substitutes for and/or equivalents of the same), any interconnecting building block with a properly-sized aperture/opening $O_{53}/O_{54}$ and $\mathbf{8}_L$ formation capabilities may be used as part of the orthogonal pair that forms the L arrangement illustrated in FIGS. 1, 2A, 2D, 3-4, 4A, 4D-E, 7E, 7G, 10D, 11B-E, 12C-F, and 13C, e.g., Lego® part nos. 6541, 32000, 3701, 31493, 32064, 6632, 4081, 41632, 4590, 18975, 85943, 11458, 18677, and all variations, combinations, or known functional substitutes for and/or equivalents of the same.

Alternatively, any pair of lock 54/clutches 53 may be arranged so that the axes passing through the centers of each of their openings $O_{54}$ and $O_{53}$, respectively, are parallel to one another to achieve friction fitting of rigid components 2/3 of an exemplary PBB 10 within each such opening, PBB 10 may require an arch-like formation $\mathbf{8}_A$ from one opening to the other opening (e.g., a 180° arch or "U-turn"). An exemplary arch-like arrangement $\mathbf{8}_A$ of PBB 10 may be illustratively provided for in FIG. 2D wherein a lock 54/clutch 53 pair may be oriented so that opening $O_{54}$ has an axis that is substantially parallel with an axis of the opening $O_{53}$. When an exemplary PBB 10 passes therethrough and frictionally engages each opening $O_{53}/O_{54}$ via one or more of its rigid components 2/3, an exemplary L arrangement may once again form within an exemplary construct 300 and thereby enable the further formation of substantially the same U-joint for the remainder of the PBB 10 as the orthogonal or L-like arrangements herein disclosed in FIGS. 1 and 2A. Additionally, a single brick or block may have sufficient openings into which one head/body component 3/2 of a PBB 10 may frictionally pass and another head/body component 3/2 may be inserted so that the posable component between the two aforementioned rigid pieces forms a 180° arch to yield a downstream U-joint in the remainder of PBB 10 outside of the locking arrangement L formed thereby. Such exemplary single bricks/blocks that may be used to create a PBB 10 configuration with a 180° arch while frictionally or otherwise holding two components 3/2 of the same PBB 10 may be, for example, Lego® Part Nos. 32000, 6632, 41482, 3701, 3709, 32013, 6536, 43857, 40147, 74965 (in combination with one or more Lego part nos. 4274 for Technic-type holes), and 32039, 32056, 32.72, 42135, 41677, 44862, 49132, and all variations, combinations, or known functional substitutes for and/or equivalents of the same. An exemplary 180° U-turn U-Joint formation using blocks/bricks other than those already described may be further illustrated in FIGS. 7E and 7G.

Figure 4:
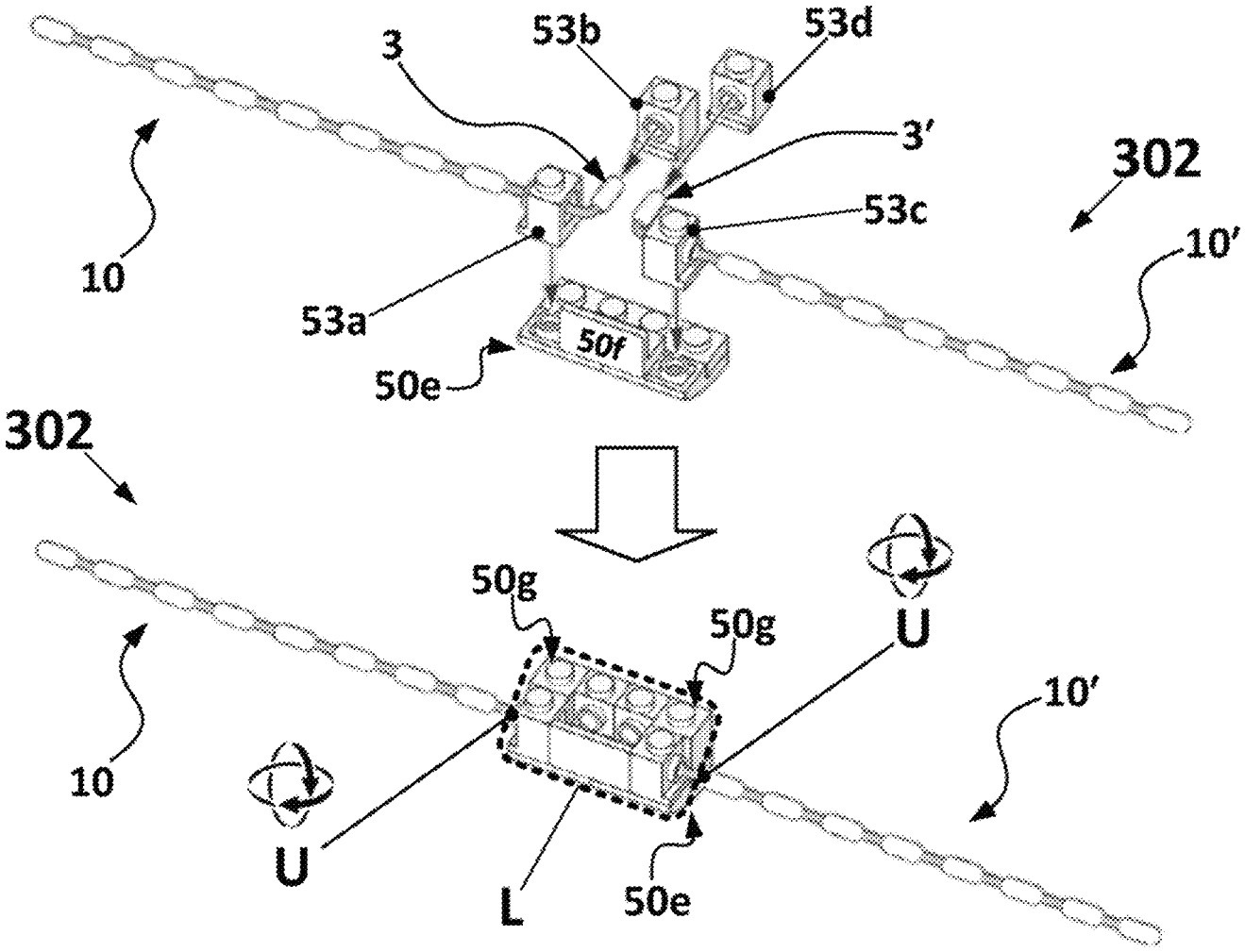
FIG. 4 provides an illustrative embodiment of a fourth variation of an interconnecting methodology for an exemplary PBB.

In an exemplary embodiment, the frictional fitting of PBB 10 may be within just the openings $O_{54}/O_{53}$ of the locks/clutches 54/53 themselves, as may be illustrated by viewing the orthogonal frictional fitting illustrated in FIG. 4. In another exemplary embodiment, the orthogonal frictional fitting of PBB 10 may be achieved by one component 2/3 being frictionally fitted within an opening in one of the locks/clutches 54/53 and another component 2/3 being frictionally fitted within a cylindrical block element 55, which itself is frictionally fitted within the opening $O_{54}/O_{53}$ in one of the locks/clutches 54/53, which is illustrated in FIG. 1.

An additional building advantage due to the revolute "R" joint and universal "U" joint formed by PBB 10 and plates 50*a* and 50*b*, respectively, is the capability of parts within the same system as plates 50*a* and 50*b*, e.g., within the Lego® system, K'nex® system, Cre-O® system, and all variants/compatible versions of the same, to be able to be bent, rotated, and moved without being pulled out during play (e.g., the PBB 10 cannot be frictionally detached or un-plugged from the system like a snap-fit interconnecting building block). In other words, the R-joints and U-joints contemplated with respect to the illustrative embodiments in each of the figures where they are shown may be considered as strong as a prior art action figure limb joint while allowing for the near-infinite customization of the building block system construct in which the PBB 10 may be found and the near-infinite versatility of the PBB 10's possibility. In a preferred embodiment, PBB 10 coupled within a snap-fit interconnecting building block system in either a U-joint or R-joint configuration as described herein may not be detached from the system without substantial disassembling and/or deconstructing the surrounding blocks/bricks/clutches/locks 51/53/54/55 and all known variants and interchangeable versions of the same known to those skilled in the building block arts and/or toy or other type of construction art.

In a first exemplary aspect of the exemplary building advantages herein described, an exemplary PBB 10 may enable multivarious constructable joints for components of a toy system that are more adaptable to multiple toy systems (e.g., a toy combining action figures and interconnectable building blocks), provide a level of possibility that does not exist with plastic-on-plastic, rubber, or bolt/screw joints, while also being as strong, if not stronger, than the plastic-on-plastic joints and the screw, bolt, and mechanical fastener type joints of the prior art. In a second exemplary aspect of the exemplary building advantages herein described, an exemplary PBB 10 may allow for replaceable multifunctional joints for constructable toys that in the prior art would require complete disposal of the entire toy when such a joint is broken or is worn to the point of lost possibility and/or utility. In other words, the second exemplary aspect provides a PBB-based joint that reduces waste if and when a joint no longer functions as it did or permanently breaks. An exemplary PBB-based joint may alleviate this wear and tear issue of toy joints by being more easily replaced and obviate the need for replacement of the entire construction or toy in which the PBB was used. Further, these exemplary constructions and methods disclosed herein may be understood to reduce the repair required to mend joints and instead allow for complete replacement of such joints in the event of worn sockets, bolt/screw holes, weakened joints, and breakage, as may be the case with items that undergo extensive use conditions (e.g., toys and/or action figures).

While a slack space 8+ may be shown as forming the U-joint in FIGS. 1 and 2A, it should be recognized that such formations $\mathbf{8}_L$ and $\mathbf{8}_A$ may be a type of slack space 8+, such formations $\mathbf{8}_L$ and/or $\mathbf{8}_A$ may be spaces 8 and/or 8–, depending on the PBB 10 in use. Further, the rigidity of the U-joint and R-joint herein disclosed and/or illustrated may be enhanced with additional features added to one or more of the exposed portions of posable component 1 portions involved in the joint, e.g., space 50*x*, elbow-type formation $\mathbf{8}_L$, arc-type formation $\mathbf{8}_A$, slack space 8+, bendable bracket 80 (to be discussed further herein), and/or the rigid components 2/3 affixed thereto.

Referring again to FIGS. 1 and 1A, an exemplary feature that may be added to an exposed portion of posable component 1 may be bendable bracket 80. An exemplary bendable bracket 80 may be configured to cover multiple lengths of exposed portions of component 1 (e.g., reduced section 8–, default space 8, slack space 8+) by virtue of its resiliency and flexible nature. In an exemplary embodiment, which may be illustratively provided for in detail via FIG. 1A, bendable bracket 80 may be made up of one or more substantially spring-shaped helix bodies 82 having a head 81*a* and a tail 81*b* to complete the final spiral. In a preferred embodiment, each of head 81*a* and/or tail 81*b* may be designed to abut the internal faces 5 of components 2/3 between which it may be found, but not extend beyond such internal faces 5. As illustratively provided for in FIG. 1A, an exemplary posable component 1 may have portions 1*e* that are embedded within components 2/3, but through movement of components 2/3 may become exposed while sliding within bendable bracket 80 during the movement.

In an alternative embodiment, bendable bracket 80 may be designed to substantially cover the exposed portion of posable component 1 as well as portions of one or more rigid components 2/3 adjacent to said exposed posable component 1 portion, such as, for example, the portions 26*c* and/or extensions 25*z* of components 3(*a*) and 3(*b*) in FIGS. 6G-6M of International Patent Application No. PCT/US2022/54016, the disclosures and illustrations of which being incorporated herein by reference in their entirety. In an alternative embodiment, the cross section of the helix bodies 82 may be circular while the end portions of the head 81*a* and/or tail 81*b* may be flattened on the surfaces designed to abut internal faces 5 of the rigid components 2/3 of an exemplary PBB 10. Alternatively, all cross-sections of the bendable bracket 80 may be circular or any other polygonal cross-section. In another embodiment, head 81*a* and tail 81*b* may be rectangular in cross-section while all intervening helix bodies 82 therebetween are circular in cross-section.

Figure 1A:
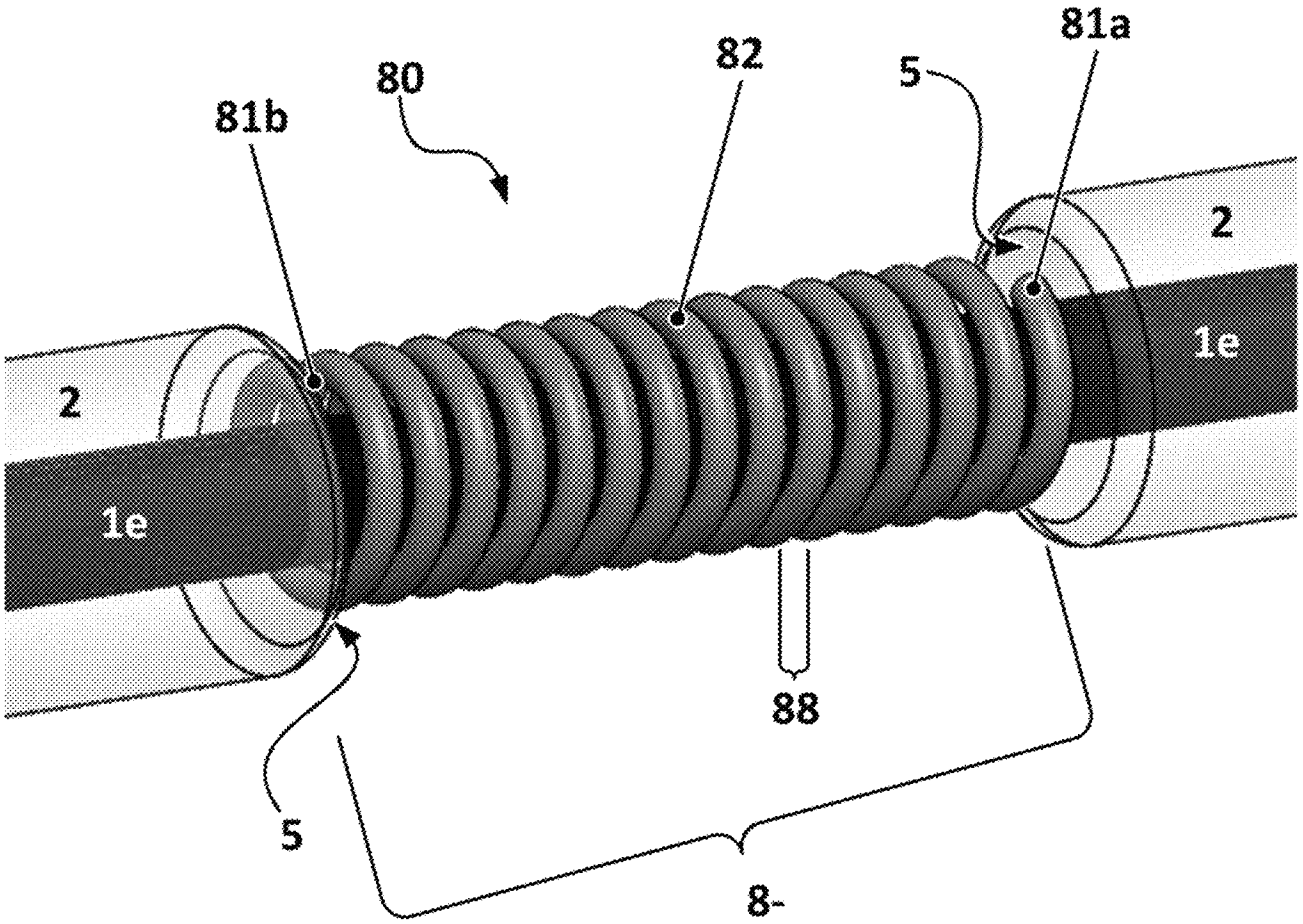
FIG. 1A provides a view of rectangular section A from the illustrative embodiment of FIG. 1.
Figure 1B:
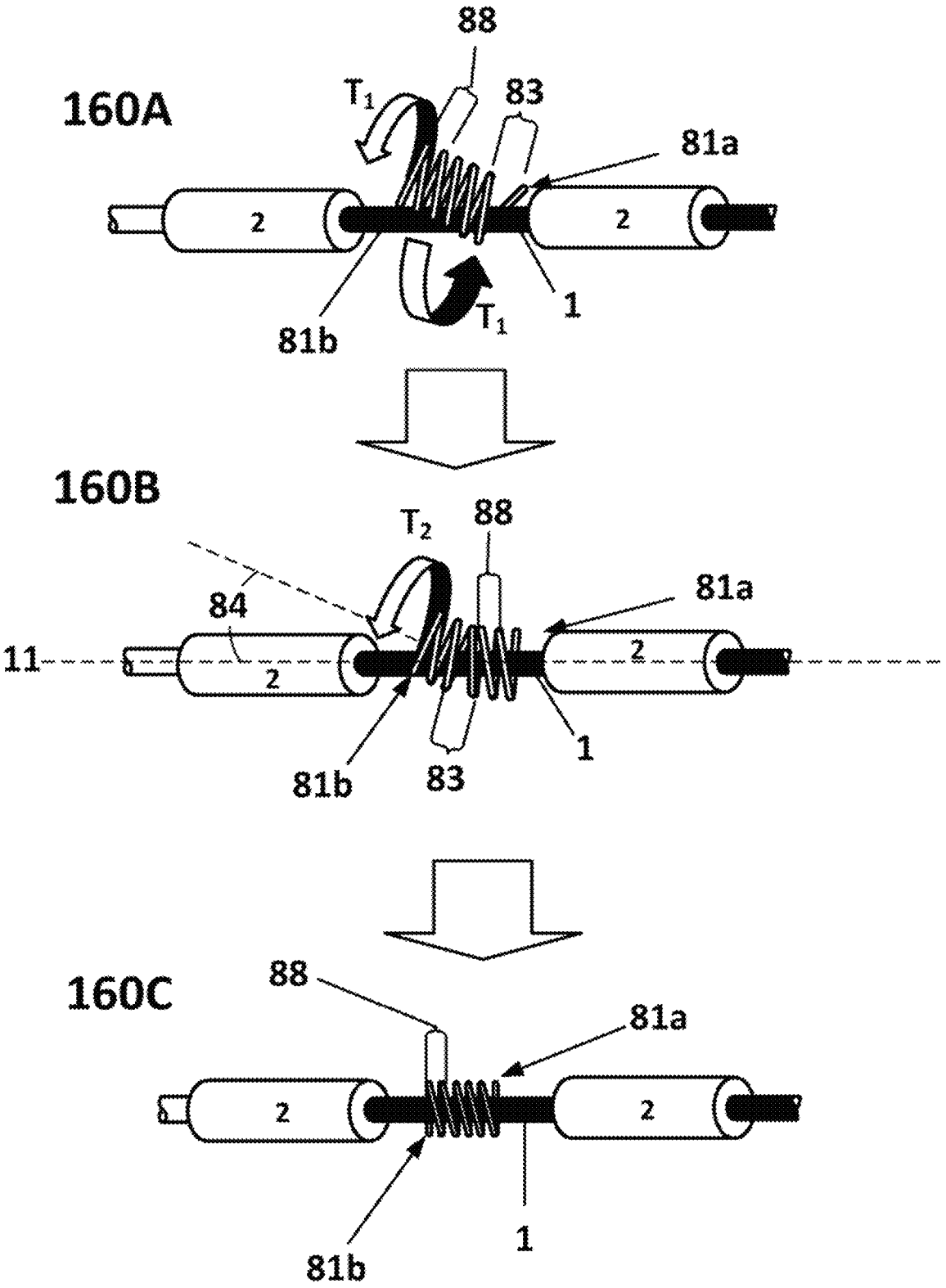
FIG. 1B provides an illustrative embodiment of a covering mechanism engaged to an exemplary PBB.

Referring to the illustrative embodiment in FIGS. 1A-B, bendable bracket 80 may be press-fit, snapped, or screwed onto or "spiraled" onto an exposed portion of posable component 1. In an exemplary embodiment of a first step 160A, an exemplary bendable bracket 80 may be flexibly manipulated to create a mouth 83 between either (i) head 81*a* and/or tail 81*b* and an adjacent helix body 82, or (ii) two consecutive helix bodies 82, whereby mouth 83 may be a gap space larger than gap space 88 to enable a flexibly manipulated part of bendable bracket 80 to travel helically about posable component 1 as if posable component 1 was at the center of the spiral of bendable bracket 80. According to an exemplary second step 160B as illustrated in FIG. 1B, twisting the bendable bracket 80 in the same direction (e.g., those of the white arrows $T_1$ and $T_2$ in FIG. 1B) will cause each subsequently twisted helix body 82 to encircle a surface of the posable component 1. As may be illustrated by FIG. 1B, during an exemplary helical attachment step 160B between an exemplary bendable bracket 80 and a PBB 10, bendable bracket 80 may take on an acute angle 84 with respect to the axis 11 of an exemplary posable component 1 during the twisting until all helix bodies 82 are located about posable component 1 and both head 81*a* and tail 81*b* may be radially most proximal to posable component 1. In an exemplary completion step 160C, an exemplary bracket 80 may be flexibly circumscribing one or more portions of an exemplary posable component 1 of an exemplary PBB 10. While bendable bracket 80 may be depicted as a type of coil and/or helical spring, it may be of any type of helically shaped body known to those skilled in the art, such as, for example, variable-pitch springs, barrel springs, hourglass spring, conical springs, magazine springs, volute springs, springs with hooks at the head/tail, or die springs.

Figure 1C:
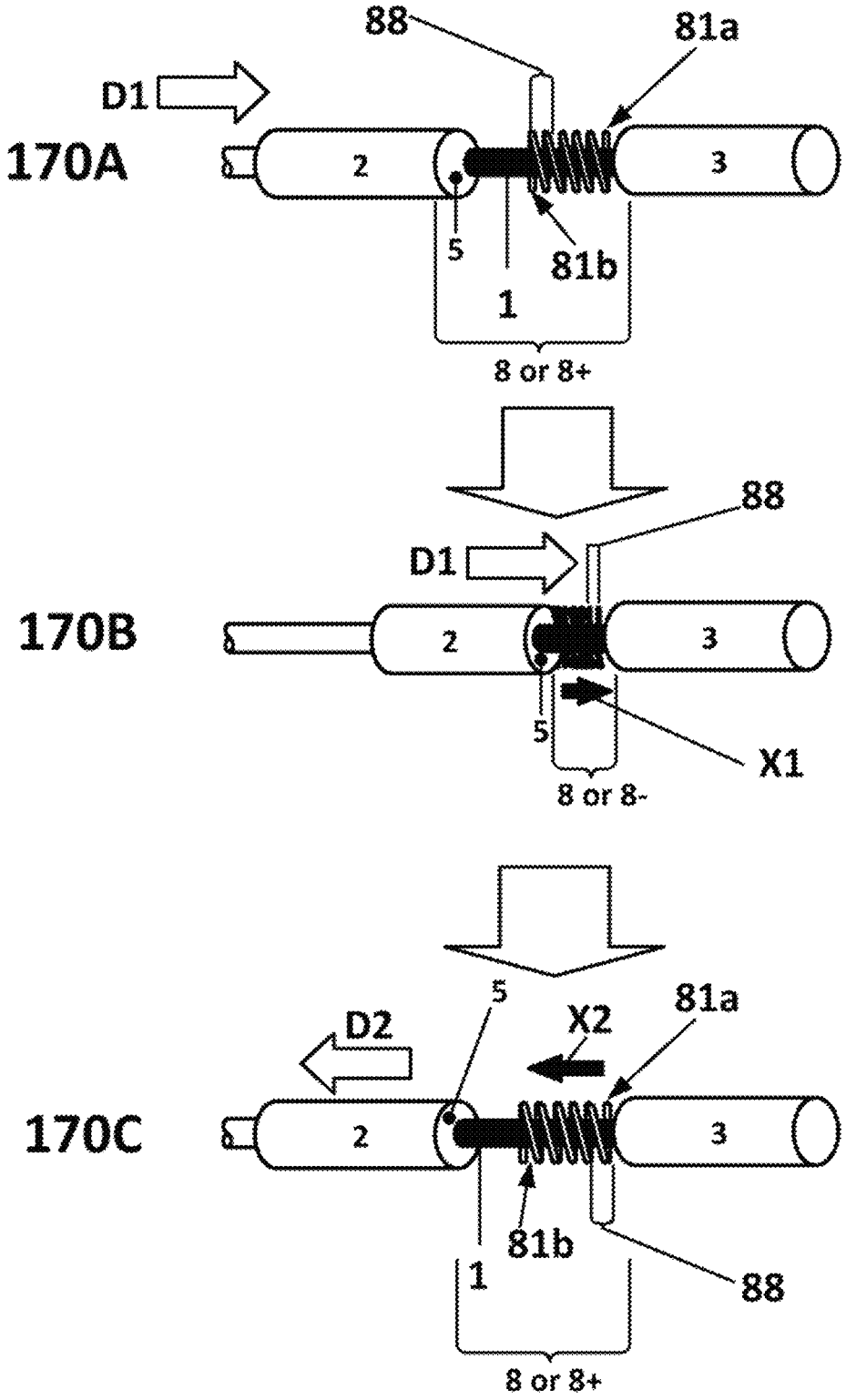
FIG. 1C provides an illustrative embodiment of an activity involving a first embodiment of a covering mechanism engaged to an exemplary PBB.
Figure 1D:
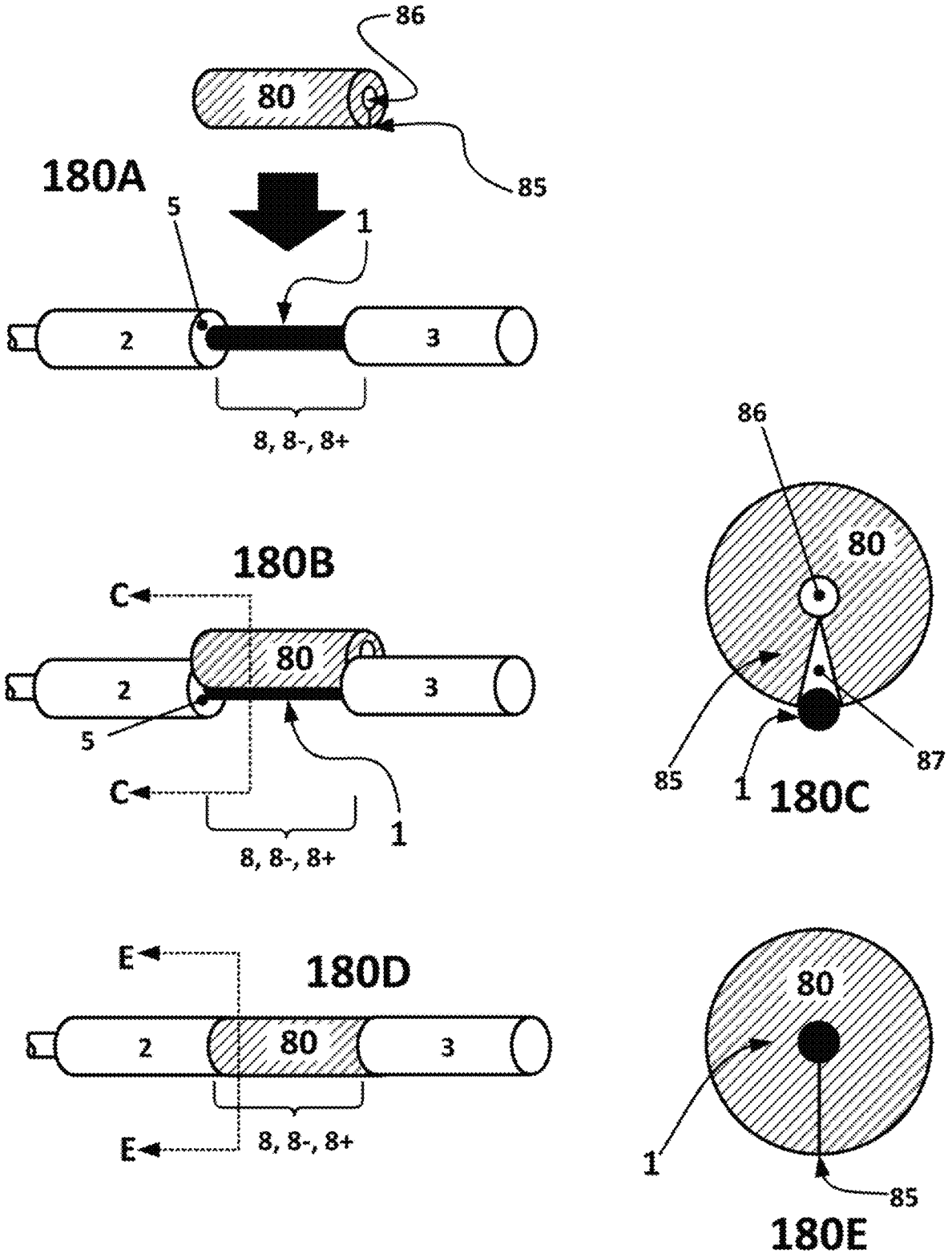
FIG. 1D provides an illustrative embodiment of an activity involving a second embodiment of a covering mechanism engaged to an exemplary PBB.

In an alternative embodiment, which may be depicted in FIG. 1D, an exemplary bendable bracket 80 may be substantially sleeve-like in construction and be made from bendable plastic or rubber with a substantially centralized longitudinal opening 86 that can accommodate a posable component 1. Further, an exemplary bendable bracket 80 according to this exemplary alternative embodiment may also have a slit 85 running axially from the outside of the sleeve 80 to the centralized longitudinal opening 86. Accordingly, in a first step 180A, a user may align sleeve 80 so that slit 85 may be substantially aligned with the portion of posable component 1 gap space 8/8+/8– sought to be covered. In a second step 180B, an exemplary bendable bracket 80 of sleeve-type configuration may be pressed onto the posable component 1 so that the slitted opening 85 may expand away from the opposing surface(s) of posable component 1 to create an expanse 87 about the posable component 1 (see cross-section C-C in FIG. 1D) through which further pressing may allow the posable component 1 to travel. After repeated or continuous pressing in step 180D, an exemplary on posable component 1 may be enveloped by bracket 80 of the sleeve type and found substantially within opening 86 and slit 85 may be substantially closed.

When bendable bracket 80 becomes sufficiently secured to posable component 1, many advantages may be yielded. For example, bendable bracket 80 may be made of a material (e.g., metal, plastic, rubber, fabric, and combinations of same) that allows for posable component 1 to flex but otherwise substantially obscures the material making up posable component 1 during bending and/or posing of PBB 10. In one aspect, an exemplary bendable bracket 80 may be a metal spring that upon helically adjoining the same to an exemplary portion of an exemplary posable component 1 may allow for substantially free bending of the portion of PBB 10 covered thereby, which may remain substantially unhindered due to the expansive and contractive capabilities of the bendable bracket 80. In another exemplary aspect, bendable bracket 80 may be made of a plastic or other polymer that may be flexible like a flexible spring of similar thickness, coil width, and length/height but also rigid enough to appear like the rigid components 2/3 adjacent to it. In yet another exemplary aspect, bendable bracket 80 may be made of rubber with the same qualities and capabilities of the embodiments comprised of metal or plastic springs. Due to its spring-like configuration, an exemplary bendable bracket 80 may not only accommodate the bending of PBB 10 at the covered portion of posable component 1 about which it goes but it may also allow for near substantial coverage of the posable component 1 located between rigid components 2 and/or 3 that may change the distance between them in terms of spaces 8, 8+, and 8–. In another aspect, bendable bracket 80 may make the regions of PBB 10 that would otherwise be exposed portions of posable component 1 appear with substantially the same dimension (e.g., width or diameter) as rigid components 2 and 3. In yet another aspect, bendable bracket 80 may be used to customize and/or enhance the appearance of PBB 10 when used in a construction system. In a still further aspect, bendable bracket 80 may be made of material that allows for illumination of the PBB 10 (e.g., fluorescent, glow in the dark, or LED attachments). In a still even further aspect, bendable bracket 80 may be an attachment point for even further structures within or outside of the system into which PBB 10 may be placed.

In a more dynamic alternative embodiment, which may be illustratively provided for in FIG. 1C, the translational/sliding ability of body components 2 of an exemplary PBB 10 may be used in conjunction with the spring resilience of bendable bracket 80 to create an embodiment in which body components 2 may be shifted into bendable bracket 80 and be pushed away due to the resilience in the helix bodies 82. For example, an exemplary body component 2 may be separated by space 8 from a permanently attached end component 3 by an exposed length of posable component 1 to which an exemplary bendable bracket 80 may be attached. In a first step 170A, by translating the exemplary body component 2 towards the end component 3 via displacement D1, e.g. by causing space 8 or 8+ over which the bendable bracket 80 may be helically covering to become a space 8 or 8–, an exemplary body component 2 may create potential energy in the bendable bracket 80's helical bodies 82 as they are compressed X1 using the face 5 of translating component 2 against the non-translational face 5 of coupled end component 3 of the exemplary PBB 10 (as per second step 170B). According to an exemplary third step 170C, when body component 2 is no longer pressed against bendable bracket 80, body component 2 may be displaced D2 using the spring resilience of bendable bracket 80 which expands a distance X2 based on its size, material, configuration, etc. According to this dynamic alternative embodiment exemplified by the illustrative embodiment of FIG. 1C, an exemplary bendable bracket 80 may turn PBB 10 into a spring-action like toy in that bendable bracket 80 may expand X2 and displace D2 the translatable body components 2 about posable component 1 when released following translation D1 of a component 2 and compressing of the bendable bracket 80 into a compressed state X1. In yet a further embodiment, the portions of PBB 10 not involved in the compression embodiment may be bent so that the translated component 2 most adjacent the compressed bendable bracket 80 may be held in place whereupon bending of the same may cause component 2 to then be displaced as a result of bendable bracket 80's ability to expand due to translated component 2 no longer being held in place by the bending of the remainder of PBB 10. In an exemplary embodiment based on this dynamic teaching, an exemplary component 2 may be more slidingly engaged to PBB 10 by having less rigid material points of contact with the posable component 1, such as, for example, by having exemplary component 2 being snapped onto the exposed posable component 1.

Figure 3:
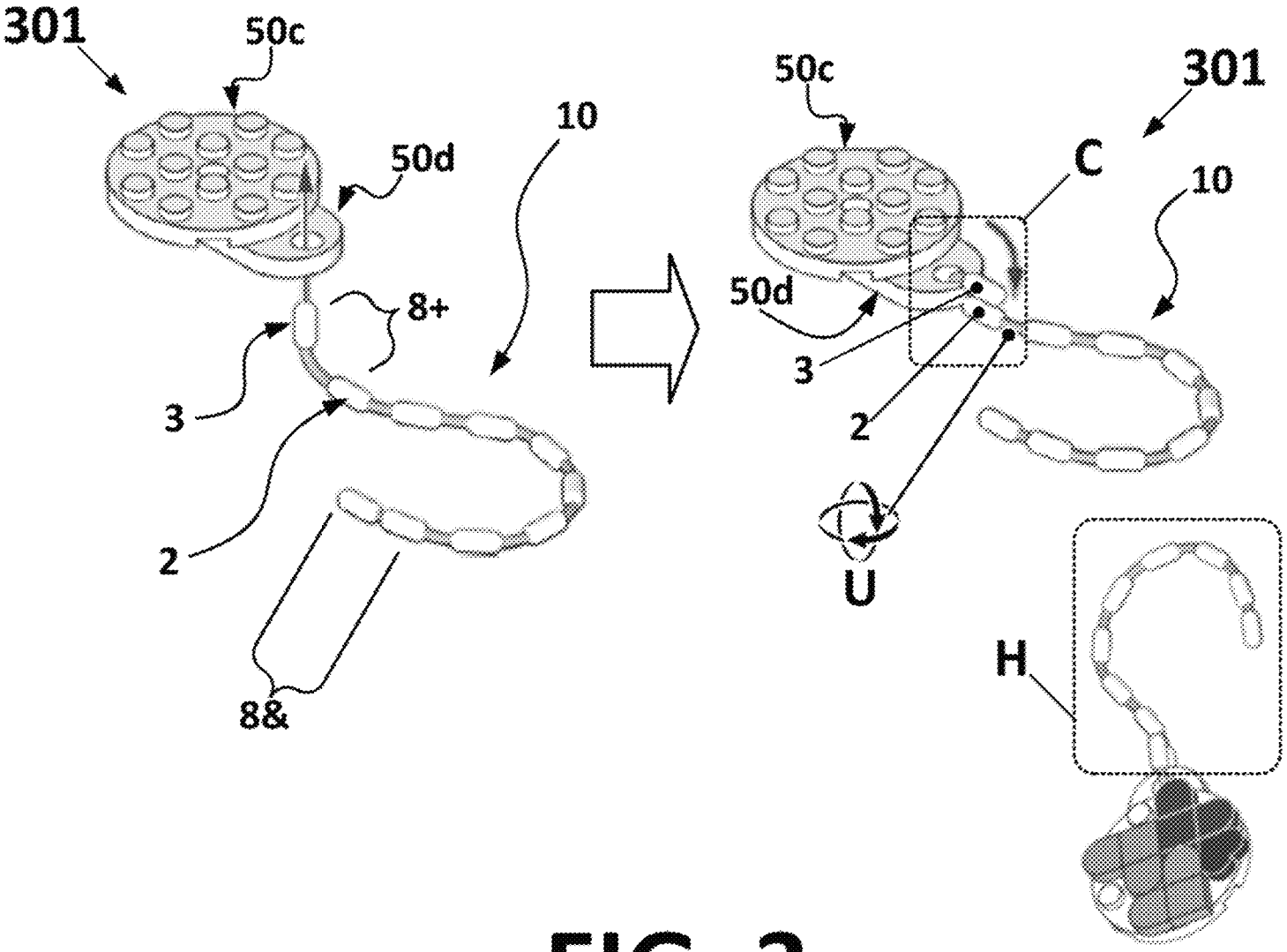
FIG. 3 provides an illustrative embodiment of a third variation of an interconnecting methodology for an exemplary PBB.

Referring now to the illustrative embodiment of FIG. 3, an exemplary PBB 10 in an exemplary construct 301 may pass through an apertured block 50*d* that itself may be coupled to another plate 50*c*. An exemplary aperture block 50*d* may be any interconnecting building block with an aperture therein, which may include, for example, Lego® Part Nos. 3176, 78168, and all variations, combinations, or known functional substitutes for and/or equivalents of the same. According to this illustrative embodiment, an exemplary end component 3 and the next adjacent exemplary body component 2 may have between them a slack space 8+ to provide additional posable component 1 length therebetween. As may be illustrated in FIG. 3, an exemplary PBB 10 may have its end component 3 bent so that component 3 forms a clamp arrangement "C" with the next adjacent body component 2 that holds the non-apertured portion of block 50*d*. With accurate adjustment of the space 8, 8+, and/or 8– between components 2/3, an exemplary PBB 10 as may be illustrated in FIG. 3 may maximize its gripping force about block 50*d* so as to firmly secure the same within the bent spacing 8/8–/8+ in the locking "C" clamping arrangement. An exemplary "C" clamping arrangement may be such as to provide either a universal ("U") joint for the remainder of PBB 10 or a revolute ("R") joint for the remainder of PBB 10 depending on the tightness of the "C" clamping arrangement, e.g., whether the posable component 1, rigid bodies 2/3, and space 8/8+/8– are configured to frictionally hold the remainder of an exemplary apertured block 50*d* in place to create the "U" joint or only slightly frictionally hold the apertured block 50*d* so as to allow the existence of play between the block 50*d* surfaces and the posable component 1 and rigid bodies 2/3 forming the "C" clamp.

As further illustrated in FIG. 3, an exemplary PBB 10 may be posable to form a substantially hook shape or be configured into an inverted-J shape so as to be placed on another object and substantially held thereto. In an exemplary embodiment, a construct 301 may have the non-clamped end turn "H" of PBB 10 that may be a substantially inverted J-shaped hook or bend. In an exemplary embodiment, end turn "H" may be configured to hold onto an ear of a user, e.g., a human being or other animal, a hook or extension of any object or thing, e.g., organic things or otherwise. According to such an exemplary embodiment, exemplary end turn "H" may enable construct 301 to take on the form of an earing or other jewelry piece. In this way, an exemplary PBB 10 in conjunction with blocks like 50*c* and 50*d* may allow for the creation of wearable accessories to which other known snap-fit interconnecting building blocks may be assembled and/or removed. In a preferred embodiment, the possibility and metallic strength of an exemplary PBB 10 may allow for numerous "C" clamping arrangements that would otherwise not be possible using the plastic-on-plastic components of other snap-fit interconnecting building block systems. Alternatively, the end turn "H" may be used for the creation of hanging hooks for a variety of objects, such as, for example, holiday ornaments, stationary, eyewear, automobile ornamentation (e.g., air fresheners), door hangers, window hangers, desk ornaments, portable lights and outdoor hangers, earphones (e.g., headsets, in-ear Bluetooth headsets, or wired headsets). All of the aforementioned and their equivalents may easily incorporate the PBB 10 when configured in the end turn "H" by having similar openings, locks, clutches, and other retainment mechanisms and arrangements disclosed.

Referring to the illustrative embodiment of FIG. 4, an exemplary PBB 10 and PBB 10' may be part of another construct 302 having multiple locking arrangements "L" to create multiple "U" joints for the construct 302. An exemplary base block 50*e*, which may be any known snap-fit interconnecting building block known to those skilled in the art, e.g., a Lego® like brick, capable of accommodating the various pieces to be discussed herein. For example, an exemplary base block 50*e* may be configured to frictionally hold a first clutch 53*a*, a second clutch 53*b*, a third clutch 53*c*, and a fourth clutch 53*d*. As may be appreciated with respect to the teachings related to FIGS. 1 and 2A, an orthogonal arrangement of the openings of clutch 53*a* and 53*c* may provide for a PBB 10 configuration whereby an end component 3 may be friction-fitted within an opening in clutch 53*c* while another component 2 (not shown) may be friction-fitted within another opening in clutch 53*a*. Another orthogonal arrangement of the openings of clutch 53*b* and 53*d* may provide a substantially similar arrangement for a PBB 10' by receiving an end component 3' within an opening in clutch 53*c* while another component 2' (not shown) may be friction-fitted within another opening in clutch 53*b*. Where slack space 8+ may be present for each of PBB 10 and PBB 10' in the illustrative embodiment of FIG. 4, a shield brick 50*f* may be used to prevent direct viewing of the exposed posable component 1 formed thereby. An exemplary shield brick 50*f* may be any known panel-type interconnecting building block, such as, for example, Lego® brick Part Nos. 30413, 6231, 4864, 4865, 91501, 35391, 59349, and all variations, combinations, or known functional substitutes for and/or equivalents of the same. Additional bricks 50*g* may be added to either side of the clutches 53*c* and 53*d* to prevent any torquing or displacement that may result to the same during use of the construct 302. The addition of bricks 50*g* further rigidify the locking arrangement "L" formed in construct 302 while shield brick 50*f* prevents disruption to the slack space 8+ that lay within the construct 302. While the space has been referred to as a slack space 8+, it may be a normal space 8 or reduced space 8– depending on the particular PBB 10 and/or 10'. As assembled, construct 302 may provide for two universal joints ("U"), one for each PBB 10 and PBB 10', proximate to the clutches 53*a* and 53*b*, respectively, making up the locking arrangements L for each.

As disclosed elsewhere herein, the exemplary locking arrangements L illustrated in FIG. 4 may provide additional beneficial aspects. For example, tugging on PBB 10 would not "unplug" the PBB 10 from the construct 302 without also resisting frictional forces of blocks 50*g* and 50*e*. Moreover, with the addition of a properly configured brick or block to snap-fit the cylindrical studs of blocks 53*a-d* and 50*g*, an additional increase in strength and pull-resistance may be added to the construct 302. Nevertheless, the arrangement provided for in FIG. 4 may also allow for passage of an additional PBB 10" perpendicularly through the space formed by the elbow-like bends $\mathbf{8}_L$ in each of PBB 10 and 10', which may be illustrated in FIGS. 4A-E.

Figure 4A:
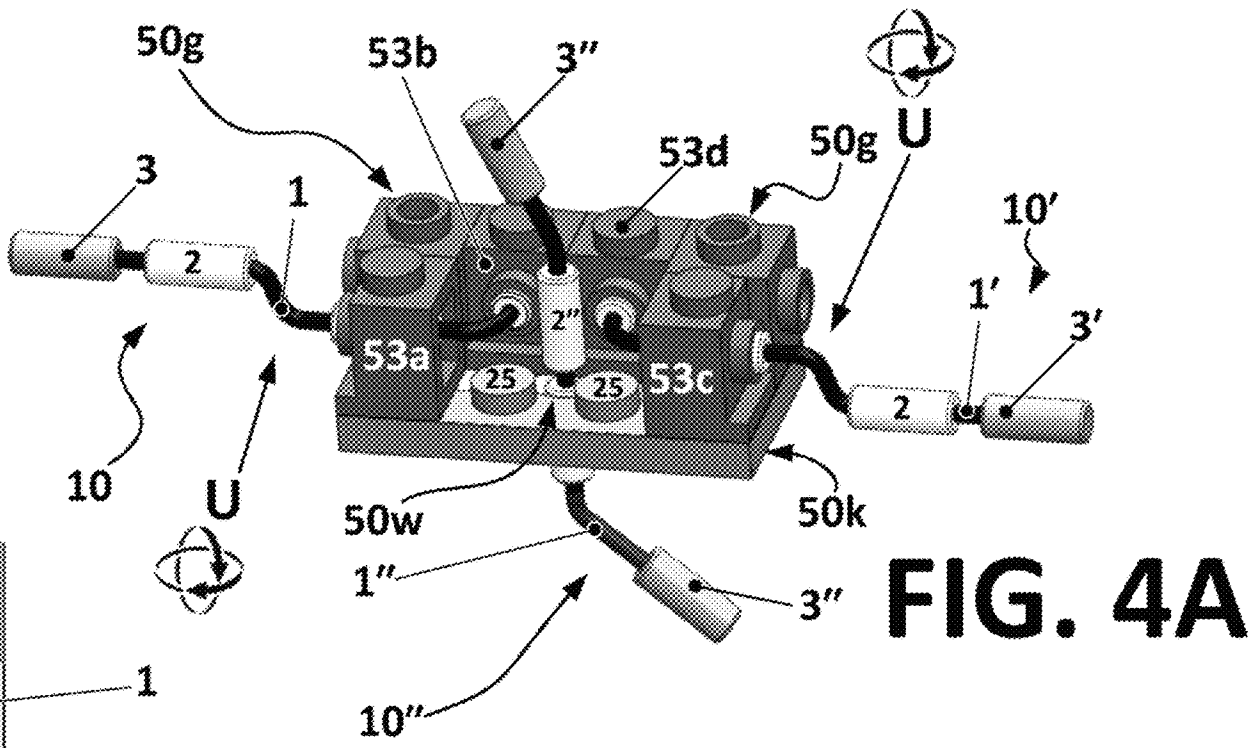
FIGS. 4A-E provide illustrative embodiments of a fifth variation of an interconnecting methodology for an exemplary PBB.
Figure 4B:
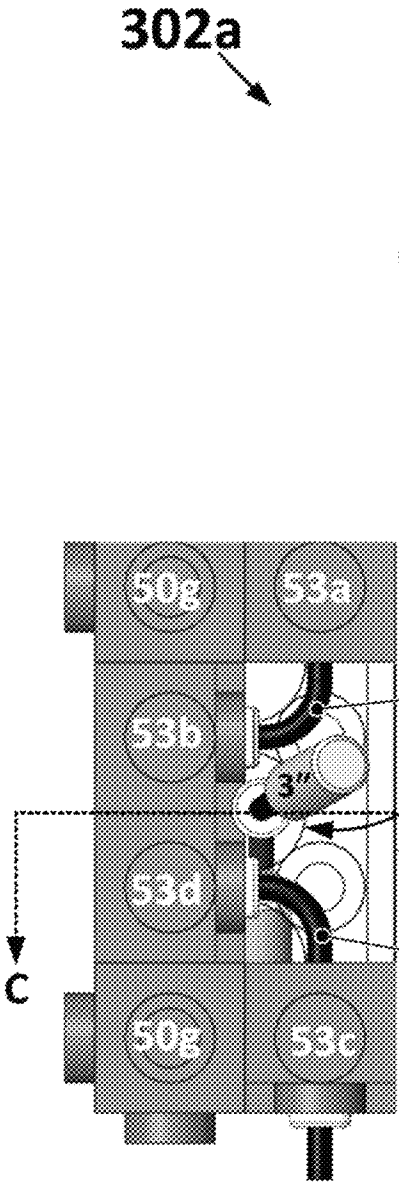

According to the illustrative embodiments of FIGS. 4A-D, an exemplary construction 302*a* may be formed of the same components as construction 302 with the difference being the use of hole plate 50*k* having one or more holes 50*w* through its thickness. An exemplary hole plate 50*k* may be, for example, Lego® Part Nos. 3709, 4032, 3176, 6157, 43045, 32124, 4151, and all variations, combinations, or known functional substitutes for and/or equivalents of the same. As provided for in FIGS. 4A-D, an exemplary construct 302*a* may have two U-joints formed from L-type locking arrangements between PBB 10 and blocks 53*a* and 53*b* and PBB 10' and blocks 53*c* and 53*d*, respectively. Additionally, a PBB 10" may be disposed through hole 50*w* in plate 50*k* such that its rigid components 2"* and 3"* may pass through on one side of the plate 50*k* and the remainder of the rigid components 2" and 3" are below plate 50*k*. As discussed previously, while PBB 10, 10', and 10" may be shown with a certain number and shape of rigid components 2, 2',2",3, 3', and 3", any number and variety of exemplary rigid components may be contemplated depending on needs. As illustrated in FIGS. 4A-B, an exemplary PBB 10" may be situated between the L-formation posable components 1 and 1' of PBB 10 and 10', respectively, the cylindrical extensions from blocks 53*b* and 53*d*, and the studs 25 of plate 50*k*. As such, the construct 302*a* may be particularly useful in creating a multi-moveable section for another larger construct with two U joints and another posable portion above and below the U-joints.

Figure 4C:
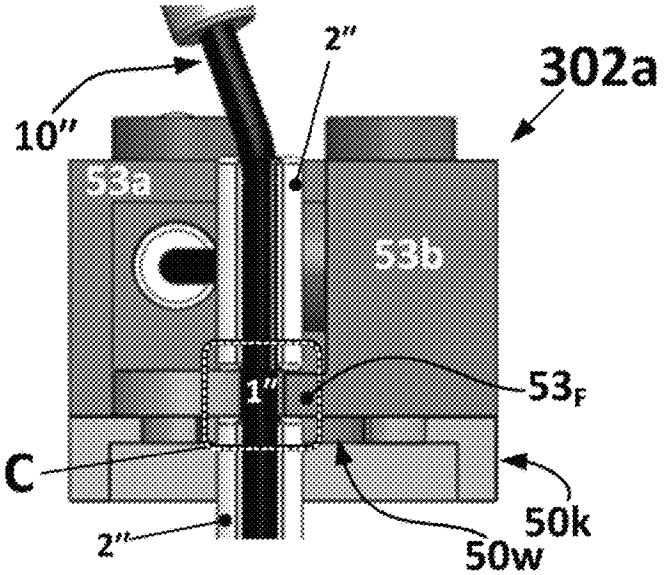

With reference to FIG. 4C, which is the profile sectional view C-C from FIG. 4B, an exemplary construct 302*a* may be illustrated so that a clamping arrangement "C" may be illustrated between the rigid components 2" of the PBB 10" that exist both below plate 50*k* and above plate 50*k*. As may be seen in FIG. 4C, an exemplary rigid component 2" above plate 50*k* may be forced into a position that clamps down upon the foot $\mathbf{53}_F$ of clutch 53*b* while an exemplary rigid component 2" below plate 50*k* may be forced into an opposing clamping position below the foot $\mathbf{53}_F$ of clutch 53*b*. Accordingly, a stability enhancement may be achieved by virtue of the construct 302*a* positioning of PBB 10" among the construct 302 constituents as previously described. Additionally, when another plate or block, such as, plate 50*k in FIG. 4E, is placed atop clutch 53***b*, an exemplary component 2/3 may be sized to fit within the same building block system as the plate 50K*, e.g., the Lego® system, to cause the component, here 2", to be frictionally held in place between the foot $\mathbf{53}_F$ of clutch 53*b* and the bottom of the plate or block attached above it, e.g., plate 50K*.

Figure 4D:
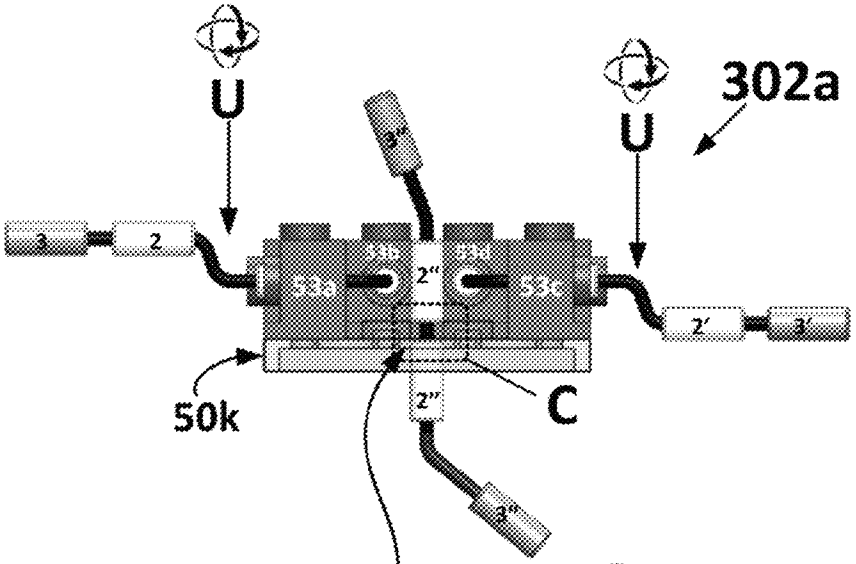
Figure 4E:
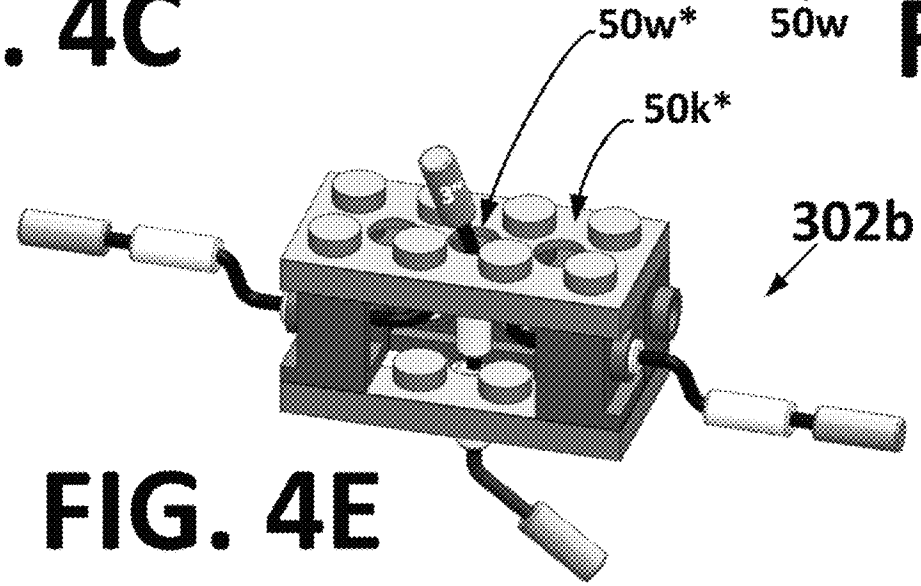

An exemplary result of having both a clamping arrangement and two U joints in such an exemplary system may be illustrated in FIG. 4D. With the addition of an additional hole plate 50*k having an additional hole 50*w, a new construct 302*b* may be formed with a more robust construction due to the increase in snap-fit interconnections. One may also appreciate that the PBB 10" may now be further held in place through both hole plates 50*k* and 50*k** to further stabilize this additional posable component in the construction system destination.

Referring to FIG. 5, an exemplary construct 303 may be composed of a PBB 10 working in conjunction with a plurality of cylindrical blocks 50*i* and grooved blocks 50*h*. According to the illustrative embodiment, an exemplary groove in block 50*h* allows for an exemplary exposed posable component 1 to be held within while the depth of the groove in block 50*h* permits the rigid structure to rotate about the exposed portion of posable component 1. Additionally, the slack space 8+ created for reception within groove block 50*h* may provide for the limited zone of revolution for the block 50*h*. This may be due to the fact that the rigid components 2/3, such as in abutment 8&, prevent translation of groove blocks 50*h* up and down the PBB 10, but may otherwise allow the blocks 50*h* to rotate within the slack space 8+. In this way, an exemplary construct 303 may be configured for use as a rotational joint "R" that operates by being engaged with an exemplary PBB 10 based on the location of any rigid components 2/3 vis-à-vis the rotating parts of the assembly.

With continued reference to FIG. 5, it may also be illustratively provided that an exemplary block 50*j* has a cavity facing towards lock 54*a*. Such a block 50*j* may be any type of friction-fit interlocking building block known to those skilled in the art, such as, for example, Lego® Part Nos. 6143, 3941, 4032, and all variations, combinations, or known functional substitutes for and/or equivalents of the same. As such, block 50*j* may have the cavity for interlocking with another snap-fit interlocking building block (e.g., another block 50*j* and/or brick 50*i*) facing lock 54*a* but otherwise still be coupled thereto via PBB 10. In other words, block 50*j* and lock 54*a* in combination with PBB 10 may achieve a posable and moveable configuration that would have otherwise been physically impossible without PBB 10, namely, friction fitting the cavity of block 50*j* with the face of lock 54*a*, which has no interconnecting means (e.g., cylindrical studs or other friction-inducing structures). In this example, PBB 10 significantly increases the play capabilities of such toys using far less components (e.g., just one PBB 10) and creating joints that such prior art toys do not and cannot provide.

Figure 6C:
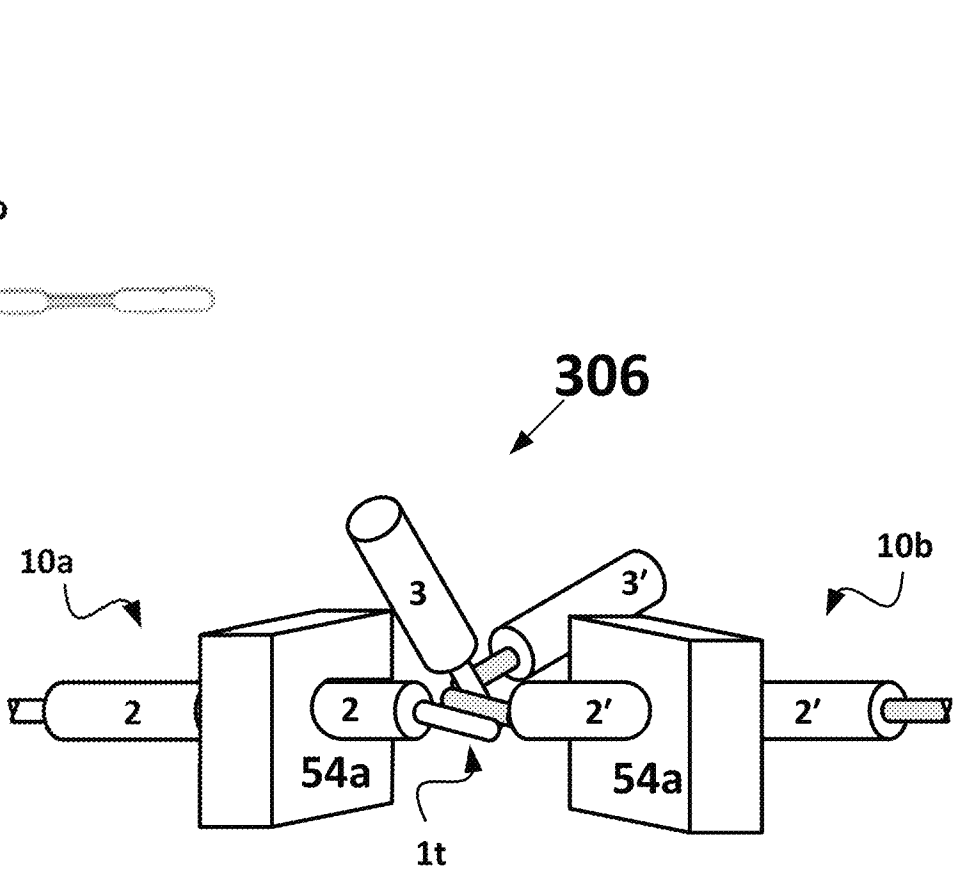
FIGS. 6A-C collectively provide numerous illustrative embodiments of other variations of interconnecting methodologies for exemplary PBB.
Figure 6A:
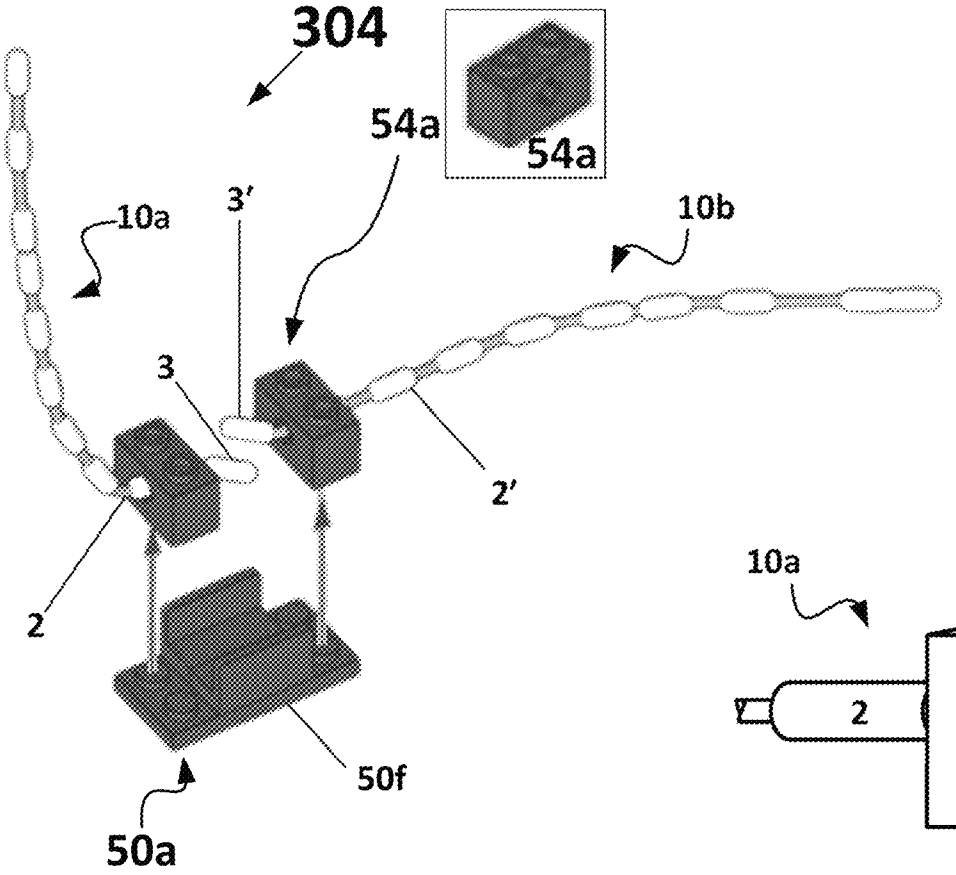
Figure 6B:
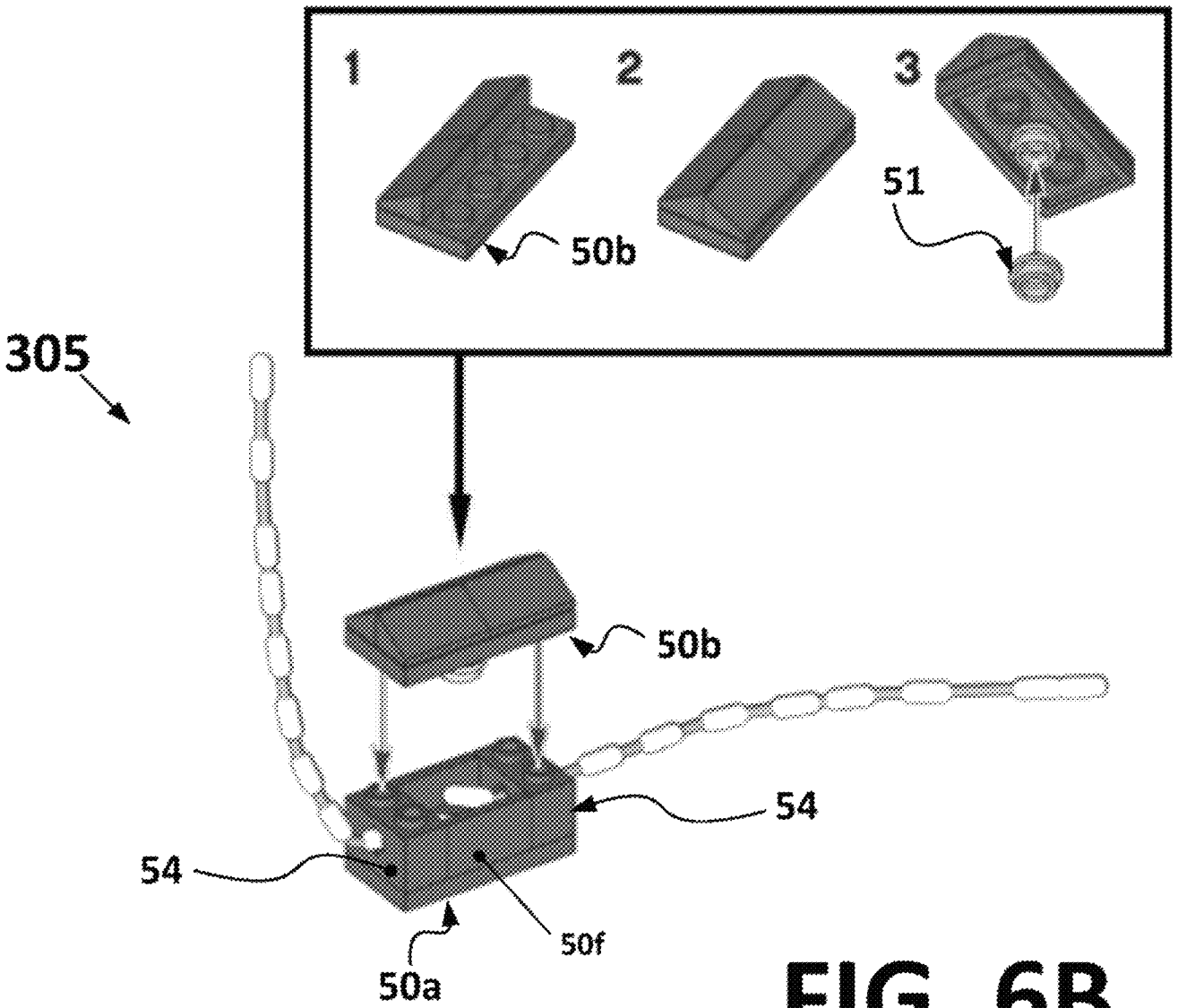

Referring to FIGS. 6A, 6B, and 6C, an illustrative set of constructs 304, 305, and 306 may be provided showing variations of interconnection. In a first embodiment, construct 304 may comprise PBB 10*a* and PBB 10*b* interconnected to one another via a snap-fit interconnecting building block arrangement comprised of a plate block 50*a*, a shielding block 50*f* (e.g., Lego® brick Part Nos. 30413, 6231, 4864-4865, 91501, 35391, 59349, and all variations, combinations, or known functional substitutes for and/or equivalents of the same), and two locks 54*a* with a cruciform-type aperture $O_{54}$a through their minor thickness, such as, for example Lego® brick part nos. 31493, 32064, and all variations, combinations, or known functional substitutes for and/or equivalents of the same. According to this illustrative embodiment, head component 3 of PBB 10*a* may be bent at an acute angle with respect to the next proximal surface of the respective lock 54*a* through which it passes while its preceding body component 2 may be friction-fit within the cruciform aperture $O_{54a}$ thereof. Further according to this illustrative embodiment, head component 3' of PBB 10*b* may be bent at an acute angle with respect to the next proximal surface of the respective lock 54*a* through which it passes while its preceding body component 2' may be friction-fit within the cruciform aperture $O_{54}$a thereof. The angled arrangement of each head component 3 and 3' of PBB 10*a* and 10*b*, respectively, combined with the enclosure created by opposing faces of shield brick 50*f* may create a zone of constraint for the components, and thereby prohibiting substantially free movement in the radial or translational sense for each PBB 10*a* and 10*b*. While the apertures $O_{54}$a of lock 54*a* may be cruciform in this example, the aperture $O_{54a}$ may be any form or configuration depending on needs, e.g., cylindrical as illustrated in FIGS. 10A-G.

In addition or in the alternative to constructs 304, 306, and any others, and with reference to FIG. 6B, an exemplary construct 305 may be like construct 304 with the exception that a top plate brick 50*b* may be used to adjoin to the lock 54*a* of the construct 304 with a specifically spaced round flat brick 51. In this exemplary embodiment, construct 305 may utilize specific geometries of each PBB 10*a*/10*b* and the snap-fit interlocking building block system, such as Lego® system, to prohibit the angled head components 3 and 3' from any form of movement due to tangent contact with the surface of brick 51 descending from flat plate brick 50*b*. In other words, brick 51 abuts each of head components 3 and 3' so that in their bent configurations neither one may rotate while located within construct 305.

In addition or in the alternative to constructs 304, 305, and any others, and with reference to FIG. 6C, which depicts an exemplary construct 306 in an alternative arrangement for combining PBB 10*a*/10*b* within the assembly of lock 54*a* and shield bricks 50*f* atop plate brick 50*a* and below plate brick 50*b*. According to this illustrative embodiment, construct 306 may utilize an advantage provided by an exemplary PBB 10 in that each PBB 10 may couple to one another via a twist 1*t* comprised of their separate posable components 1 wrapped about one another. According to this exemplary embodiment, each head component 3 and 3' of PBB 10*a* and 10*b*, respectively, may interlock with one another via a twist 1*t* that prevents either one from moving rotationally or translationally within construct 306. In a preferred embodiment, a twist 1*t* as a coupling between separate PBB 10 may be especially robust due to the metal-on-metal contact between the PBB 10. In an exemplary embodiment, the twisting configuration of head component 3 about head component 3' of PBB 10*a* and 10*b*, respectively, may be further disposed between the shields 50*f* so that each of the head component 3 and 3' thereof, respectively, may be stored tightly within the closed construct 306 made from the lock 54*a*, plates 50*a* and 50*b*, and shields 50*f*. In an exemplary embodiment, the twist-and-store technique of FIG. 6C may ensure a robust connection between separate PBB 10 while each PBB 10 is within a building block system. In a further exemplary embodiment, the twisting of PBB 10 to one another may create a portion or all of the universal joints in an exemplary construction, e.g., constructions 310-312. In a preferred embodiment, the twist coupling of one PBB 10 to another PBB 10 may be the strongest and most optimal joinder of two PBB within a building system due to the metal-on-metal contact.

FIGS. 7A-G may provide another exemplary coupling technique for an exemplary PBB 10. As illustrated in sequence from FIG. 7A through and to FIG. 7E, an exemplary PBB 10 may be shown with a head 3 and/or body component 2 coupled via a length of posable component 1. The brick into which PBB 10 may be disposed is brick 57 having at least one-hole 57*a*, but may have additional hole 57*b*. In an exemplary embodiment, brick 57 may be any of the following Lego® Part Nos.: 2817, 10247, and all variations, combinations, or known functional substitutes for and/or equivalents of the same. Each hole 57*a/b* may be configured to receive a cylindrical block element 55, as was used in FIG. 1, that may snap fit into each hole 57*a/b*. Additionally, each stud 25 located on brick 57 may receive a cylindrical block plate 51.

From FIGS. 7A to 7B to 7C to 7D to 7E, the skilled artisan may visually be presented with a sequence by which an exemplary PBB 10 may be inserted into an exemplary brick 57 so that at least one of the head/body component 3/2 may be friction fit within an opening in cylindrical block element 55 while the same is snap-fit into hole 57*a/b* while another head/body component 3/2 may be coupled atop brick 57 via a combination of the ridges 51*a** and 51*b** of plate brick cylinders 51 snap-fit to studs 25 located on brick 57. Alternatively, the head/body 3/2 previously referenced may be merely disposed within hole 57*a/b* without any cylindrical block element 55, although other flat circular plates (51*a/b*) may be used in an attached friction-fit formation to brick 57 and/or may be used in conjunction with the apertured brick 50*d* from FIG. 3. In a preferred embodiment, an exemplary PBB 10 may pass one or more of its head/body 3/2 first through the aperture of aperture brick 50*d* and then be bent into a position to be disposed within hole 57*a/b* of brick 57.

Figure 7A:
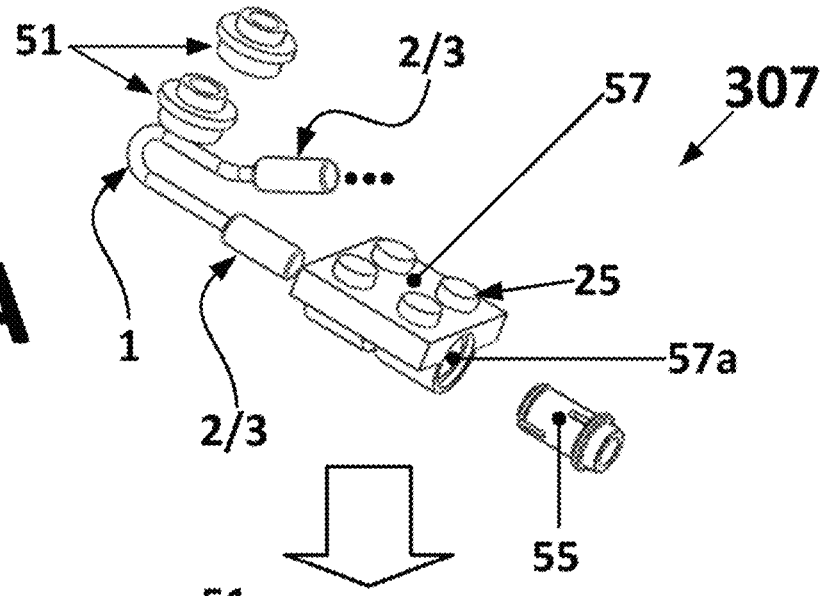
FIGS. 7A-7G provide for illustrative embodiments of yet other variations of interconnecting methodologies for an exemplary PBB.
Figure 7B:
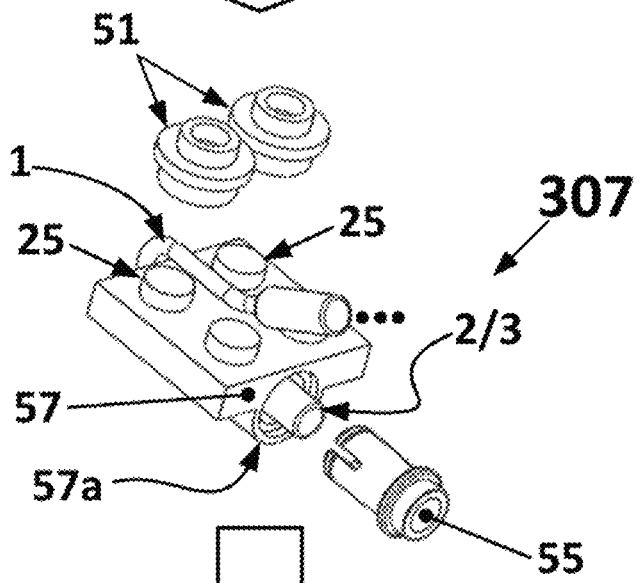
Figure 7C:
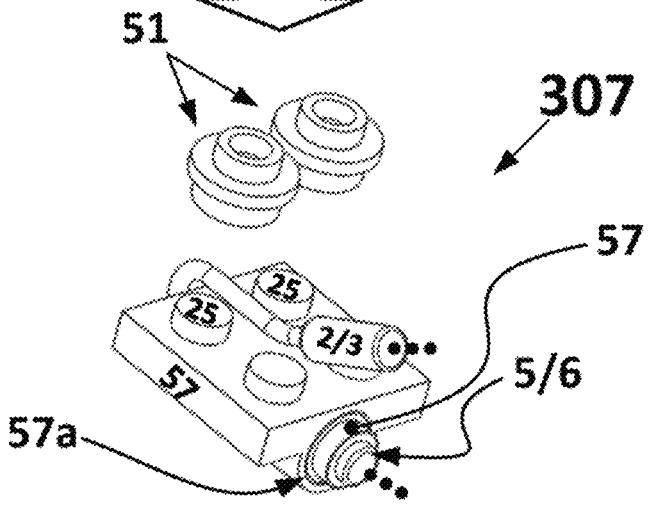
Figure 7D:
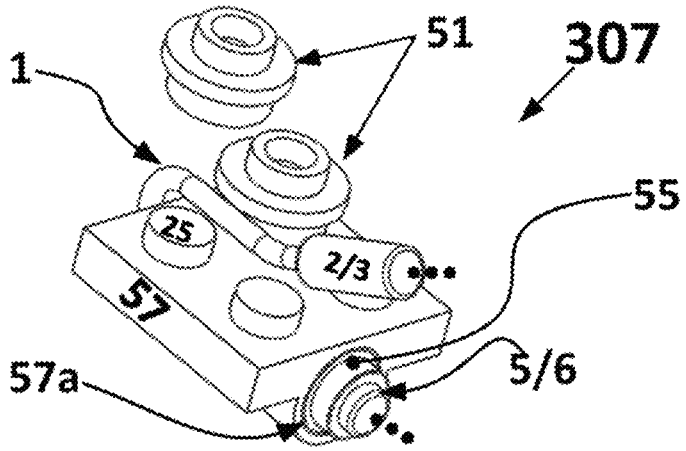
Figure 7E:
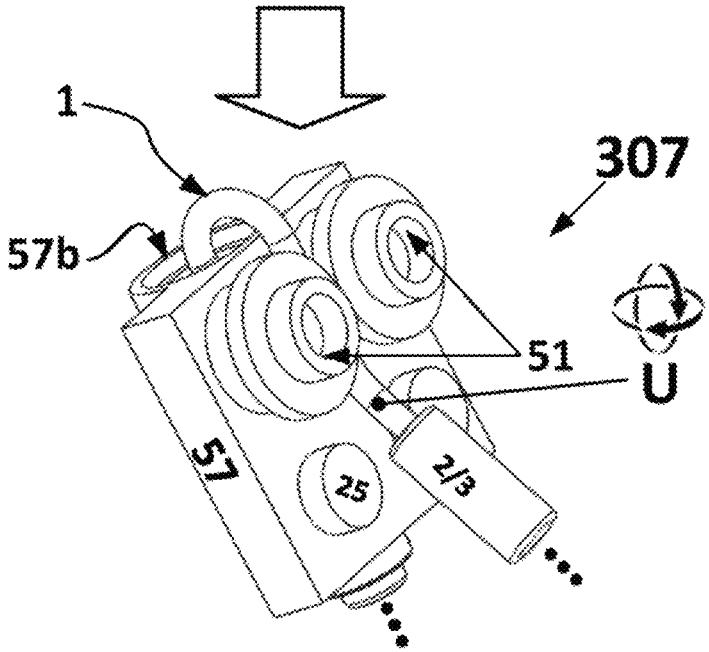
Figure 7F:
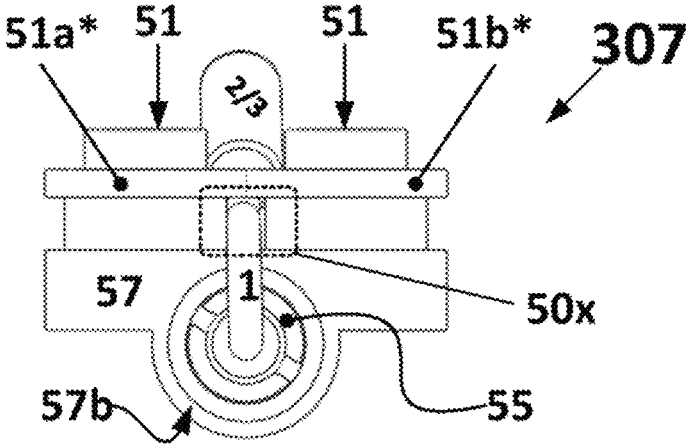
Figure 7G:
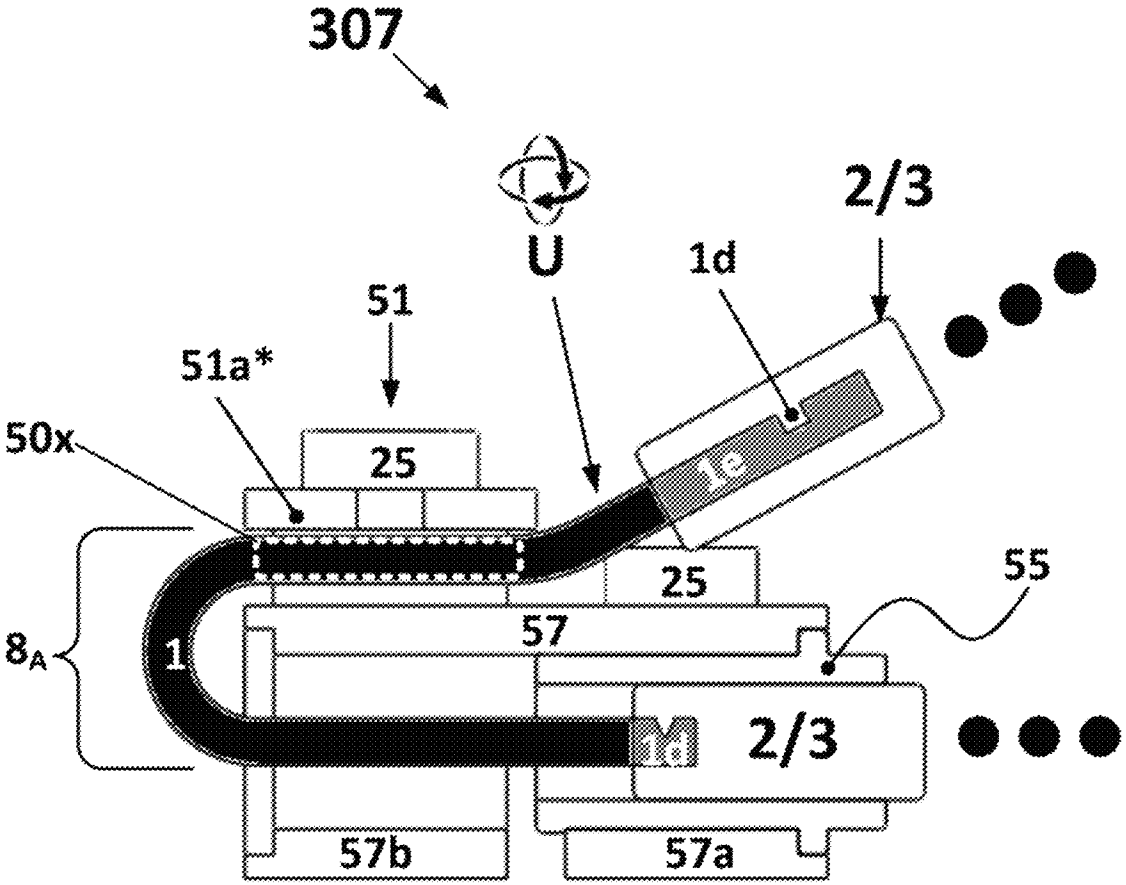

As provided for in FIGS. 7E-G, an exemplary construct 307 formed by the steps illustrated in FIGS. 7A-D may be considered a "terminating" construct because it substantially reduces all available degrees of freedom of the head/body components 3/2 included in the same. In an exemplary embodiment, a head component 3 is the component frictionally fitted within element 55 While a similar gap space 50*x* may result from the teachings related to construct 307, it may be seen that the 1800 turn of posable component 1 about brick 57 substantially eliminates any play that may exist for mobility of any exemplary body/head components 2/3 that may exist past the plate brick cylinders 51.

Also contemplated herein are blocks designed specifically to rigidly hold exemplary PBB 10 within a toy building block system, e.g., the Lego® system, so as to create one or more locking arrangements L, clamping arrangements C, U joints, R joints, and combinations of the same. Exemplary blocks of such design may be illustratively provided for in FIGS. 8A-D. As illustrated in FIGS. 8A-D, an exemplary construct 308 may comprise an exemplary PBB 10 with one or more components 2/3 disposed on stock 58 within a retainer 58*a*. While retainer 58*a* may be illustrated as a substantially C-shaped channel extending inwardly from outer block surface 58*b*, it may be understood that retainer 58*a* may be any shape or contour (within or outside of stock 58) that may be configured to frictionally or otherwise tightly hold one or more surfaces of an exemplary rigid component 2/3 of an exemplary PBB 10, e.g., ovular, polygonal (square, rectangular, trapezoidal, octagonal, trigonal), pyramidal, scalloped, faceted, frusto-pyramidal, hexagonal, and combinations of the same and others known to those skilled in the art. In a preferred embodiment, retainer 58*a* may be the negative of the surface of the component 2/3 designed to be retained within stock 58.

Figure 8B:
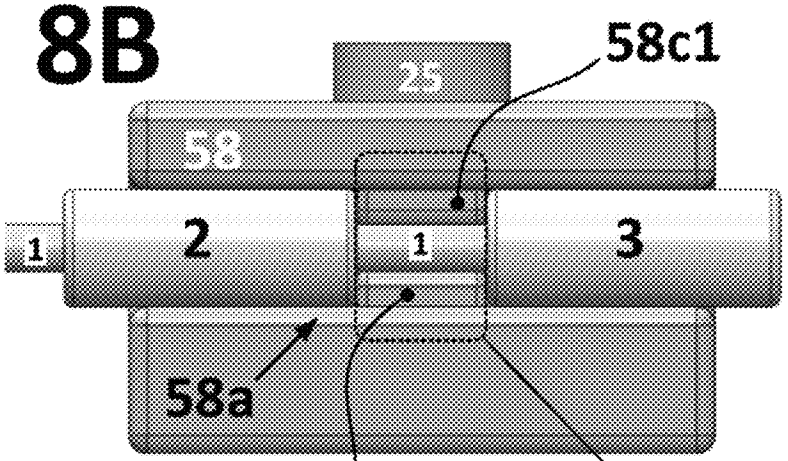
Figure 8A:
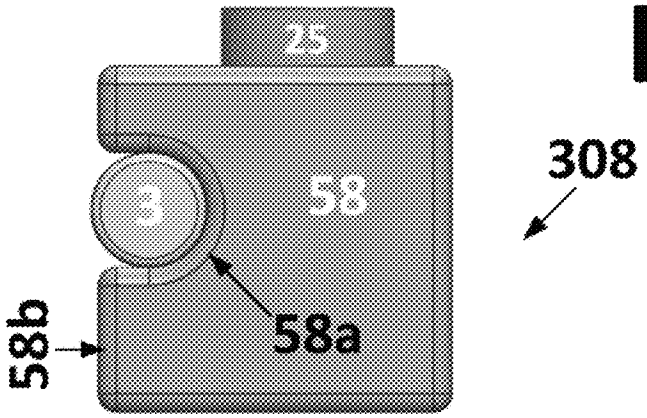
Figure 8C:
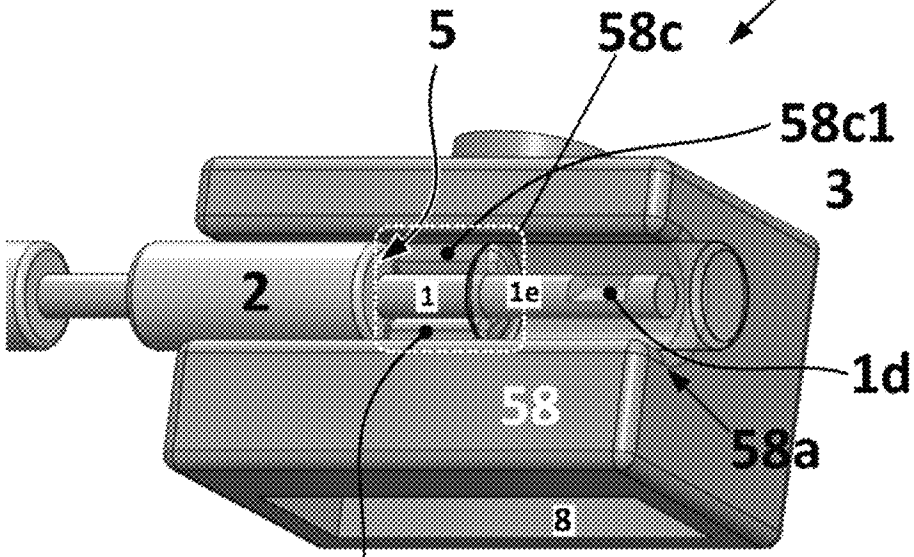
Figure 8D:
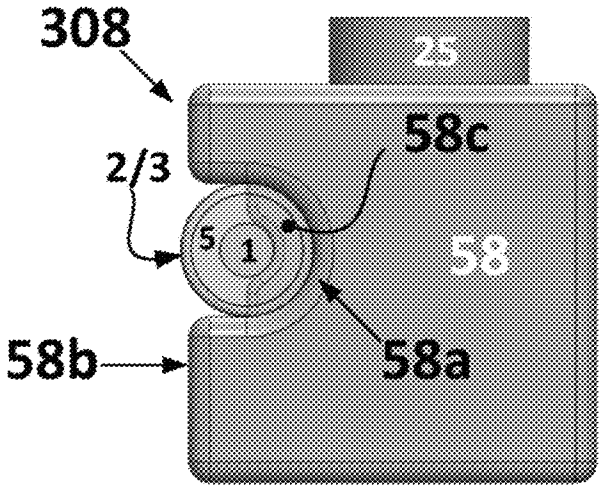

In an exemplary embodiment, an exemplary stock 58 may have a mouth 58*c* comprised of an upper jaw 58*c*1 and a lower jaw 58*c*2, however an exemplary mouth 58*c* may be designed so as to have only one of these jaws 58*c*1/58*c*2, depending on needs. An exemplary mouth 58*c* may cooperate with retainer 58*a* to ensure a rigid hold on an exemplary PBB 10 via one or more parts of an exemplary PBB 10, such as, posable component 1, one or more of the rigid components 2/3, and combinations of the same. As illustrated in FIGS. 8B-D, an exemplary mouth 58*c* may be illustrated with jaws 58*c*1 and 58*c*2 holding posable component 1 while the internal surfaces 5 of each rigid component 2/3 face the mouth 58*c* while being held within stock 58. As may be illustratively disclosed in FIGS. 8A and 8D, an exemplary stock 58 may grip the PBB 10 so that the retained surfaces of the components 2/3 and posable component 1 may not go beyond an outer surface 58*b* of the stock 58. However, an exemplary stock 58 may retain portions of PBB 10 that may extend beyond surface 58*b* either fully or in part. An advantage of maintaining the retainer portions of PBB 10 within an exemplary stock 58 so that none extend beyond the surface 58*b* may be the use of stock 58 adjacent other building blocks or toy systems without interference from PBB 10. For example, an exemplary stock 58 with an embedded retainer 58*a* that places the retained portions of PBB 10 away from outer surface 58*b* may be placed in abutting position to another snap-fit interconnecting building block so that an outer surface of the other building block is coincident with substantially the entire outer surface 58*b*. In this exemplary way, the stock 58 in combination with other blocks may conceal the retention points of PBB 10 and leave exposed only those parts of PBB 10 that may be needed for the U joint and/or R joint as the case may be.

While stock 58 may be shown as a block, those skilled in the art would understand stock 58 may be configured to have the design of other toys or toy parts, e.g., the torso of an action figure, the shoulder of an action figure (e.g., as may be illustrated in FIG. 13C), the floor of a toy playset, etc. In other words, the "block" depiction of stock 58 should be understood to enable the reader to appreciate that different contours and surfaces may be designed in a solid structure (block, brick, toy, toy playset, and the like playthings) to rigidly hold and restrict movement of an exemplary PBB 10 configured to work with the same. However, the stock 58 should be understood to not be so limited and may take other forms that may serve similar functions.

In another exemplary embodiment, an exemplary PBB 10 may comprise only two end components 3 separated from one another by an exposed portion of posable component 1, such as, for example, the illustrative embodiments of FIGS. 6G-6M of International Patent Application No. PCT/US2022/54016, which are incorporated herein by reference in their entirety. Alternatively, a PBB 10 may have both end and body components 3/2, respectively, with sufficient spacing 8 therebetween for an object to fit between the existing body components 3/2. In either exemplary alternative herein, and with reference to the illustrative embodiments of FIGS. 9A-F, an exemplary snap component 59 may be incorporated into the PBB 10 so as to be configured to function as an exemplary body component 2 as illustrated and described in International Patent Application No. PCT/US2022/54016 and U.S. patent application Ser. No. 17/561,926, the relevant disclosures of which being incorporated herein by reference in their entirety. An exemplary snap component 59 may be divided into two halves: upper half 59*a* and lower half 59*b* to form a rigid component that snap-fits about an exposed portion of the posable component 1 of an exemplary PBB 10.

In an exemplary embodiment, the exposed portion of the posable component 1 to which snap component 59 halves 59*a* and 59*b* may couple may be found between (i) two end components 3, (ii) an end component 3 and body component 2, and/or (iii) two body components 2. According to this illustrative embodiment, an exemplary snap component 59 may have an outlet 7* formed in whole or in part in one or more of halves 59*a* and/or 59*b*. In an illustrative example as provided for in FIGS. 9A-F, an exemplary outlet 7* may be formed partly in upper half 59*a* of snap component 59 and may be formed partly in lower half 59*b* of snap component 59 so that when the upper half 59*a* is coupled to the lower half 59*b*, a complete outlet 7* may form about the posable component 1 located therebetween. It should be understood that snap component 59 may be any known type of interconnecting building block component, e.g., Lego® block, or rigid component capable of having within it an appropriately sized outlet 7* through which an exemplary posable component 1 of an exemplary PBB 10 may pass. For example, an exemplary snap component 59 may be a cylindrical component 2 as provided for in PBB 10 illustrations depicted and disclosed elsewhere herein. Alternatively, an exemplary snap component 59 may be a feature in another toy or toy plaything that may be used to attach an exemplary PBB 10 thereto.

Figure 9B:
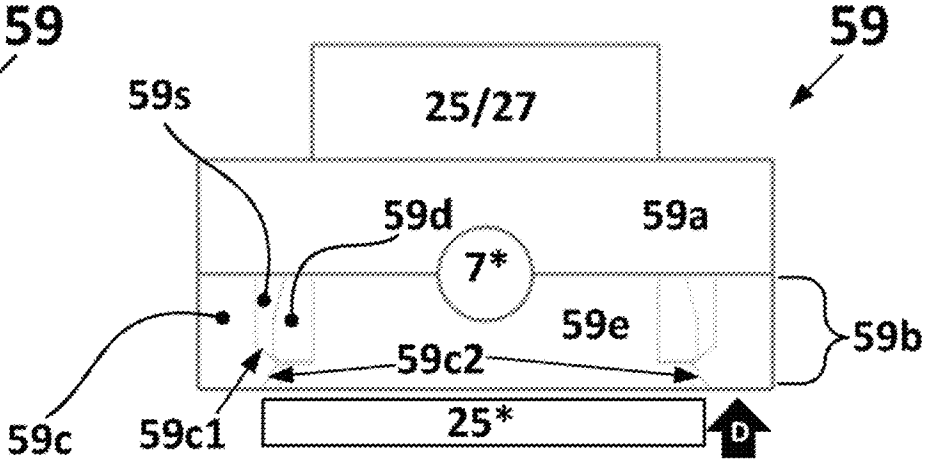
Figure 9D:
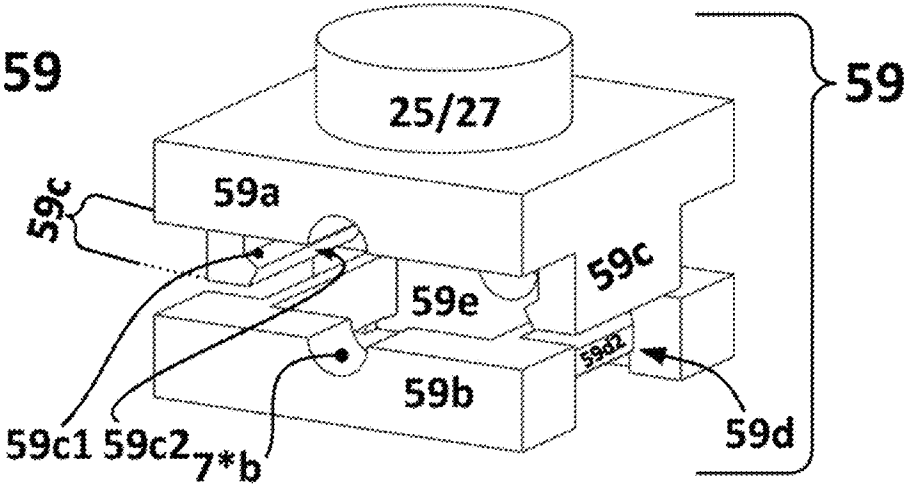
Figure 9A:
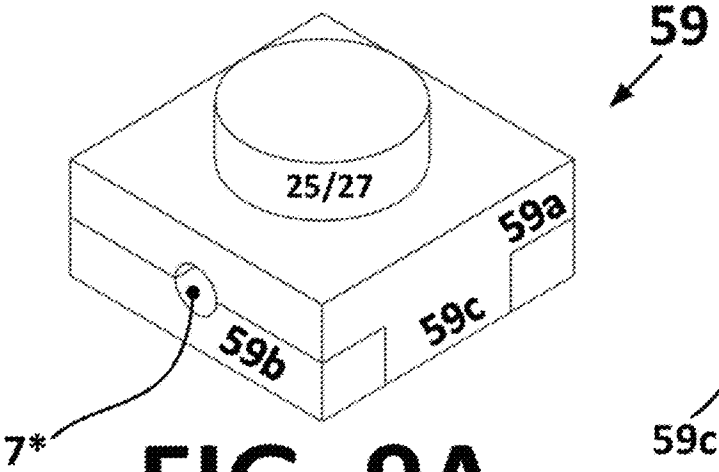
Figure 9C:
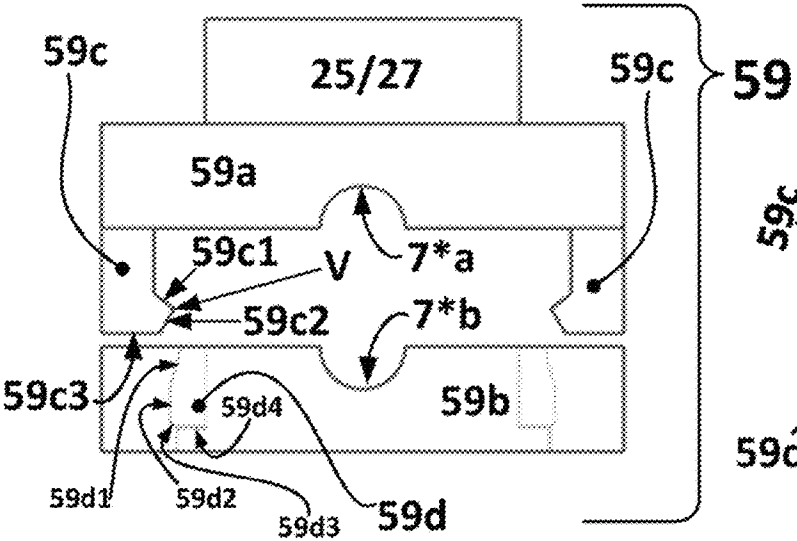

As may be illustratively provided for in FIGS. 9A-E, an exemplary upper half 59*a* of an exemplary snap component 59 may comprise at least one snap arm 59*c* descending downwardly therefrom. With reference to FIGS. 9B-D, an exemplary snap component 59 may have the snap arm 59*c* of its upper half 59*a* engage a retainment 59*d* found within the lower half 59*b*. As illustratively shown in FIGS. 9B-C, an exemplary snap arm 59*c* may have several surfaces to engage the corresponding retainment 59*d* in lower half 59*b* of snap component 59. For example, an exemplary snap arm 59*c* may have an impact surface 59*c*2 that may first contact retainment 59*d* at retainment surface 59*d*1. According to this illustrative embodiment, as upper half 59*a* is pushed into lower half 59*b*, retainment surface 59*d*1 causes impact surface 59*c*2 to deflect, and in turn cause snap arm 59*c* to deflect, in a direction substantially orthogonal from retainment surface 59*d*1. When snap arm 59*c* reaches deflection plateau 59*d*2 any further downward movement of upper half 59*a* into lower half 59*b* may result in sliding contact between a vertex V formed by surfaces 59*c*1 and 59*c*2 and plateau 59*d*2. Further according to this illustrative embodiment, as upper half 59*a* is pushed further into lower half 59*b* such that vertex V has traversed the full length of plateau 59*d*2, snap arm 59*c* may be at its maximum deflected position. However, once vertex V passes plateau 59*d*2, the snap action of snap arm 59*c* may be fully realized when surface 59*c*1 becomes disposed substantially parallel to holding surface 59*d*3 of retainment 59*d*. Surface 59*cl* may glide across holding surface 59*d*3 with or without friction to enable formation of a complete snap component 59. In an exemplary embodiment, vertex V may be in the same plane as retainment lower surface 59*d*4. In another exemplary embodiment, vertex V may be in a plane distal from retainment lower surface 59*d*4. In yet another exemplary embodiment, lower surface 59*c*3 of snap arm 59*c* may be in substantially the same plane as the lowest surface of lower half 59*b*, as may be illustratively provided for in FIG. 9B. It should be understood that while an exemplary snap component 59 may be used to snap upper half 59*a* and lower half 59*b* about the circumference of posable component 1, such a snap component 59 may be used in isolation of a PBB 10 depending on needs.

In another exemplary aspect of the illustrative embodiments of FIGS. 9A-F, an exemplary snap component 59 may have a cavity 59*e* formed upon coupling of upper half 59*a* to lower half 59*b*. It may be also contemplated that a key stud 25* may be configured with surfaces that allow it to be put into a deflection motion "D" so that it may impact snap arm 59*c* at surfaces 59*c*2 and deflect the snap arms 59*c* so that they disengage from retainment 59*d*. Deflection movement "D" of an object possessing key stud 25* (such as another toy or a special tool) into lower half 59*b* of snap component 59 may simultaneously force surface 59*c*1 to glide (frictionally or non-frictionally) across retainment surface 59*d*3 and push upper half 59*a* of snap component 59 into increased disengagement away from lower half 59*b*. In a preferred embodiment, a snap component 59 coupled to an exemplary posable component 1 of an exemplary PBB 10 may be disengaged from the PBB 10 using a key stud 25*. According to this preferred embodiment, a user may push snap component 59 against key stud 25* to cause deflection of the snap arm 59*c* of upper half 59*a* from the lower half 59*b* into which the key stud 25* may be engaged. In a first aspect of this preferred embodiment, the pushing of snap component 59 may include use of the remainder of PBB 10 that is not otherwise found within snap component 59 to force the snap component 59 portion of the PBB 10 into disengaging contact with the key stud 25*. In a second aspect of this preferred embodiment, a tool having the key stud 25* may hold the PBB 10 and the lower half 59*b* of snap component 59 such that the only part of snap component 59 that is permitted to freely move is upper half 59*a*. According to this second aspect, the tool with key stud 25* would use the PBB 10 to hold lower half 59*b* in place and with properly configured deflection movement "D" cause the upper half 59*a* of snap component 59 to disengage the retainment 59*d* of lower half 59*b* and cause the snap arm(s) 59*c* of upper half 59*a* to release and slide and/or pop off of the lower half 59*b* to which they were engaged.

Figure 9F:
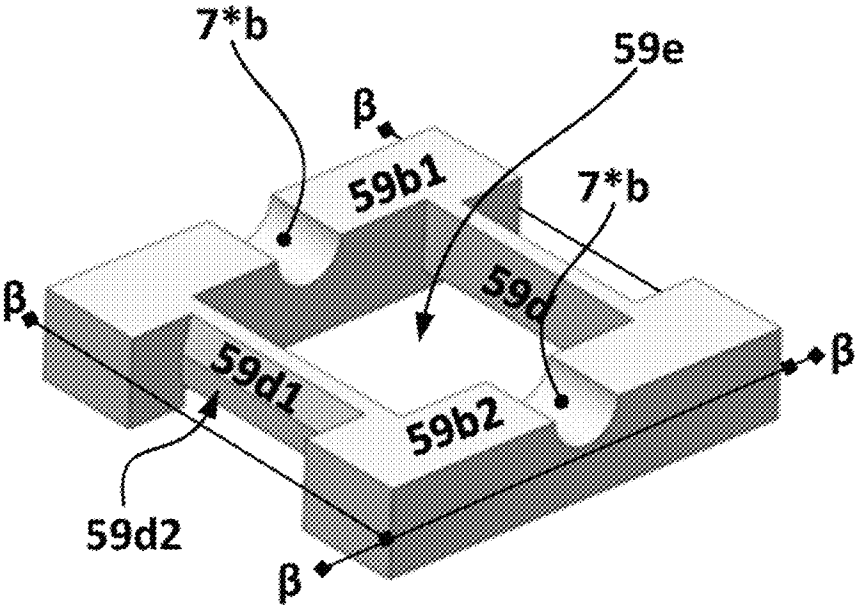
Figure 9E:
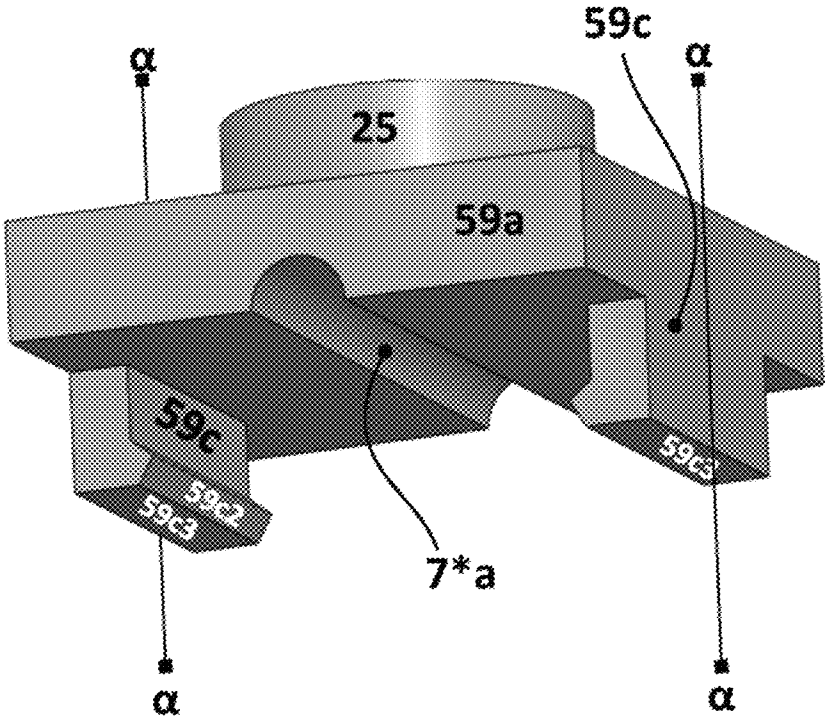

In an exemplary embodiment, an exemplary snap arm 59*c* may engage retainment 59*d* to form one or more snap-fit spaces 59*s*, which may be used by those skilled in the art to enable deflection of the snap arm 59*c* and disengagement between halves 59*a* and 59*b*. Those skilled in the art would understand how to use the various features (59*c*-*d*), surfaces (59*c*1-3, 59*d*1-4) and spaces (59*s*) of an exemplary snap component 59 to perfect the snap fit capabilities of snap component 59 as well as disengagement capabilities of upper half 59*a* and lower half 59*b*, to take any known snap-fit interconnecting building block, e.g., Lego® block, K'nex® block, in to a snap component or block 59. As may be understood with reference to FIGS. 9E-F, exemplary upper half 59*a* and lower half 59*b* may be injection mold manufactured without additional release tooling to form the undercuts that may be typically necessary to form a snap-fit structure. For example, as illustrated in FIG. 9E, an exemplary upper half 59*a* of an exemplary snap component 59 may be injection molded so as to have a parting line along lines α-α. As another example, as illustrated in FIG. 9F, an exemplary lower half 59*b* of an exemplary snap component 59 may be injection molded so as to have a parting line along lines β-β. Partin lines, such as those illustrated in FIGS. 9E-F, allow formation of snap-fit structures but without any overhangs or additional release tooling.

With reference to the exemplary embodiments illustratively provided for in FIGS. 10 and 10A-G, an exemplary construct 310 may be comprised of shell structures 91A and 91B having one or more openings $O_{54}$. As may be seen in detail in FIG. 10, shell structure 91A may have an exterior surface 92 and an interior surface 93 on which a variety of structures may be found as well as a variety of half-openings $O_{54}$A, $O_{54}$C, and $O_{54}$E in the shell rim 91E of shell 91A. An exemplary structure that may be found on interior surface 93 of shell 91A may be coupling post 94, which may be shown extending away from surface 93 and has its own opening $O_{94}$. Another exemplary structure that may be found on interior surface 93 of shell 91A may be clutch 53 having an opening $O_{53}$. The positioning and placement of the structures 94 and clutch 53 may be contingent on the structures on the shell 91B as well as the location of the half-openings in both shell 91A and 91B.

Figure 10:
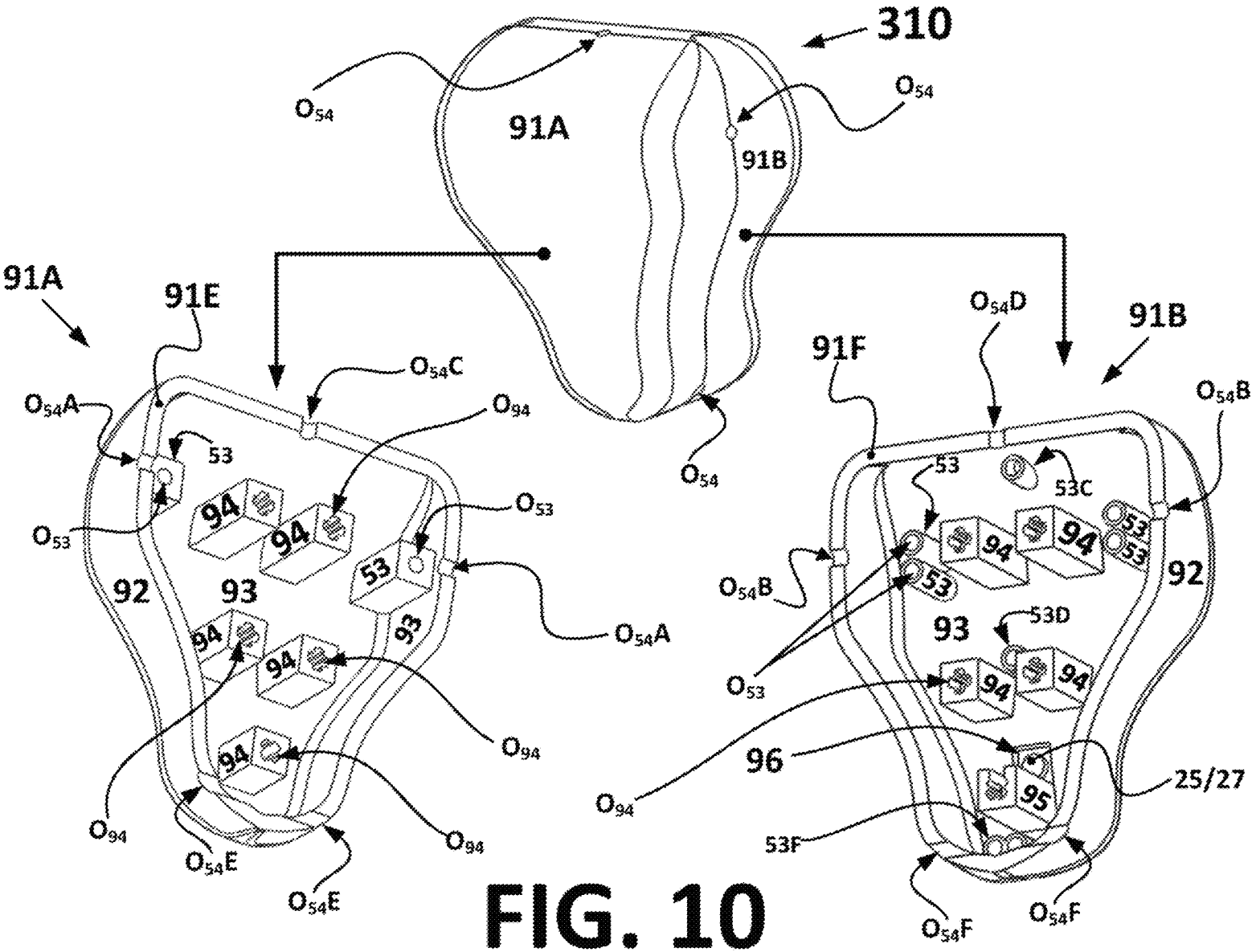

With continued reference to FIG. 10, an exemplary shell structure 91B may have an exterior surface 92, and an interior surface 93 on which a variety of structures may be found as well as a variety of half-openings $O_{54}B$, $O_{54}D$, and $O_{54}F$, whose positions along shell rim 91F of shell structure 91B may be such that when shells 91A and 91B are coupled, the half-openings $O_{54}A$, $O_{54}C$, and $O_{54}E$ in rim 91E of shell 91A combine with half openings $O_{54}B$, $O_{54}D$, and $O_{54}F$ in rim 91F of shell 91B to form complete openings $O_{54}$. Like shell 91A, an exemplary shell 91B may have a couple post 94 with opening $O_{94}$ such that when shell 91A and shell 91B are coupled, the couple posts 94 on each interior 93 of the shells 91A and 91B may be used to hold the shells 91A and 91B together as construct 310. Like shell 91A, exemplary shell 91B may have clutches 53, 53C, 53D, and 53F extending upwardly from interior surface 93 and/or couple to another structure (e.g., coupling posts 94) and suspended above surface 93. As shown in FIG. 10, an exemplary interior surface 93 may have a multifunction coupling post 95 and/or attachment regions 96, which may be used to allow for coupling other objects, such as other toys and/or toy systems. As illustrated in FIG. 10, the attachment region 96 depicted may have a coupling stud 25/27 onto which a snap-fit interlocking building block may be coupled, e.g., like a Lego® system building block known to those skilled in the art. While structures have been identified as being on surface 93 of shells 91A and 91B, these and like structures, such as those disclosed anywhere else herein, may be located on any other surface (e.g., interior surface 93, exterior surface 92, rims 91E/F) of shell 91A and shell 91B.

Figure 10B:
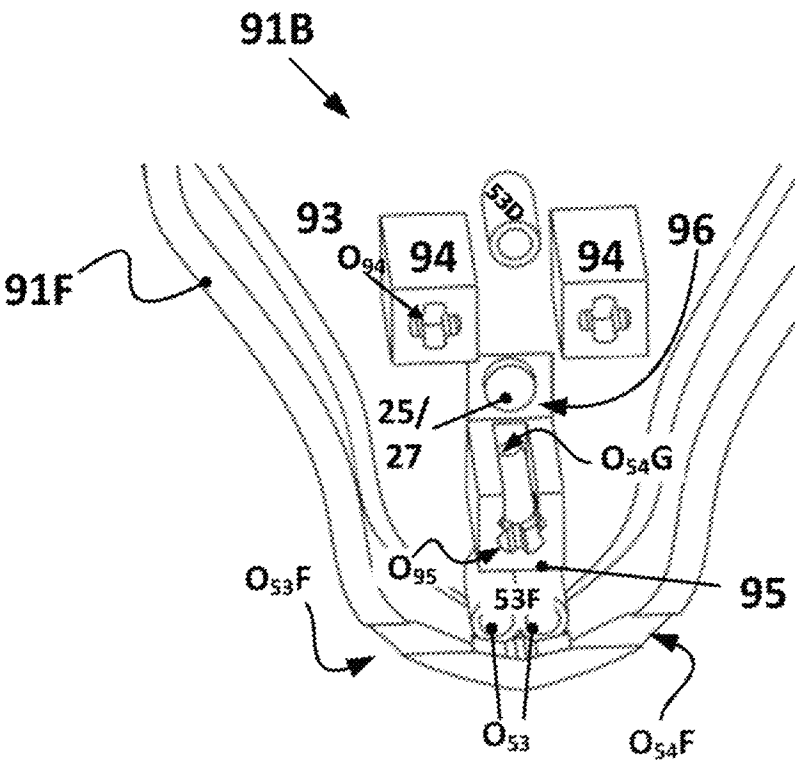
Figure 10A:
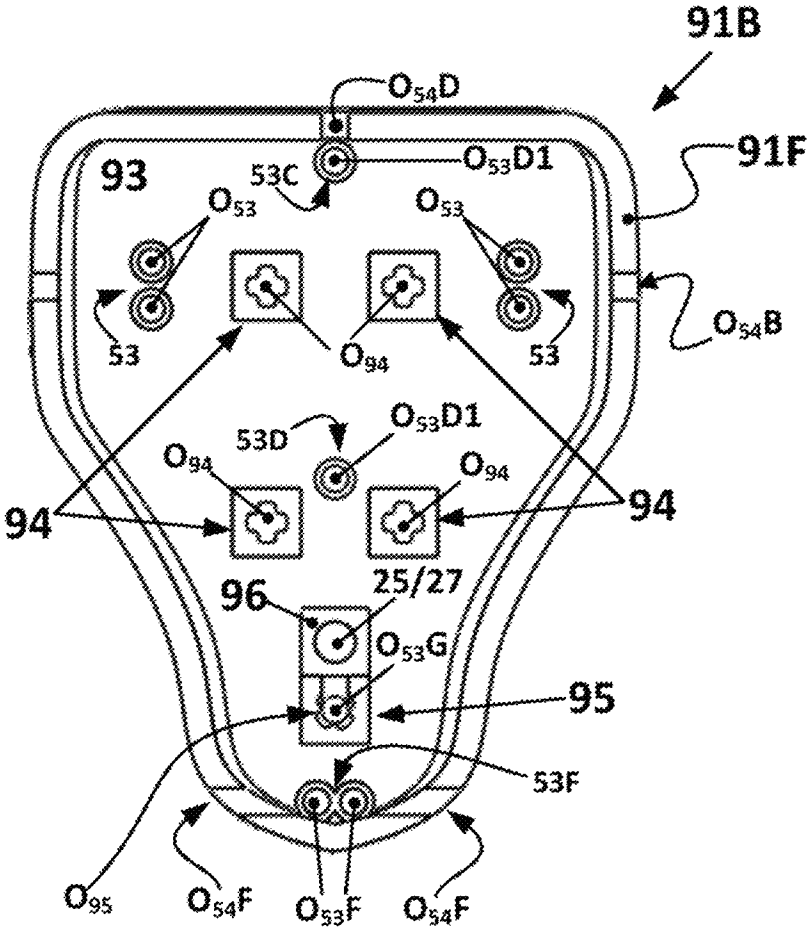

With reference to FIGS. 10A-B, an exemplary multifunction coupling post 95 may be illustrated with a plurality of openings, the first of which, $O_{95}$, being most proximal to rim 91F of the particular shell 91B in which it is illustratively provided. The second of opening in the multifunction coupling post 95 may be $O_{53}G$, which may be most proximal to exterior surface 92 of shell 91B by virtue of the fact that $O_{53}G$ passes from the interior surface 93 to the exterior surface 92 of the particular shell, here shell 91B, although such openings may be found in any shell 91A/B. FIG. 10A may also illustrate the various openings found in clutches 53, 53C-D, and 53F and coupling posts 94. For example, the opening $O_{53}$ of an exemplary clutch 53 located in an exemplary shell 91 may be configured to fit an exemplary PBB 10 rigid element (2 and/or 3) while opening $O_{94}$ may be configured to fit another type of structure that would mutually fit within the opposing coupling post 94 of the other shell 91 to allow the two to be joined as one into construct 310. As may be appreciated with reference to FIG. 10B, an exemplary multifunction coupling post 95 may have a coupling-post 94 type opening ($O_{95}$) spanning a portion of the length of the post 95 and an opening $O_{54}G$ similar to what may be found in clutches 53 directly connected and/or separated from the coupling post 94 type opening, $O_{95}$. Additionally, while the attachment region 96 may be illustrated as a recessed portion of surface 93 of the shell 91 in which it is found, this is not required nor should be deemed limiting. It should also be understood that while not shown, attachment region 96 may be found on surface 93, exterior surface 92, and on any other structures discussed (e.g., coupling post 94, clutches 53, and multifunctional coupling post 95). Referring back to FIG. 10A, an exemplary group of clutches 53 may have their own types of openings. For example, clutches 53C and 53D may have the same type of opening $O_{53}D1$, while clutches 53F may have opening $O_{53}F$.

Figure 10C:
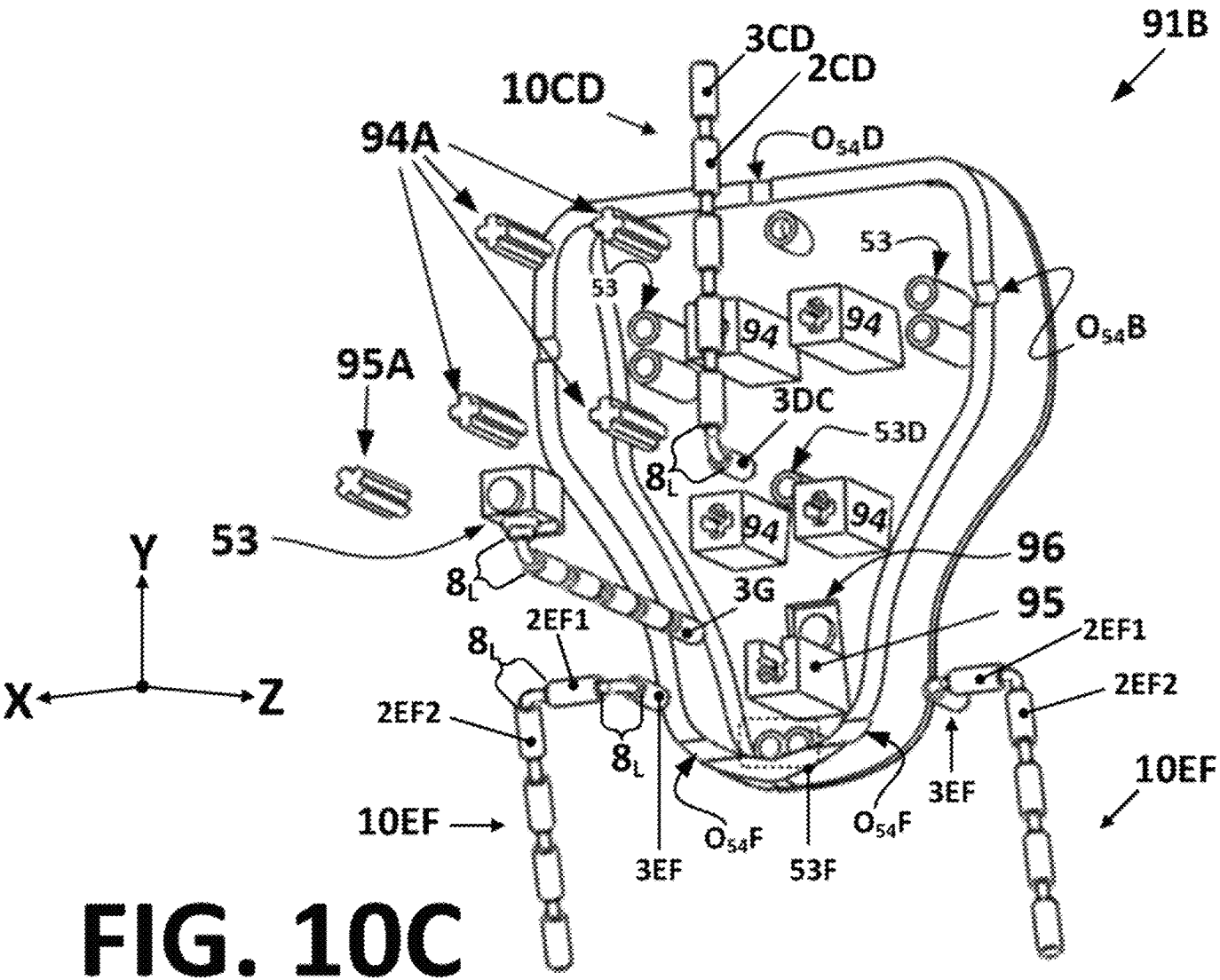

Referring to the illustrative embodiment of FIG. 10C, an exemplary shell 91B may be illustrated with numerous PBB 10 and other coupling mechanisms 94A and 95A illustrated. The coupling mechanisms 94A may be used so that they cooperatively engage the openings $O_{94}$ of the coupling posts 94 and coupling mechanism 95A may be used to cooperatively engage opening $O_{95}$ of the multifunction coupling post 95 of the exemplary shell 91A/B in which they may be found. An exemplary coupling mechanism 94A may be capable of friction fitting and/or snap-fitting two coupling posts 94 to cause a removable but robust connection between shells 91A/B. The same may be true for coupling mechanism 95A. In an exemplary embodiment, coupling posts 94 may utilize snap-fit or friction fitting mechanisms 94A that are also useable within the Lego® system to couple posts 94 located in adjacent shells 91A and 91B together. In a preferred embodiment, coupling mechanisms 94A may be Lego® Part Nos. 3704, 32062, 43093, 3749, 65249, 4519, 6587, 3705, 3705b, 99008, 32073, 3706, bb0301a, bb0301, pinpw2, 2736, and all variations, combinations, or known functional substitutes for and/or equivalents of the same). While $O_{94}$ and/or $O_{95}$ may be illustrated with the same cross-section, it should be understood that a particular coupling opening $O_{94}/O_{95}$ of one coupling post 94/95 may differ from other openings $O_{94}/O_{95}$ found in the coupling posts 94/95 located in the same shell 91 and/or may differ from the openings $O_{94}/O_{95}$ in the opposite shell 91 that are specifically configured to couple thereto. For example, the opening $O_{94}$ in a coupling post 94 in shell 91A may be of one cross-section and depth while the corresponding coupling post 94 in shell 91B may be of a different cross-section and/or depth due to the fact that the coupling mechanism 94A required for the shell coupling between shells 91A and 91B may be configured with two different coupling cross-sections.

Figure 10D:
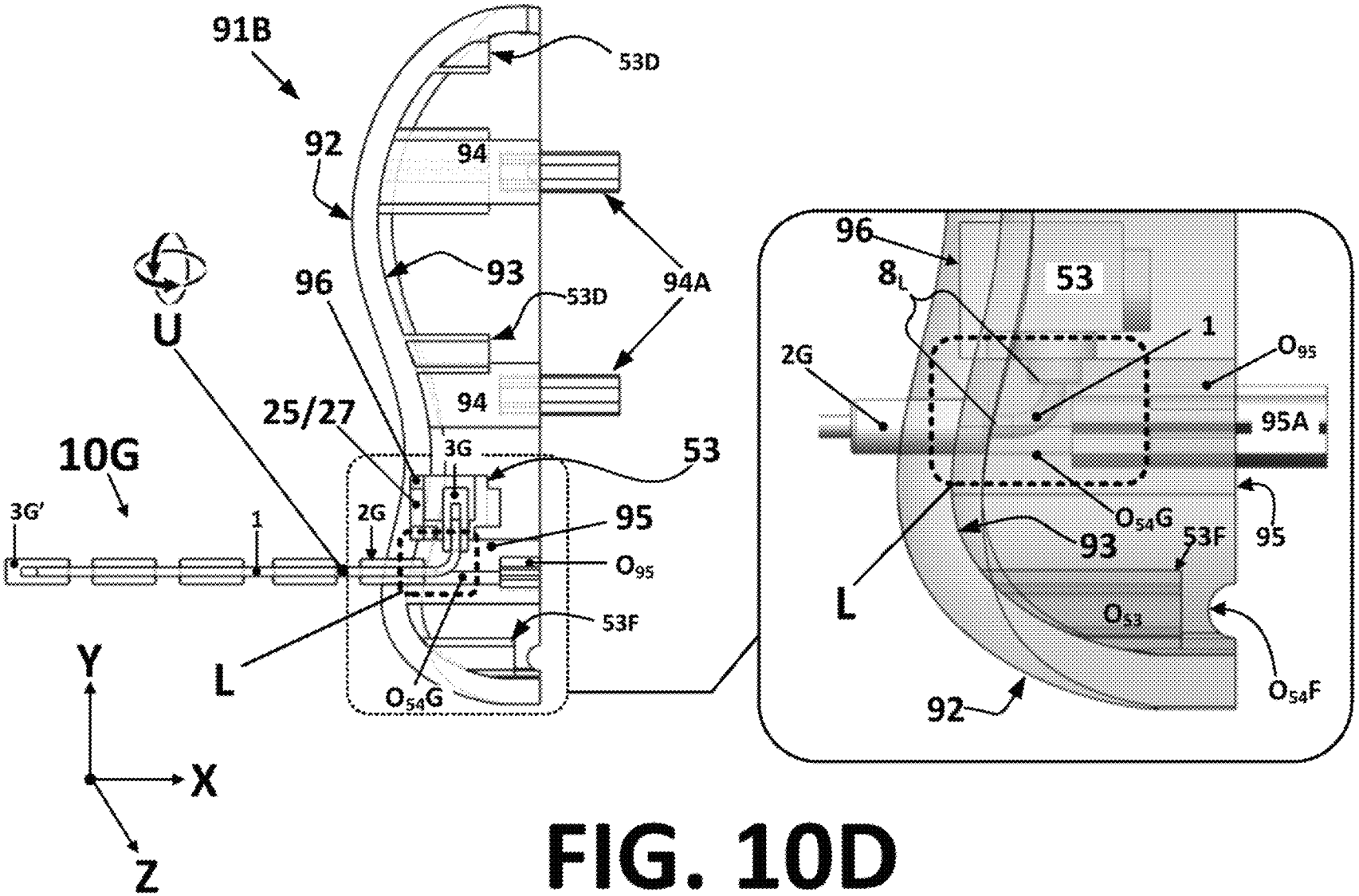

With continued reference to FIG. 10C, An exemplary PBB 10CD may be configured so that its end component 3DC may be positioned via an elbow-type formation $\mathbf{8}_L$ so that it may be inserted into clutch 53D extending from interior surface 93 of shell 91B. An exemplary PBB 10EF may be configured so that its end component 3EF may be positioned via an elbow-type formation $\mathbf{8}_L$ so that it may be inserted into clutch 53F extending from interior surface 93 of shell 91B. In addition to the exemplary PBB 10CD and 10EF, an exemplary clutch 53, which as illustrated may be an Erling-type Lego® brick Part Nos. 4070, 30069, and all variations, combinations, or known functional substitutes for and/or equivalents of the same, may be configured about another end component of PBB 10G such that end component 3G while being positioned via an elbow-type formation $\mathbf{8}_L$ may be may be passed through the opening $O_{95}$ of multifunctional coupling post 95 and may also be passed through the opening $O_{53}G$ (as illustrated in FIG. 10B). Simultaneously, as component 3G may be pass through each opening $O_{95}/O_{54}G$ of multifunctional coupling post 95, the exemplary clutch 53 coupled to PBB 10G may engage, via friction, snap-fit, screw-in, or other known forms of mechanical attachment, into or within attachment region 96 formed in interior surface 93 of shell 91B. As may be illustrated with further reference to FIG. 10D, the interconnecting engagement of clutch 53 of PBB 10G with an interconnecting stud 25/27 extending from shell 91B in region 96 may hold one end component 3G of PBB 10G in a first direction (e.g., the Y-axis direction in FIG. 10D) and the remainder of PBB 10G passing through multifunctional coupling post 95 via $O_{95}$ and $O_{53}G$ may hold a body component 2G of PBB 10G in a second direction (e.g., the X-axis direction in FIG. 10D). The orthogonal arrangement formed by end component 3G laying along the Y-axis and body component 2G laying along the X-axis may form a locking arrangement L through shell 91B. Thus, using a similar clutch 53 from FIGS. 1, 2A, 4, and 4A-D, an exemplary shell 91B with its opening $O_{54}$G may act as an equivalent to the lock 54 illustrated and disclosed with respect to those same embodiments. Like the clutch-lock 53/54 locking L arrangements formed in those figures, a similar locking arrangement L is formed as shown in FIG. 10D. With continued reference to FIG. 10D, the portion of the PBB 10G that exits shell 91B via opening $O_{54}$G, as illustrated as component 2G of PBB 10G, a universal joint U may result for the remainder of the posable component 1 and end component 3G'.

With reference to FIG. 10C, it may be appreciated that body components 2CD of PBB 10CD may be found within half-opening $O_{54}$D, just as body components 2EF1 may be found within half-opening $O_{54}$F. Meanwhile, opening $O_{54}$B may be vacant. The vacancy or filling of a particular half-opening may be contingent on how the PBB 10 involved is coupled to a particular shell 91 in which such half-opening may be found. As shown in FIG. 10C, because PBB 10EF is coupled within clutch 53F of shell 91B, body component 2EF1 of PBB 10EF may also be found in half-opening $O_{53}$F until the corresponding half-opening $O_{53}$E of shell 91A is used to close about the body component 2EF1 of the exemplary PBB 10EF. Similarly, because PBB 10CD may be coupled within clutch 53D of shell 91B, its end component 2CD may be found in half-opening $O_{54}$D until end component 2CD is closed upon by corresponding half-opening $O_{54}$E of shell 91A. In a preferred embodiment, the coupling of a PBB 10 to a half of an exemplary shell 91 prior to closure with the opposing shell 91 half reduces the possibility of PBB 10 falling out of their places of coupling and/or the half-openings where they are meant to flexibly and possibly operate. As may be further explained, the possibility of PBB 10EF may be taken advantage of to form two planarly diverse elbow-like formations $\mathbf{8}_L$. For example, elbow formation $\mathbf{8}_L$ between end component 3EF and body component 2EF1 may place end component 3EF along the X-axis, body component 2EF1 along the Z-axis, and body component 2EF2 along the Y-axis. Thus, constructions, like construction 310, and others described herein, may comprise a PBB 10 having multiple elbow formations $\mathbf{8}_L$ formed in the posable component 1 that are located in different planes and/or otherwise angularly offset from one another in three-dimensional space.

Referring to FIGS. 10E-G, an exemplary shell 91A may be illustrated with and without a PBB 10 therein. Like the shell 91B, exemplary shell 91A may also have coupling posts 94 with openings $O_{94}$ as discussed herein. Likewise, the clutches 53 found adjacent the half openings $O_{54}$A may be used like clutches 53, 53D, and 53F in shell 91B to create locking arrangements L between the shell 91A and an exemplary PBB 10, such as, for example, PBB 10AB. With specific reference to FIG. 10G, which is a snap-shot of the shell 91A with transparency to show the internal operations to be discussed herein, an exemplary PBB 10AB may have an exemplary end component 3AB with an elbow-like formation $\mathbf{8}_L$ between itself and the adjacent component (as illustrated in FIG. 10G, an exemplary body component 2AB) so as to be coupled within an exemplary clutch 53 via opening $O_{53}$ while the exemplary end component 2AB of PBB 10AB may be located within half-opening $O_{54}$A formed in rim 91E of an exemplary shell 91A. As discussed, coupling mechanisms 94A may be found in coupling post 94 extending upwardly from the interior surface 93 of shell 91A. While the exemplary end component 3AB may be seen as existing on the Y-axis, the existence of body component 2AB along the X-axis and elbow-like formation $\mathbf{8}_L$ may not yet form complete locking arrangement L with clutch 53. In an exemplary aspect, a locking arrangement L may not be present due to the fact that the opening $O_{54}$A is a half-opening and not substantially about body component 2AB to substantially resist its movement.

While structure need not fully envelop any exemplary PBB 10 component to create the locking arrangement L, those skilled in the art in possession of these disclosures may understand that there may be a sufficient amount of structure to at least resist the amount of play capable of the remainder of PBB 10 that is not coupled within the exemplary clutch 53 constituent of the construction 310. In the example illustrated in FIG. 10G, the absence of structure beyond one half of the circumference of component 2AB would not be considered a locking arrangement L, although structure beyond that amount may be sufficient to form the arrangement L provided the same would be rigid enough to prevent component 2AB from being dislodged from its position during normal use conditions (e.g., normal use of the construction by a person for whose age its use is directed, which in a range of ages, such person may be the youngest member of such age group designated to use such a construction). In a preferred embodiment, where construction 10 may be designated for use by persons six (6) years of age and older, an exemplary PBB 10 component may be deemed to be in a locking arrangement L when a $50^{th}$ percentile human male (as that standard exists on the filing date of these disclosures) who is no more than six (6) years of age can pull on and rotate the universal joint U formed thereby without any component 2/3 of the PBB 10 involved in the pulling and/or rotating to be decoupled from one or more of the clutch 53, lock 54, and any corresponding openings $O_{53}/O_{54}$. In an alternative embodiment, an acceptable locking arrangement L may be one in which PBB 10 components 2/3 resist displacement from one or more of the clutch 53, lock 54, and any corresponding openings $O_{53}/O_{54}$ when the remainder of the PBB 10 is pulled at its opposite end component 3 along an axis passing through the center of opening $O_{54}$ using the same amount of force needed to decouple shell 91A from shell 91B. In yet another alternative embodiment, an acceptable locking arrangement L may be one in which PBB 10 components 2/3 resist displacement from one or more of the clutch 53, lock 54, and any corresponding openings $O_{53}/O_{54}$ when the remainder of the PBB 10 is moved so that its opposite end component 3 is as orthogonal as possible to the axis passing through the center of opening $O_{54}$ and deflected in a circular path whose center is the axis passing through the center of opening $O_{54}$ while using the same amount of force needed to decouple shell 91A from shell 91B.

Referring to the illustrative embodiments of FIGS. 11A-E, an exemplary construction 310 may be formed from the joining of shells 91A and 91B together about one or more PBB, such as PBB 10AB, 1° C. D, and 10EF. As illustrated in FIG. 11B, an exemplary construct 310 may be formed from engagement of shells 91A and 91B via coupling posts 94 and coupling mechanisms 94A. Further, when shells 91A and 91B combine, the half-openings found in their respective rims 91E and 91F, respectively, may join to form a full opening through which a PBB 10 portion may pass from the clutch 53 of the shell in which it is found. For example, in FIG. 11B, an exemplary PBB 10AB may be locked by the combination of half opening $O_{54}$A in rim 91E of shell 91A and half opening 91B in the rim 91F of shell 91B. Consequently, when PBB 10AB has one component (here exemplary end component 3AB) within the opening $O_{53}$ of an exemplary clutch 53 and another component (here body component 2AB) within a lock 54 (as illustrated in FIG. 11B, wherein the lock 54 may be a combination of shells 91A, 91B, and their respective half-openings $O_{54}A$ and $O_{54}B$), the result may be a locking arrangement L and a portion of PBB 10AB following from the lock 54 (here the posable component 1 portion to the right of component 2AB in FIG. 11B) that may establish a universal joint U for the remainder of PBB 10AB. Additionally, an exemplary construct 310 may have one or more attachment regions 96 on one or more of the exterior surfaces 92 of shells 91A and/or 91B, such as, for example, in the illustrative embodiment of FIG. 11A.

Figure 11D:
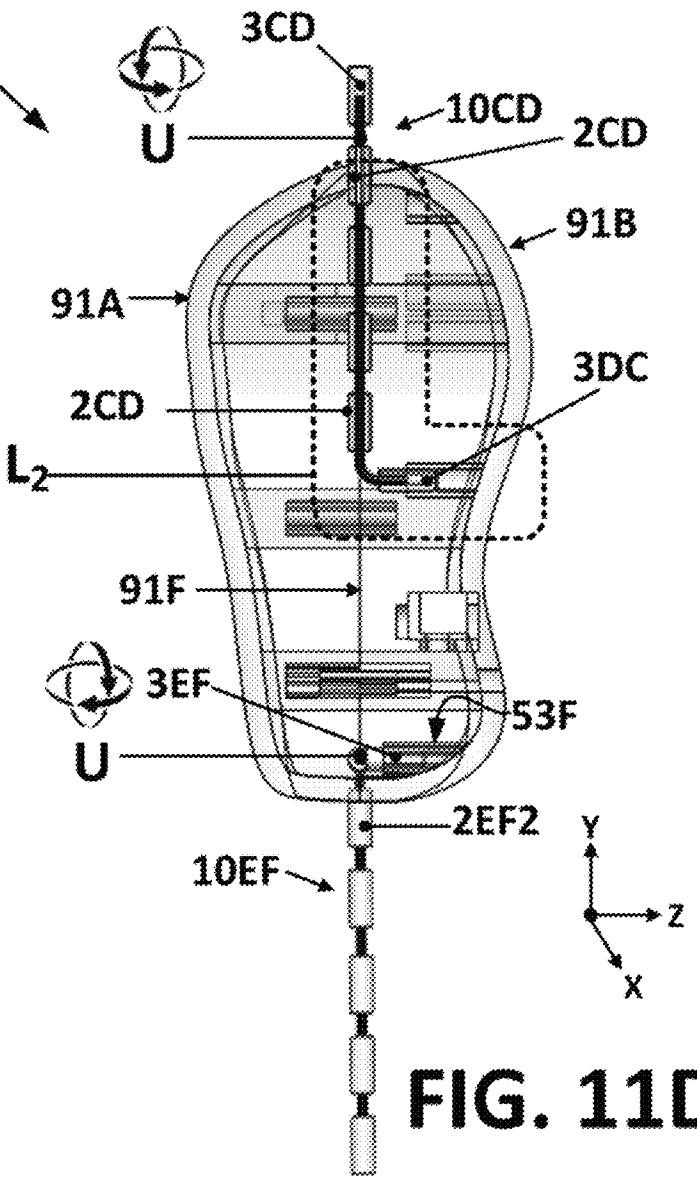
Figure 11C:
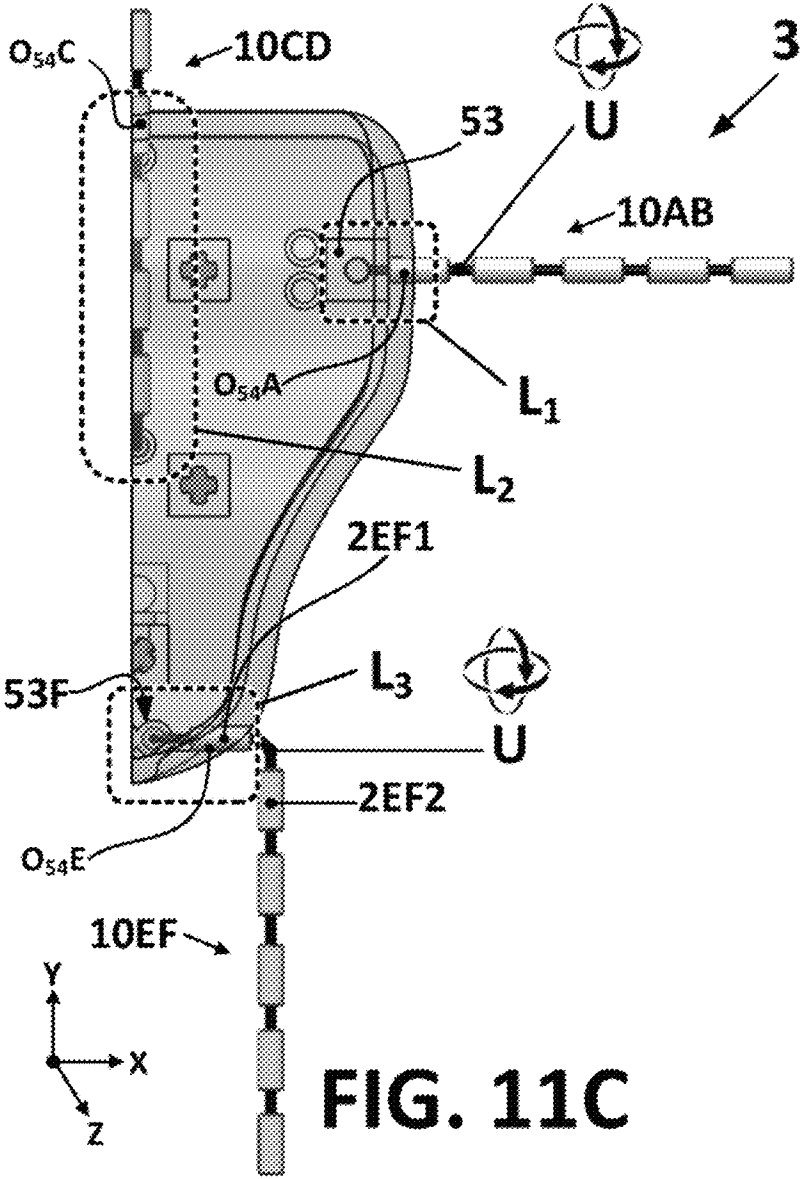
Figure 11E:
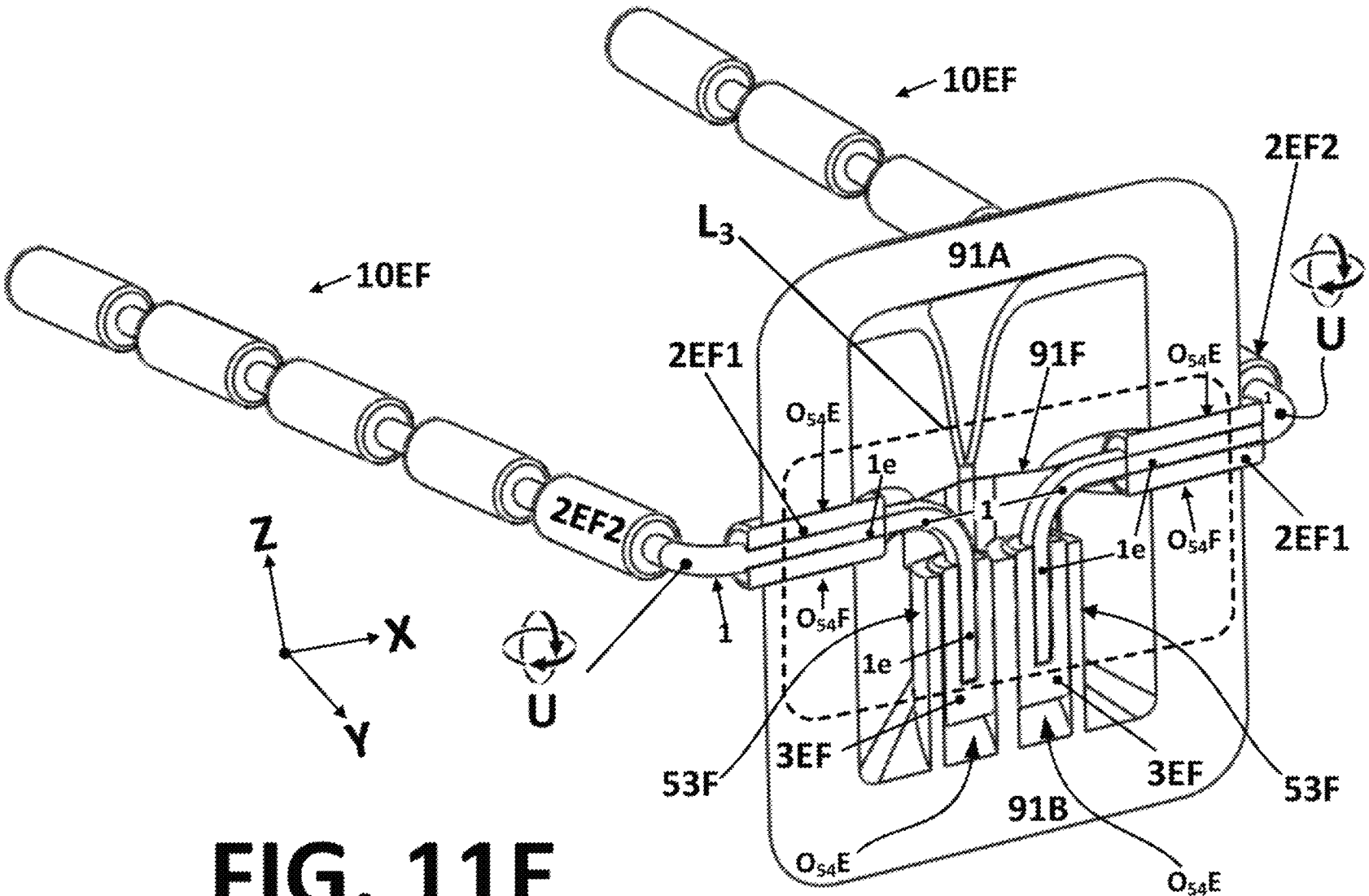

Referring to FIGS. 11C-D, it may be illustratively provided that an exemplary construction 310 may form a plurality of locking arrangements $L_1$, $L_2$, and $L_3$ from the variety of PBB 10 and structures in the shells 91A/91B. As illustratively provided for in FIG. 11C, an exemplary construction 310 may comprise a first locking arrangement $L_1$ formed by the elbow-like posable component 1 in PBB 10AB that interconnects the end component 3AB disposed in the clutch 53 extending from interior surface 93 of shell 91A and the body component 2AB disposed in the lock 54 formed by the combination of shell 91A/B half-openings $O_{54}A$ and $O_{54}B$, located in rims 91E and 91F of shells 91A and 91B, respectively. As illustratively provided for in FIG. 11C but with additional reference to FIGS. 10C, and 10E-F, an exemplary construction 310 may comprise a second locking arrangement $L_2$ formed by the elbow-like posable component 1 in PBB 10CD that interconnects the end component 3DC disposed in the clutch 53D extending from interior surface 93 of shell 91B and the body component 2CD disposed in the lock 54 formed by the combination of shell 91A/B half-openings $O_{54}C$ and $O_{54}D$, located in rims 91E and 91F of shells 91A and 91B, respectively. As may be appreciated with respect to locking arrangement $L_2$, the elbow formation in PBB 10CD may cause the PBB 10 component found within an exemplary clutch 53 (as illustrated in FIG. 11C, component 3DC within clutch 53D) to be distally located with respect to the next component in the lock 54 constituent of the locking arrangement (as illustrated in FIG. 11C, component 2CD within the lock 54 formed by the combination of (i) shell 91A opening $O_{54}A$ in rim 91E and (ii) shell 91B and its opening $O_{54}B$ in rim 91F). In other words, an exemplary locking arrangement, such as $L_2$, may result even if the components are separated over a large difference, e.g., up to their extreme end points. As illustratively provided for in FIG. 11D, an exemplary PBB 10CD may be substantially aligned with the division between shells 91A and 91B.

As illustratively provided for in FIG. 11C but with additional reference to FIGS. 10C, 10E-F, and 11E, an exemplary construction 310 may comprise a third locking arrangement $L_3$ formed by the elbow-like posable component 1 in PBB 10EF that interconnects the end component 3EF disposed in the clutch 53F extending from interior surface 93 of shell 91B and the body component 2EF1 disposed in the lock 54 formed by the combination of (i) shell 91A opening $O_{54}E$ in rim 91E and (ii) shell 91B and its opening $O_{54}F$ in rim 91F). As discussed herein, component 2EF1 may be shown lying along the X-axis while component 2EF2 may be shown lying along the Y-axis. Additionally, component 3EF may be shown lying along the Z-axis in FIGS. 11C and 11E). Those portions of PBB 10AB, PBB 10CD, and PBB 10EF that follow the lock 54 formed with respect to the identified components 2AB, 2CD, and 2EF1, may be enabled as exemplary universal joints U. A more detailed view of the interconnection of shells 91A, 91B, and PBB 10EF may be illustrated in FIG. 11E. As may be appreciated via FIG. 11E, the U-joint formed by PBB 10EF vis-à-vis shells 91A and 91B may increase the play capabilities of construction 10 and provide for movements that heretofore had be reserved for ball-and-socket joints, hinges, or other metal-to-plastic fastening methods. As may be appreciated from these disclosures, the use of an exemplary removable PBB 10 may enable an unlimited degree of possibility of those structures coupled to PBB 10. Further, if an exemplary PBB 10 U-joint is lost due to reduction in possibility in PBB 10 or breakage of the same, the construction 310 may be easily repaired by the user through replacement of the now-broken PBB 10 with anew PBB 10.

Figure 12B:
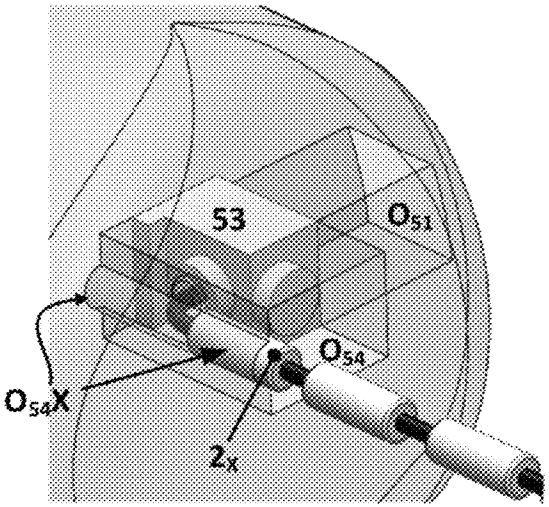
Figure 12C:
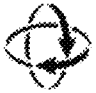
Figure 12C:
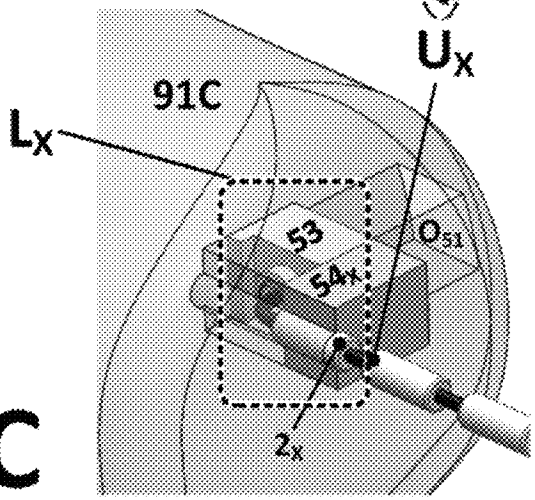
Figure 12A:
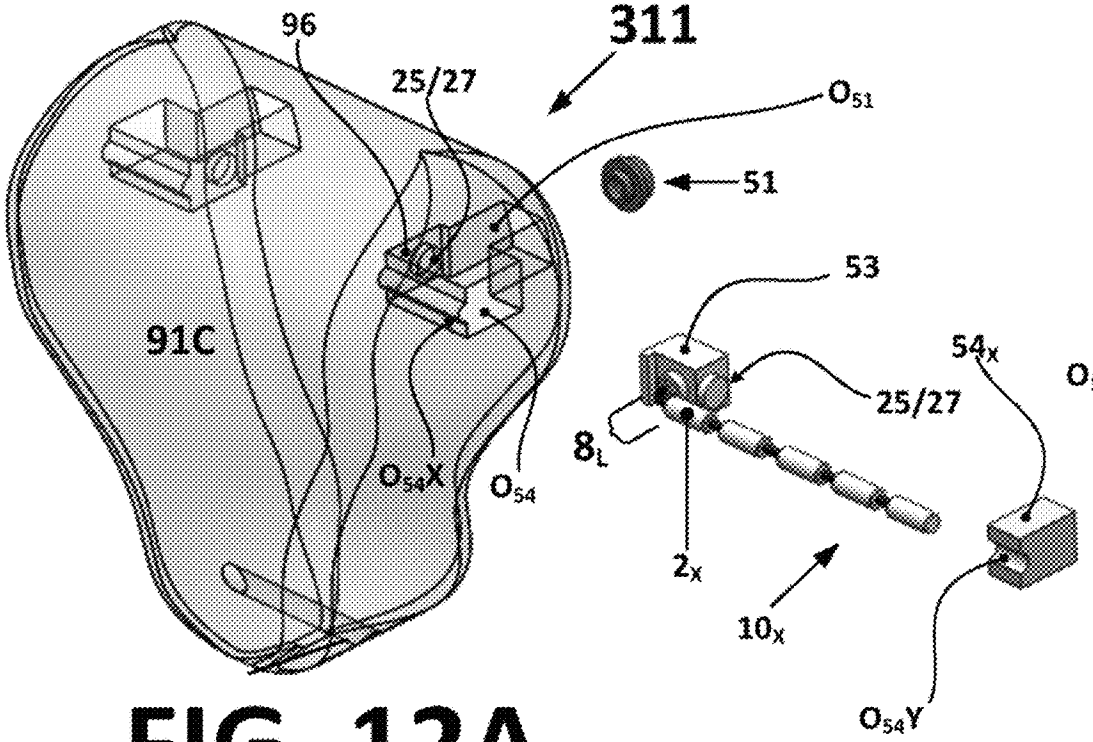

With reference to the illustrative embodiments of FIGS. 12A-F, an exemplary construction 311 may be shown with a body 91C that may be solid (i.e., having a majority of plastic making up the total volume of the structure) or may be hollow (i.e., like the shell construction 310 of FIGS. 11A-E or construction 312 of FIGS. 13A-C). Body 91C may have within it a plurality of openings, $O_{51}$, $O_{54}$, and $O_{54}X$. Further, body 91C may have within or on it an attachment region 96 comprised of attachment means, such as, for example, an interconnecting building block stud 25/27, but it may take the form of other known building block and other construction toy interconnections (e.g., those of Lego®, K'nex®, Cre-O®, Construx, Built-to-Rule, and other building block toys known to those skilled in the art). As may also be illustrated in FIG. 12A, an exemplary clutch 53 may be coupled to an appropriately configured PBB $10_X$ such that an exemplary elbow-like formation $8_L$ may be formed between clutch 53 and the component(s) of PBB $10_X$ (which as illustrated in FIG. 12A may be component $2_x$). Further illustrated on clutch 53 in FIGS. 12A-B may be an interconnecting stud 25/27 as well as a cavity 9 (not shown) that is on the surface of clutch 53 directly opposite stud 25/27. In an exemplary embodiment, clutch 53 may be attached within body 91C at the attachment region 96 so that the exemplary PBB $10_X$ may be held in place within opening $O_{54}X$, which in a preferred embodiment spans a distance substantially from the outside of body 91C to the attachment region 96, such as may be illustrated in FIG. 12B. However, in other alternative embodiments, opening $O_{54}X$ may only span as far as needed to ensure adequate placement of the clutch 53 and the PBB $10_X$ with an elbow-like formation $8_L$.

Further illustrated in FIGS. 12A-D, a partial lock $54_X$ may be used to couple to the clutch 53, another attachment region 96, another portion of body 91C, or combinations of the same. As may be appreciated with respect to the illustrative example of partial lock $54_X$, such part may be specifically designed to function in two manners: (i) to engage clutch 53 or attachment region 96 (e.g., via an exemplary coupling such as the friction-fit interconnecting arrangement with stud 25/27) or alternatively couple to some other portion of body 91C; and (ii) form a complete lock 54 by virtue of joining half-opening $O54_X$ and half-opening $O_{54}Y$ when each of clutch 53 and partial lock $54_X$ are coupled to one another. In an exemplary embodiment, partial lock $54_X$ may be designed to blend into the other surfaces of body 91C that surround opening $O_{54}$ when partial lock $54_X$ is coupled to clutch 53, as may be illustrated in FIG. 12D. An exemplary engagement between clutch 53, body 91C, partial lock $54_X$, and openings $O_{54}X$ and $O_{54}Y$ may result in another form of locking arrangement $L_X$ after which the remainder of the PBB $10_X$ may be configured as a universal joint $U_X$.

Figure 12E:
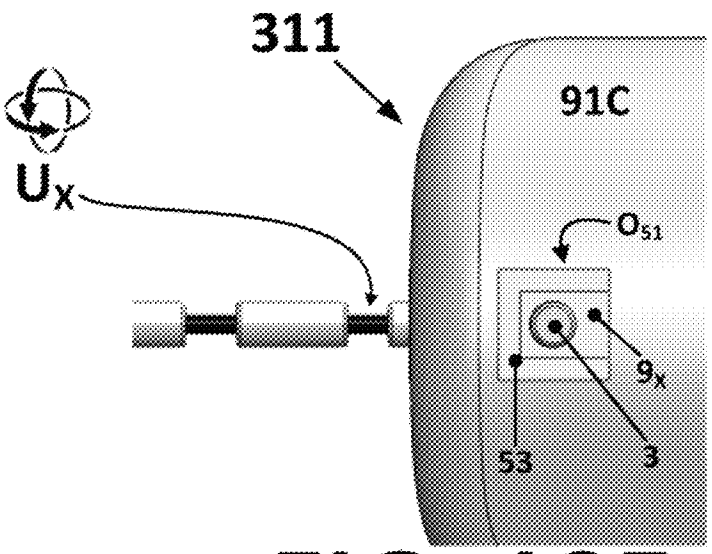
Figure 12D:
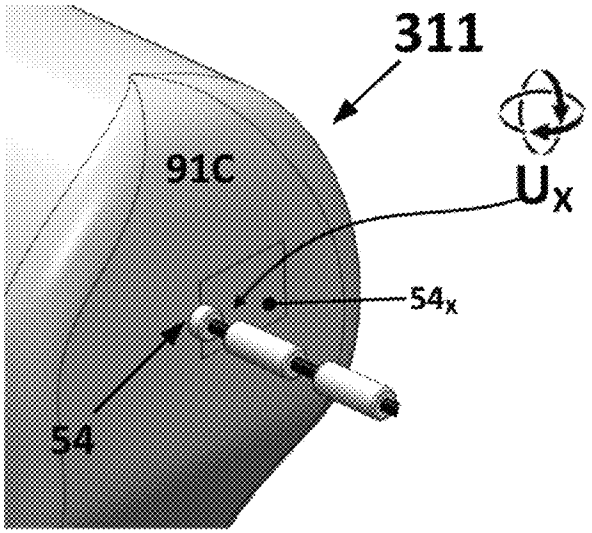
Figure 12F:
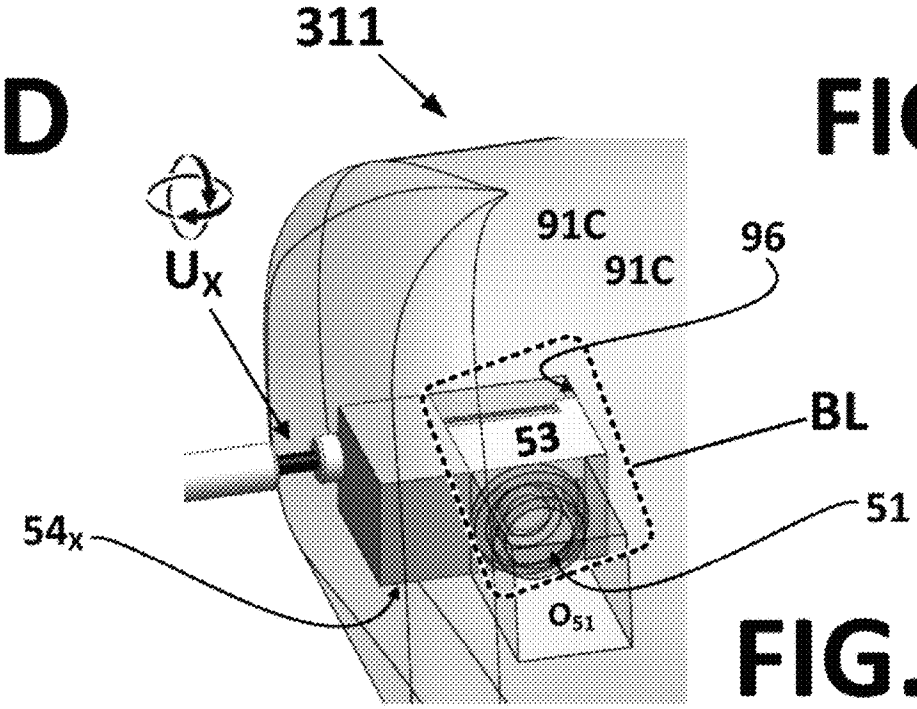

With continued reference to FIGS. 12A-C and additionally FIGS. 12E-F, it may be provided that another opening, $O_{51}$ may can be formed in body 91C. Such opening $O_{51}$ maybe configured for receiving any other structure that may be used to hold clutch 53 within the body 91C, e.g., to keep clutch 53 attached to attachment region 96 so as not to be pulled out. In other words, $O_{51}$ may be a channel through body 91C into which another snap-fit interconnecting building block 51 may be passed to then friction interconnect with another cavity $9_X$ in clutch 53 and thereby lock clutch 53 within body 91C. Like partial lock $54_X$, an exemplary block 51 may have surface features that when it is coupled to clutch 53 allows block 51 to blend into the other surfaces of body 91C that surround opening $O_{51}$. Unlike an exemplary locking arrangement $L_X$ formed by PBB $10_X$ and clutch 53, lock 54, and body 91C, an exemplary combination of block 51 and clutch 53 may create a block-lock BL within the construction 311.

With reference to FIGS. 13A-B, an exemplary construct 312 may be made of shells 91A and 91B, as was the case for construct 310, but with exemplary PBB 10AB, PBB 10AB", and PBB 10EF and slot clutches 53*. As may be shown in FIG. 13B via transparency in shell 91B, an exemplary slot clutch 53A* may be formed by a combination of the openings $O_{54}$A and $O_{54}$B in the rims 91E and 91F of shells 91A and 91B, respectively, such that at least one component of an exemplary PBB 10 (such as exemplary end component 3AB of PBB 10AB) may be able to rotate like an action figure arm joint within the construct 312. Similarly, as shown in FIG. 13B via transparency in shell 91B, an exemplary slot clutch 53E* may be formed by a combination of the openings $O_{54}$E and $O_{54}$F in the rims 91E and 91F of shells 91A and 91B, respectively, such that at least one component of an exemplary PBB 10 (such as exemplary end component 3EF of PBB 10EF) may be able to rotate like an action figure arm joint within the construct 312. A more detailed view of an exemplary shell for use with a construct 312 may be illustrated in FIG. 13C. It may be appreciated, that an exemplary construct 312 may be formed from the same shell 91A and/or 91B provided the slot clutches 53* remain substantially aligned when assembled to one another to allow rotation of at least one component of the exemplary PBB 10 coupled thereto.

With reference to the illustrative embodiment of FIG. 13C, an exemplary shell may comprise an interior surface 93 and a rim 91E as well as many other structures similar to those in the shells 91A and 91B of the construction 310 illustratively provided for in FIGS. 10 and 10A-G. According to the illustrative embodiment of FIG. 13C, an exemplary slot clutch 53A* may be a structure that may permit full or partial rotation of at least one component 2/3 of an exemplary PBB 10 (here exemplary end component 3AB of exemplary PBB 10AB). A retainer 58 of the slot clutch 53A* may be used to rotatably hold another component 2/3 of an exemplary PBB 10 (here exemplary body component 2AB of exemplary PBB 10AB in FIG. 13C). While opening $O_{54}$A and $O_{54}$B located near the surface of shell 91 adjacent to retainer 58 may allow for translation of the rotatably held other component (here component 2AB in FIG. 13C) either inwardly or outwardly (i.e., along the X-axis of origin $11_{AB}$) from construction 312, in an exemplary embodiment, an upper half-jaw 58*c*1 and a lower half-jaw 58*c*2 may be located adjacent a slot clutch 53A* and/or found within rim 91E of the shell 91 in which it is formed. In an exemplary embodiment, when two shells with one or more half-jaws are combined, then the PBB 10 component that may be located adjacent to slot clutch 53A* (component 2AB in FIG. 13C) but is orthogonal to the component(s) within the slotted portion of the clutch 53A* (component 3AB in FIG. 13C), may be precluded from being disposed beyond the full or partial jaws formed in the shells. It is contemplated that only one half-jaw may be necessary to preclude such alluded to movement of the PBB 10 in an exemplary construct 312.

As further illustrated in FIG. 13C, an exemplary PBB 10AB may have at least one component, such as exemplary end component 3AB, rotating in the plane bounded by the Y-Z axes while another component, exemplary body component 2AB, remains on the X-axis (both axis references being to those with origin $11_{AB}$). As a result of the slot clutch 53A* and retainer 58 formation and at least one jaw 58*c*1/2, an exemplary revolutionary universal joint R/U may be established for the PBB 10AB. It may be deemed advantageous to have an R/U joint for an exemplary construction 312 when a construction 312 involves repeated rotation of the exemplary PBB 10 but may also benefit from the possibility provided by the PBB 10 when not engaged in rotation. In an exemplary embodiment, the use of PBB 10 in an R/U joint gives the user of construction 312 the ability to replace worn ends (such as 3AB in FIG. 13C for example) to ensure a controlled and friction-fit within slot clutch 53A*. Alternatively, while slot clutch 53A* may be illustrated as one integrated component extending from interior surface 93, it may be conceivable that slot clutch 53A* may be a combination of pieces that attach to interior surface 93 via an attachment region so that if slot clutch 53A* begins to wear from repeated use of the R/U joint of construction 312, then a user can easily replace the slot clutch 53A* constituent pieces and resume a more tight or posable R/U joint. Further contemplated in the illustrative embodiment of FIG. 13C may be the existence of a clutch 53 without any slot (i.e., one with just an opening $O_{53}$ designed for the same or a different PBB 10 component 2/3) that may be used to form the locking arrangement L using exemplary end component 3AB' (not shown) disposed in a clutch 53, while components 2AB' and 2AB" span the slot clutch 53A* to allow exit of an exemplary PBB 10, e.g., such as exemplary PBB 10AB", from the shell rim 91E and formation of the universal joint $U_Y$.

While an exemplary slot clutch 53A* may possess an alternative in a clutch 53, it may be seen from exemplary slot clutches 53E* in FIG. 13C that no such option may exist for a clutch 53 for the exemplary PBB 10EF. Additionally, the slot clutch 53E* may be angled within construction 312 such that at least one component 2/3 of an exemplary PBB 10 (e.g., component 3EF of PBB 10EF) may be rotatable within a slotted section formed by the joinder of shells 91A and 91B of construction 312 that lay in a plane Y-Z that is angled from the rotation plane Y-Z with respect to another slot clutch 53* (e.g., 53A* in FIG. 13C). Likewise, another component 2/3 of the exemplary PBB 10 (e.g., 2EF) may then lay within an opening $O_{54}$E and/or $O_{54}$F adjacent slot clutch 53E* and rotate about the X-axis in response to rotation movement of PBB 10EF. Importantly, unlike the jaws 58*c*1/2 and retainer 58 associated with slot clutch 53A*, an exemplary slot clutch 53E* may not require any such structure due to the nature of the slot clutch 53E* and the PBB 10EF rotatable therein. In the exemplary embodiment illustrated in FIG. 13C, an exemplary PBB 10EF may be considered locked within construct 312 in spite of no jaws 58*c* and/or retainer 58 due to the geometry and design of the PBB 10EF vis-à-vis slot clutch 53E*. In other words, using a pulling force encountered during construction 312 use conditions (e.g., normal use of the construction by a person for whose age its use is directed, which in a range of ages, such person may be the youngest member of such age group designated to use such a construction) the exemplary PBB 10EF may not be removable from construction 312 due to the fact that the at least component 3/2 within slot clutch 53E* cannot be pulled through the orthogonal opening $O_{54}E/O_{54}F$ due to its size, positioning, length of posable component 1, length of elbow-like formation $\mathbf{8}_L$, and combinations of the same.

Shells 91A and/or 91B may provide an additional play experience and manufacturing benefit for toy constructions in that they may use less plastic and can be replaced on the component level in the event of breakage of the shells themselves or their inner components, e.g., PBB 10. Thus, a user of a toy construction 310 (as well as constructions 311-312) may build the action figure or toy comprising the construction 310 and either customize or reconfigure the construction as needed and replace broken parts individually without having to manufacture, or on the consumer side, obtain an entire new figure or toy. In addition to the end user, the manufacturer of such constructions 310-312 may be able to reduce raw material and assembly costs by allowing users to "build" their action figure or doll from the shells 91A/B. Not only does the shell 91A/B exemplary designs herein function to increase the play value of the toy construction, but they may also promote incorporating engineering principles into the play process by allowing users to design their toy, experience how their toys work from the inside, and be able to customize them as well (e.g., deciding whether to use an R/U joint via a slot clutch 53A* or use a U-joint via a clutch 53 in a particular shell 91).

While each of the constructs 300, 301, 302, 302*a*, 302*b*, 303, 304, 305, 306, 307, 308, 309, 310, 311, and 312 may have been shown and described with respect to their specific features, alternatives, and illustrations, any of the aforementioned and disclosed constructions and all variations of the PBB 10 and/or rigid components 2/3 and/or structures 50*a-g*, and 51-58 comprising the same may be used in any combination and frequency to design a toy or toy system. Further, any shell 91A/B, body 91C, and coupling structures 94/95/96 may be used in combination or in different configurations to achieve a desired construction. Additionally, while the shells 91A/B and body 91C may be of a form similar to a torso, chest, waist, or center of a particular figure or structure, such shells 91A/B and/or body 91C may be the appendages, head, neck, hands, feet, fins, tails, wings, or any other accessory to accompany such constructions 310-312. In other words, the disclosures herein for such constructions 310-312 may be used to form constructable forms of any pre-existing figure or posable toy known to those skilled in the art, e.g., GI-Joe®, He-Man™, Barbie®, any and all characters from Marvel® comics, DC® comics, Spawn®, Teenage Mutant Ninja Turtles®, My Little Pony, Lego®, Disney®, Warner Brothers. The disclosures herein for such constructions 310-312 may be used to form constructable forms of sports players, actors, fictional characters, non-fictional characters, and cartoons. The disclosures herein for such constructions 310-312 may be used to form constructable forms of educational elements such as periodic elements, animal or insect skeletons, or celestial bodies.

Each part of any disclosed construction, with the exception of PBB 10, may be manufactured using known methods, such as vertical and/or horizontal injection molding, over-molding, casting, welding, stamping, thermoforming, and additive manufacturing methods (i.e., "3D printing").

Additionally, any of the coupling methods described herein may be used in any construct otherwise disclosed herein, as well as all variations and combinations of the same. For example, the C clamp of construct 301 may be used in conjunction to terminate a PBB 10 in a terminator construct 307. As another example, an exemplary bendable bracket 80 may be used on each PBB 10 used as part of an exemplary construct 303. As still a further example, one or more of the same construct 302*b* may be used in combination with the C-clamp and other revolute joint systems in any of the other constructs.

Many further variations and modifications may suggest themselves to those skilled in art upon making reference to above disclosure and foregoing interrelated and interchangeable illustrative embodiments, which are given by way of example only, and are not intended to limit the scope and spirit of the interrelated embodiments of the invention described herein.

The invention claimed is:

1. A toy construction, comprising:

a posable metal component having a first terminus and a second terminus;

a first rigid component comprised of a material embedded in the first terminus;

a second rigid component comprised of the material;

a clutch having at least one opening with a first central axis;

a lock having at least one opening with a second central axis, wherein the first central axis and the second central axis are not colinear, wherein the first rigid component is disposed in the at least one opening in the clutch and the second rigid component is disposed adjacent the at least one opening in the lock, wherein a portion of the posable metal component between the first rigid component and the second rigid component is configured to be bent with respect to one of the clutch and the lock.

2. The toy construction of claim 1, wherein the first central axis is substantially orthogonal to the second central axis.

3. The toy construction of claim 1, wherein the first central axis is substantially parallel to the second central axis.

4. The toy construction of claim 1, wherein the clutch and the lock are each a snap-fit interconnecting building block toy.

5. The toy construction of claim 4, wherein the clutch and the lock are each the same snap-fit interconnecting building block toy.

6. The toy construction of claim 1, wherein the clutch is integrally molded into a shelled structure.

7. The toy construction of claim 1, wherein a portion of the lock is molded into a shelled structure.

8. The toy construction of claim 7, wherein the clutch is integrally molded into the shelled structure.

9. The toy construction of claim 8, wherein the first central axis is substantially orthogonal to the second central axis.

10. The toy construction of claim 1, wherein the clutch is integrally molded into a first shelled structure, a first portion of the lock is molded into the first shelled structure, and a second portion of the lock is molded into a second shelled structure, wherein the second shelled structure is configured to combine with the first shelled structure to form the lock from the first portion and the second portion.

11. The toy construction of claim 10, wherein the first central axis is substantially orthogonal to the second central axis.

12. The toy construction as in any of claims 2-10, wherein the clutch and the lock are integrally molded with one another.

* * * * *